US010276924B2

(12) United States Patent
Lee et al.

(10) Patent No.: US 10,276,924 B2
(45) Date of Patent: Apr. 30, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventors: Cheng-Han Lee, New Taipei (TW); Yi-Wen Hsu, New Taipei (TW); Wei-Xuan Ye, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/647,282

(22) Filed: Jul. 12, 2017

(65) Prior Publication Data

US 2018/0026346 A1 Jan. 25, 2018

Related U.S. Application Data

(60) Provisional application No. 62/364,303, filed on Jul. 19, 2016.

(30) Foreign Application Priority Data

Jun. 29, 2017 (CN) ..... 2017 1 0518152

(51) Int. Cl.

| | |
|---|---|
| ***H01Q 1/24*** | (2006.01) |
| ***H01Q 5/10*** | (2015.01) |
| ***H01Q 9/42*** | (2006.01) |
| ***H01Q 13/10*** | (2006.01) |

(Continued)

(52) U.S. Cl.

CPC ..... *H01Q 1/243* (2013.01); *H01Q 5/10* (2015.01); *H01Q 5/371* (2015.01); *H01Q 9/42* (2013.01); *H01Q 13/10* (2013.01); *H01Q 21/28* (2013.01)

(58) Field of Classification Search

CPC ..... H01Q 1/243; H01Q 5/10; H01Q 5/371; H01Q 13/10; H01Q 9/0421; H01Q 9/42; H01Q 1/36; H01Q 1/48; H01Q 9/0485; H01Q 9/0414; H01Q 9/0457; H01Q 9/14;

(Continued)

(56) References Cited

U.S. PATENT DOCUMENTS 6,650,294 B2 * 11/2003 Ying ..... H01Q 1/243 343/700 MS
2014/0347227 A1 11/2014 Iellici et al.
2015/0123871 A1 5/2015 Chang et al.

(Continued)

FOREIGN PATENT DOCUMENTS

WO WO2013135043 * 9/2013 ..... H01Q 1/243

*Primary Examiner* — Jianxun Yang
(74) *Attorney, Agent, or Firm* — ScienBiziP, P.C.

(57) ABSTRACT

An antenna structure includes a metal housing, a first feed source, and a first radiator. The metal housing includes a front frame, a backboard, and a side frame. The side frame defines a slot and the front frame defines a gap. The metal housing is divided into at least a long portion and a short portion by the slot and the gap. The radiator is positioned in the housing and includes a first radiating portion and a second radiating portion. One end of the first radiating portion is electrically connected to the first feed source and another end of the first radiating portion is spaced apart from the long portion. One end of the second radiating portion is electrically connected to the first feed source and another end of the second radiating portion is spaced apart from the short portion.

24 Claims, 83 Drawing Sheets

(51) Int. Cl.
*H01Q 21/28* (2006.01)
*H01Q 5/371* (2015.01)

(58) Field of Classification Search
CPC ..... H01Q 19/005; H01Q 21/00; H01Q 9/04; H01Q 5/20; H01Q 5/30; Y10T 29/49018
See application file for complete search history.

(56) References Cited

U.S. PATENT DOCUMENTS

2015/0364820 A1* 12/2015 Dong ..... H01Q 5/10 343/729
2015/0372372 A1* 12/2015 Lee ..... H01Q 1/243 343/702

* cited by examiner

ANTENNA STRUCTURE AND WIRELESS COMMUNICATION DEVICE USING SAME

CROSS-REFERENCE TO RELATED APPLICATIONS

This application claims priority to Chinese Patent Application No. 201710518152.4 filed on Jun. 29, 2017, and claims priority to U.S. patent application Ser. No. 62/364,303, filed on Jul. 19, 2016, the contents of which are incorporated by reference herein.

FIELD

The subject matter herein generally relates to an antenna structure and a wireless communication device using the antenna structure.

BACKGROUND

Metal housings, for example, metallic backboards, are widely used for wireless communication devices, such as mobile phones or personal digital assistants (PDAs). Antennas are also important components in wireless communication devices for receiving and transmitting wireless signals at different frequencies, such as signals in Long Term Evolution Advanced (LTE-A) frequency bands. However, when the antenna is located in the metal housing, the antenna signals are often shielded by the metal housing. This can degrade the operation of the wireless communication device. Additionally, the metallic backboard generally defines slots or/and gaps thereon, which will affect a structural integrity and an aesthetic quality of the metallic backboard.

BRIEF DESCRIPTION OF THE DRAWINGS

Implementations of the present technology will now be described, by way of example only, with reference to the attached figures.

DETAILED DESCRIPTION

Figure 1:
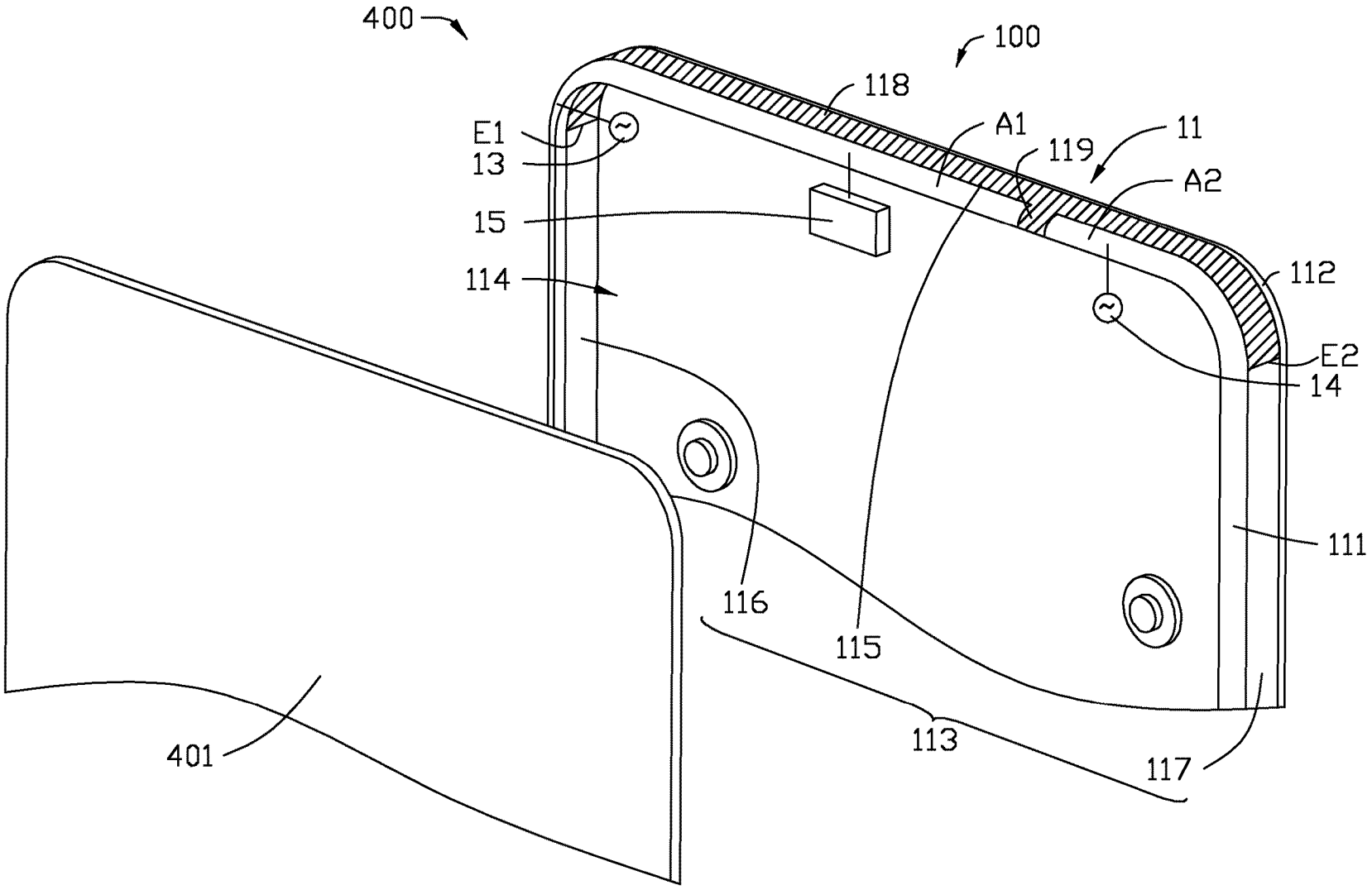
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

Exemplary Embodiment 1-2:

FIG. 1 illustrates an embodiment of a wireless communication device 400 using a first exemplary antenna structure 100. The wireless communication device 400 can be a mobile phone or a personal digital assistant, for example. The antenna structure 100 can receive and/or transmit wireless signals.

Figure 2:
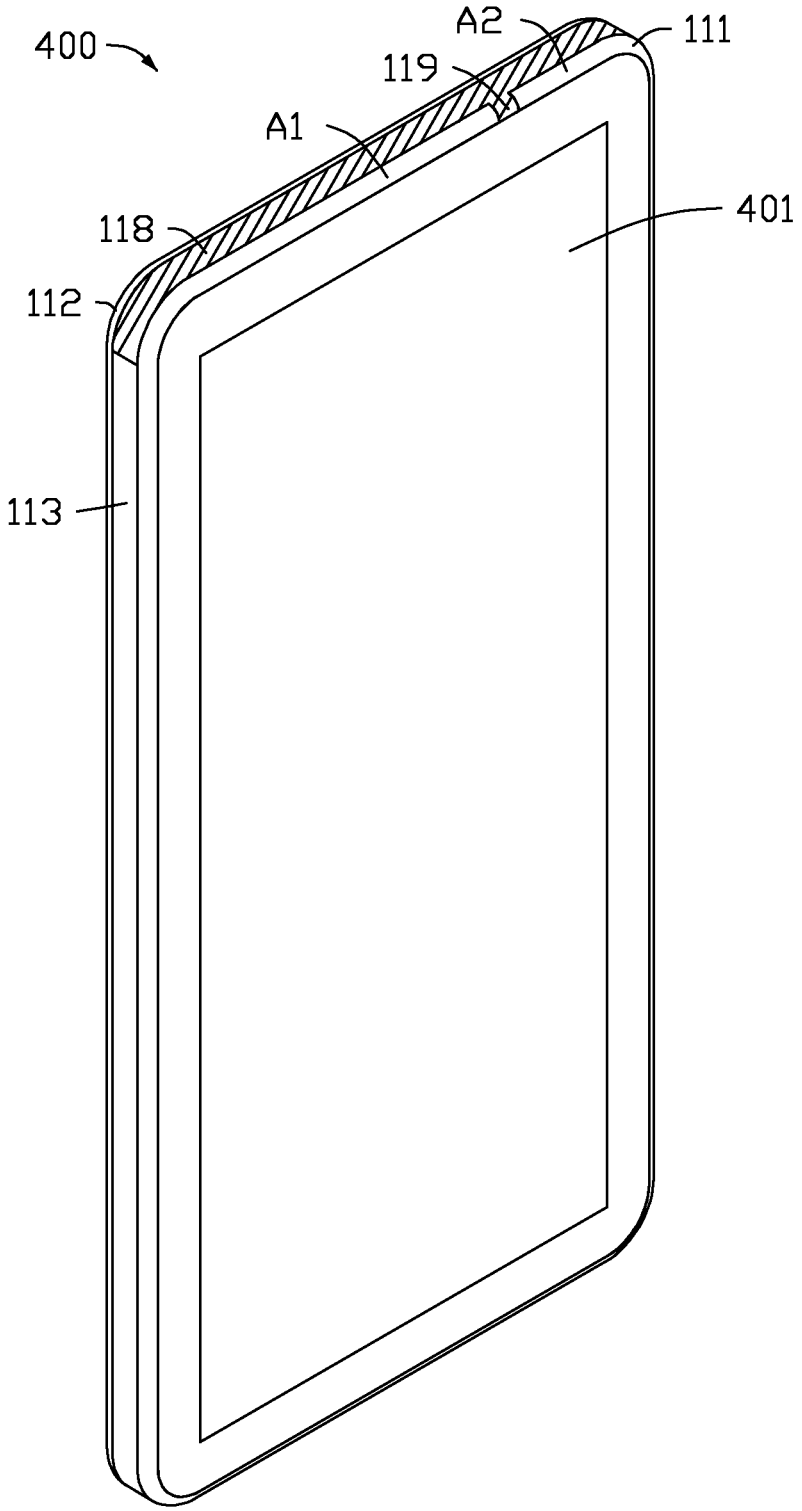
FIG. 2 is an assembled, isometric view of the wireless communication device of FIG. 1.
Figure 3:
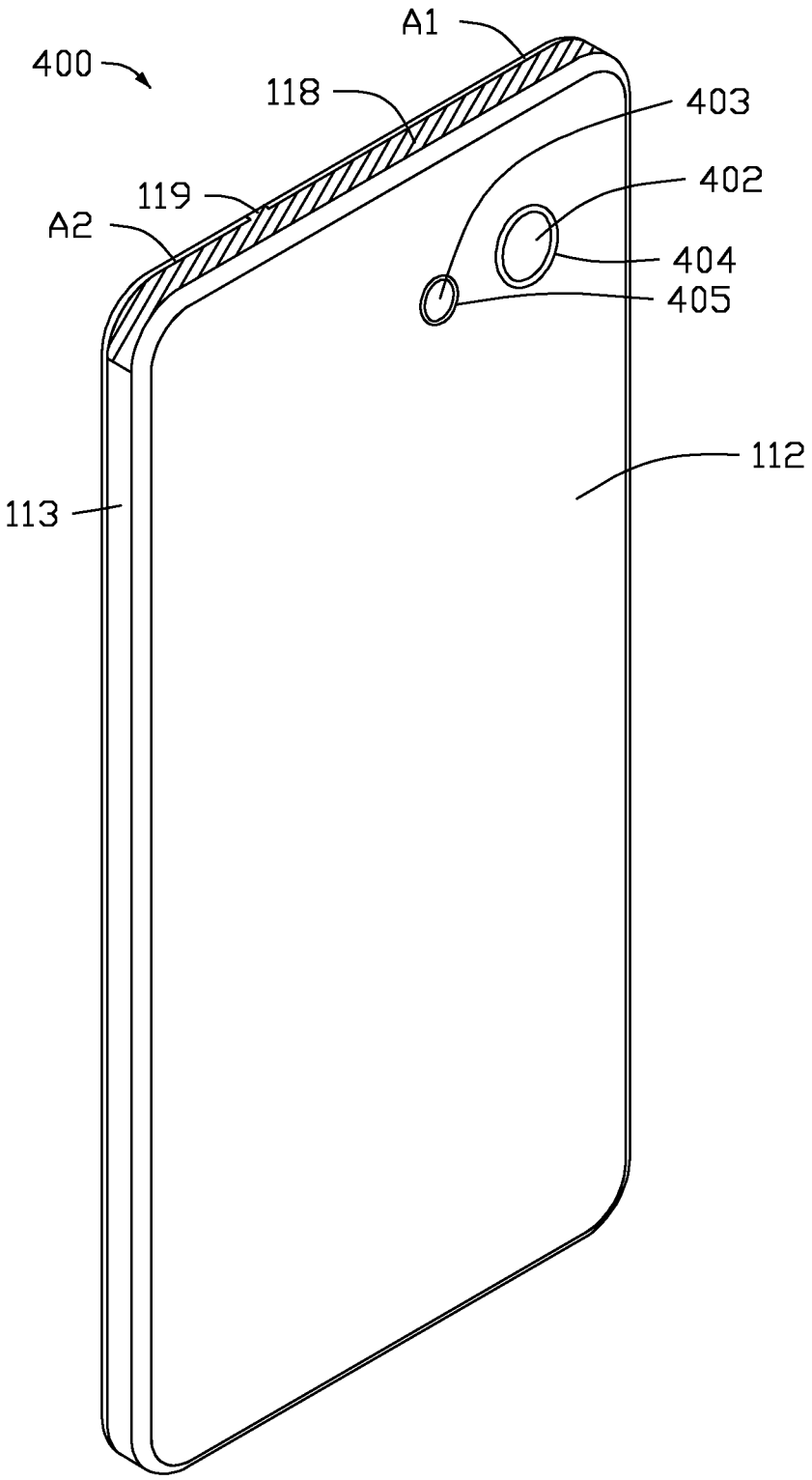
FIG. 3 is similar to FIG. 2, but shown from another angle.

Per FIG. 2 and FIG. 3, the antenna structure 100 includes a metallic member 11, a first feed source 13, a second feed source 14, and a first switching circuit 15. The metallic member 11 can be a metal housing of the wireless communication device 400. In this exemplary embodiment, the metallic member 11 is a frame structure and includes a front frame 111, a backboard 112, and a side frame 113. The front frame 111, the backboard 112, and the side frame 113 can be integral with each other. The front frame 111, the backboard 112, and the side frame 113 cooperatively form the metal housing of the wireless communication device 400.

The front frame 111 defines an opening (not shown). The wireless communication device 400 includes a display 401. The display 401 is received in the opening. The display 401 has a display surface. The display surface is exposed at the opening and is positioned parallel to the backboard 112.

The backboard 112 is positioned opposite to the front frame 111. The backboard 112 is an integral and single metallic sheet. The backboard 112 defines holes 404, 405 for exposing a camera lens 402 and a flash light 403. The backboard 112 does not define any slot, break line, and/or gap for dividing the backboard 112. The backboard 112 serves as a ground of the antenna structure 100.

The side frame 113 is positioned between the front frame 111 and the backboard 112. The side frame 113 is positioned around a periphery of the front frame 111 and a periphery of the backboard 112. The side frame 113 forms a receiving space 114 together with the display 401, the front frame 111, and the backboard 112. The receiving space 114 can receive a print circuit board, a processing unit, or other electronic components or modules.

The side frame 113 includes a top portion 115, a first side portion 116, and a second side portion 117. The top portion 115 connects the front frame 111 and the backboard 112. The first side portion 116 is positioned apart from and parallel to the second side portion 117. The top portion 115 has first and second ends. The first side portion 116 is connected to the first end of the first frame 111 and the second side portion 117 is connected to the second end of the top portion 115. The first side portion 116 connects the front frame 111 and the backboard 112. The second side portion 117 also connects the front frame 111 and the backboard 112.

The side frame 113 defines a slot 118. The front frame 111 defines a gap 119. In this exemplary embodiment, the slot 118 is defined at the top portion 115 and extends to the first side portion 116 and the second side portion 117. In other exemplary embodiments, the slot 118 is defined only at the top portion 115 and does not extend to any one of the first side portion 116 and the second side portion 117. In other exemplary embodiments, the slot 118 can be defined at the top portion 115 and extends to one of the first side portion 116 and the second side portion 117. The gap 119 communicates with the slot 118 and extends across the front frame 111. In this exemplary embodiment, the gap 119 is positioned adjacent to the second side portion 117. The front frame 111 is divided into two portions by the gap 119, that is, a long portion A1 and a short portion A2 (long and short relative to each other). A first portion of the front frame 111 extending from a first side of the gap 119 to a first end E1 of the slot 118 forms the long portion A1. A second portion of the front frame 111 extending from a second side of the gap 119 to a second end E2 of the slot 118 forms the short portion A2.

In this exemplary embodiment, the gap 119 is not positioned at a middle portion of the top portion 115. The long portion A1 is longer than the short portion A2.

In this exemplary embodiment, the slot 118 and the gap 119 are both filled with insulating material, for example, plastic, rubber, glass, wood, ceramic, or the like, thereby isolating the long portion Al, the short portion A2, and the backboard 112.

In this exemplary embodiment, except for the slot 118 and the gap 119, an upper half portion of the front frame 111 and the side frame 113 does not define any other slot, break line, and/or gap. That is, there is only one gap 119 defined on the upper half portion of the front frame 111.

The first feed source 13 is electrically connected to the end of the long portion A1 adjacent to the first side portion 116. The first feed source 13 can feed current to the long portion A1 and activates the long portion A1 to a first mode to generate radiation signals in a first frequency band. In this exemplary embodiment, the first mode is a low frequency operation mode. The first frequency band is a frequency band of about 700-900 MHz.

The second feed source 14 is electrically connected to the end of the short portion A2 adjacent to the gap 119. The second feed source 14 can feed current to the short portion A2 and activate the short portion A2 to two modes to generate radiation signals in a wide band mode (1710-2690 MHz). The wide band mode can contain a middle frequency operation mode, a high frequency operation mode, and a WIFI 2.4 GHz band.

Figure 4:
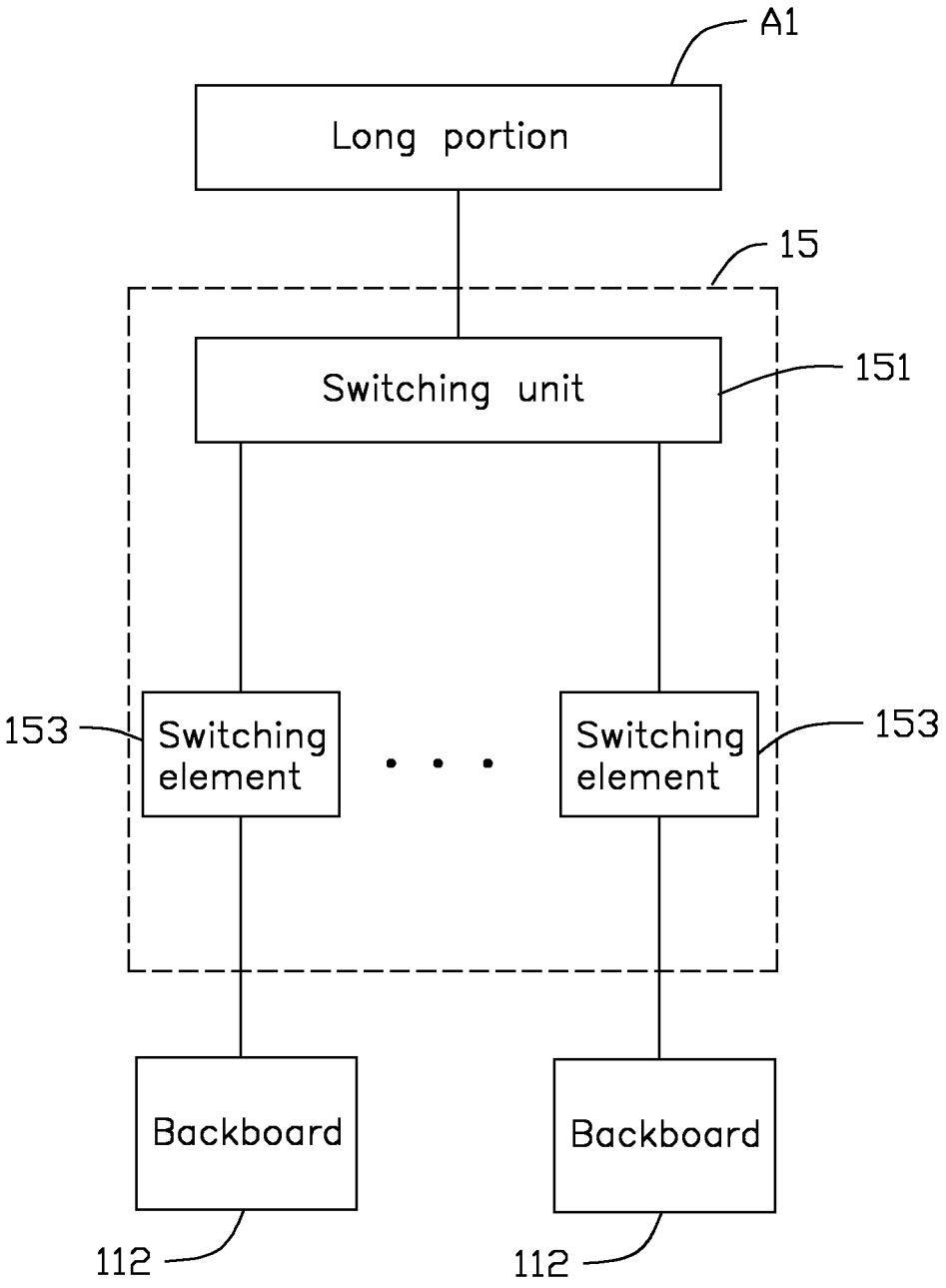
FIG. 4 is a circuit diagram of a first switching circuit of the antenna structure of FIG. 1.

Per FIG. 4, the first switching circuit 15 is electrically connected to the long portion A1. The first switching circuit 15 includes a switching unit 151 and a plurality of switching elements 153. The switching unit 151 is electrically connected to the long portion A1. The switching elements 153 can be an inductor, a capacitor, or a combination of the inductor and the capacitor. The switching elements 153 are connected in parallel. One end of each switching element 153 is electrically connected to the switching unit 151. The other end of each switching element 153 is electrically connected to the backboard 112. Through controlling the switching unit 151, the long portion A1 can be switched to connect with different switching elements 153. Since each switching element 153 has a different impedance, an operating frequency band of the long portion A1 can be adjusted through switching the switching unit 151, for example, the frequency band of the first mode of the long portion A1 can be offset towards a lower frequency or towards a higher frequency (relative to each other).

Figure 5:
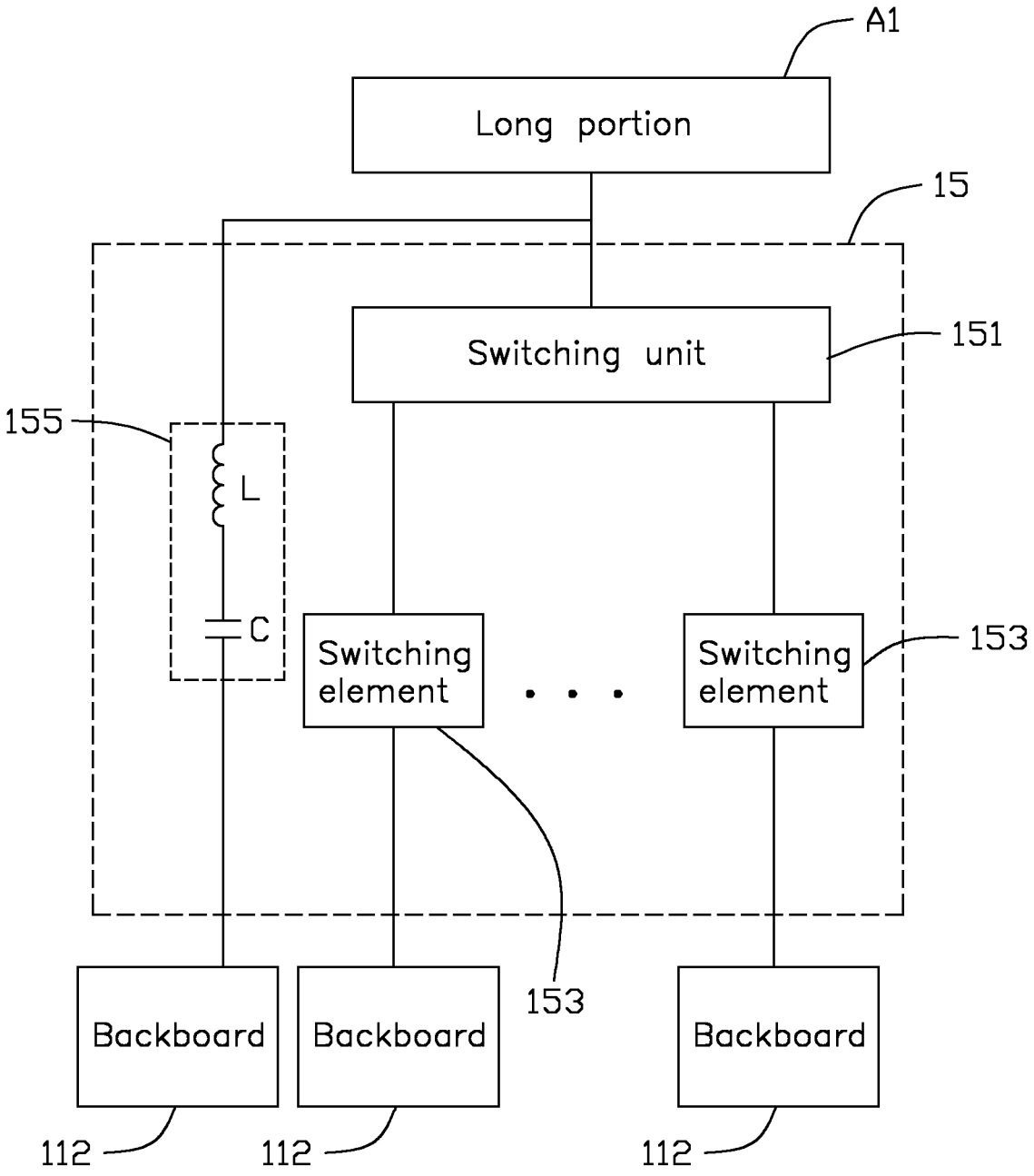
FIG. 5 is a circuit diagram of the first switching circuit of FIG. 4, showing the first switching circuit includes a resonance circuit.
Figure 6:
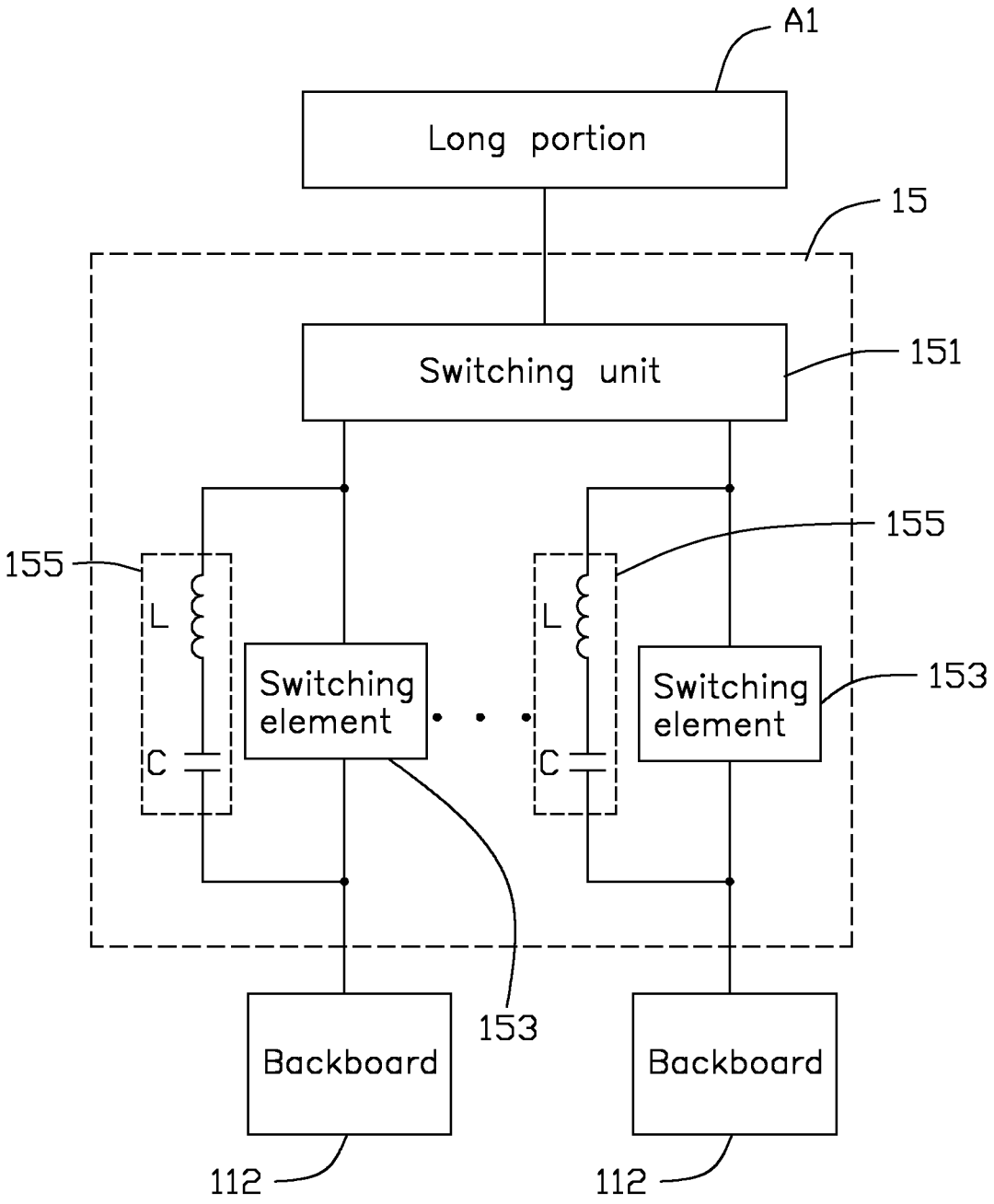
FIG. 6 is similar to FIG. 5, but shown the first switching circuit includes another resonance circuit.

Per FIG. 5 and FIG. 6, the first switching circuit 15 further includes a resonance circuit 155. Per FIG. 5, in one exemplary embodiment, the first switching circuit 15 includes one resonance circuit 155. The resonance circuit 155 includes an inductor L and a capacitor C connected in series. The resonance circuit 155 is electrically connected between the long portion A1 and the backboard 112. The resonance circuit 155 is connected in parallel to the switching unit 151 and at least one switching element 153.

Per FIG. 6, in another exemplary embodiment, the first switching circuit 15 includes a plurality of resonance circuits 155. The number of the resonance circuits 155 is equal to the number of switching elements 153. Each resonance circuit 155 includes an inductor L and a capacitor C connected in series. Each resonance circuit 155 is electrically connected in parallel to one of the switching elements 153 between the switching unit 151 and the backboard 112.

Figure 7:
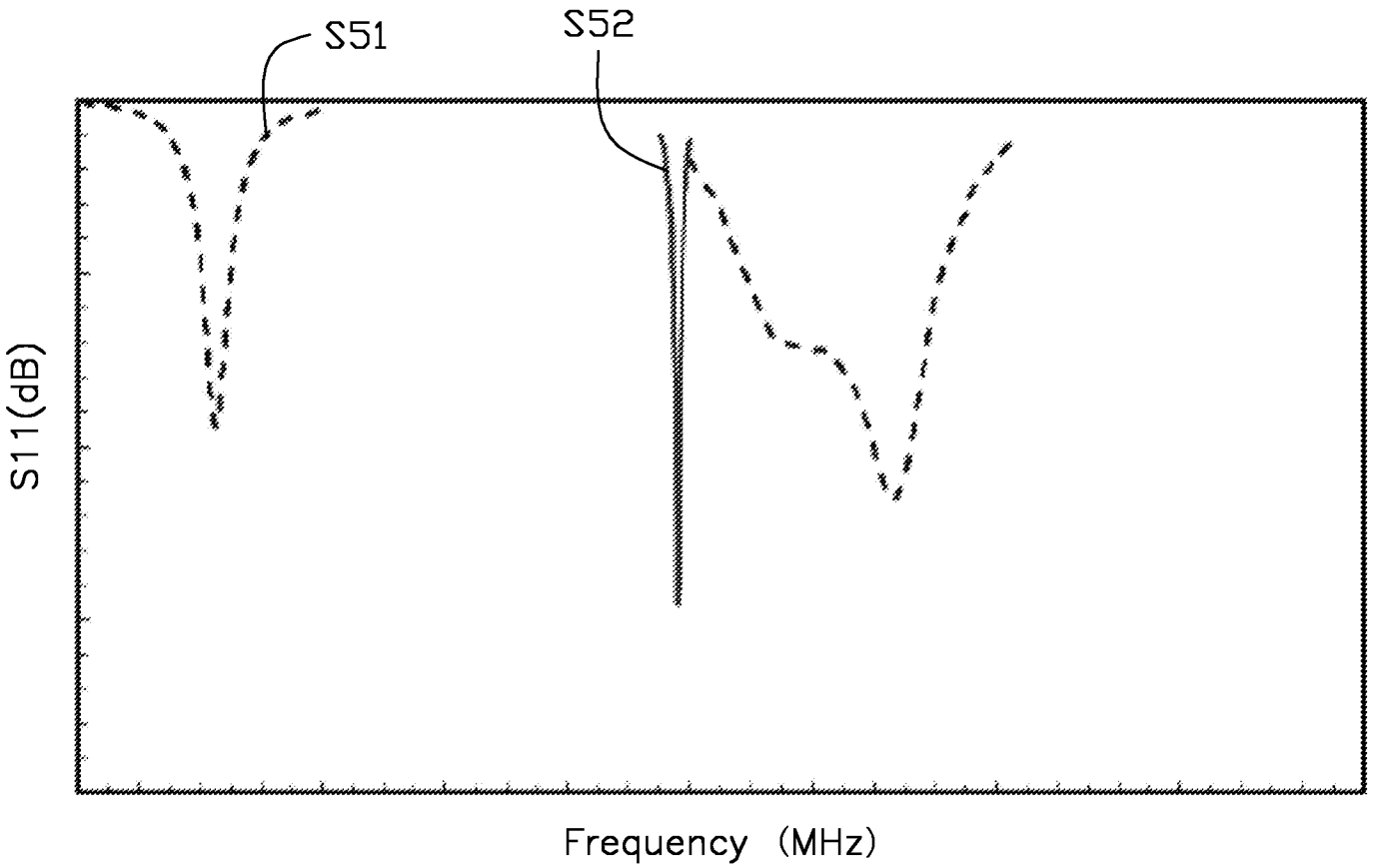
FIG. 7 is a schematic diagram of the antenna structure of FIG. 1, showing the first switching circuit of FIG. 5 includes a resonance circuit and generates a resonance mode.

Per FIG. 7, when the first switching circuit 15 does not include the resonance circuit 155, the antenna structure 100 works at the first mode (please see the curve S51). When the first switching circuit 15 includes the resonance circuit 155, the long portion A1 of the antenna structure 100 can activate an additional resonance mode (that is, the second mode, please see the curve S52) to generate radiation signals in the second frequency band. The second mode can effectively broaden an applied frequency band of the antenna structure 100. In one exemplary embodiment, the second frequency band is a GPS operation band and the second mode is the GPS resonance mode.

Figure 8:
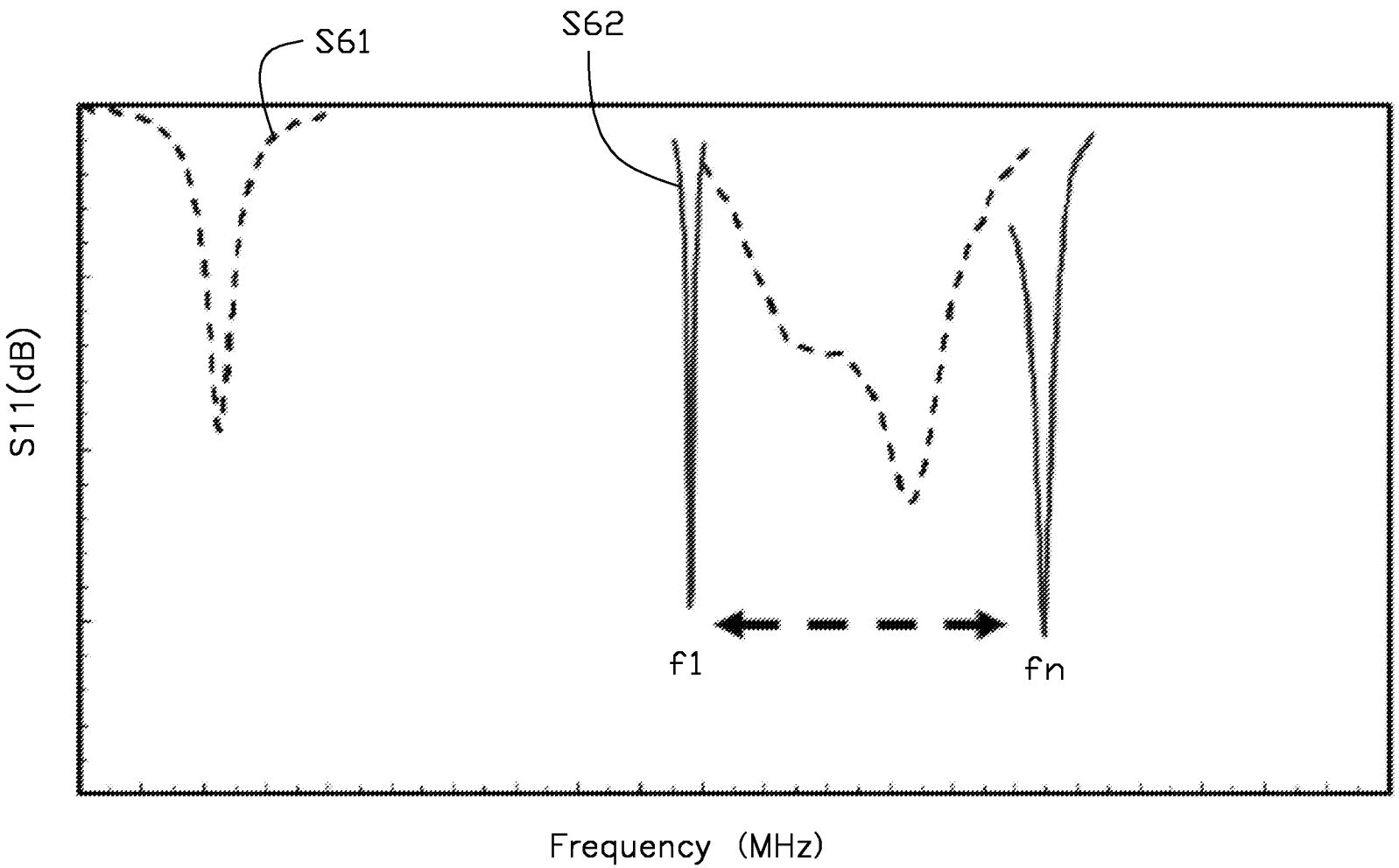
FIG. 8 is a schematic diagram of the antenna structure of FIG. 1, showing the first switching circuit of FIG. 6 includes a resonance circuit and generates a resonance mode.

Per FIG. 8, when the first switching circuit 15 does not include the resonance circuit 155, the antenna structure 100 works at the first mode (please see the curve S61). When the first switching circuit 15 includes the resonance circuit 155, the long portion A1 of the antenna structure 100 can activate the additional resonance mode (please see the curve S62), that is, the GPS resonance mode. The resonance mode can effectively broaden an applied frequency band of the antenna structure 100. In one exemplary embodiment, an inductance value of the inductor L and a capacitance value of the capacitor C of the resonance circuit 155 can cooperatively decide a frequency band of the resonance mode when the first mode switches. For example, in one exemplary embodiment, as illustrated in FIG. 8, when the switching unit 151 switches to different switching elements 153 through setting the inductance value and the capacitance value of the resonance circuit 155, the resonance mode of the antenna structure 100 can also be switched. For example, the resonance mode of the antenna structure 100 can be moved from f1 to fn.

In other exemplary embodiments, the frequency band of the resonance mode can be fixed through setting the inductance value and the capacitance value of the resonance circuit 155. Then no matter to which switching element 153 the switching unit 151 is switched, the frequency band of the resonance mode is fixed and keeps unchanged.

In other exemplary embodiments, the resonance circuit 155 is not limited to include the inductor L and the capacitor C, and can include other resonance components.

Figure 9:
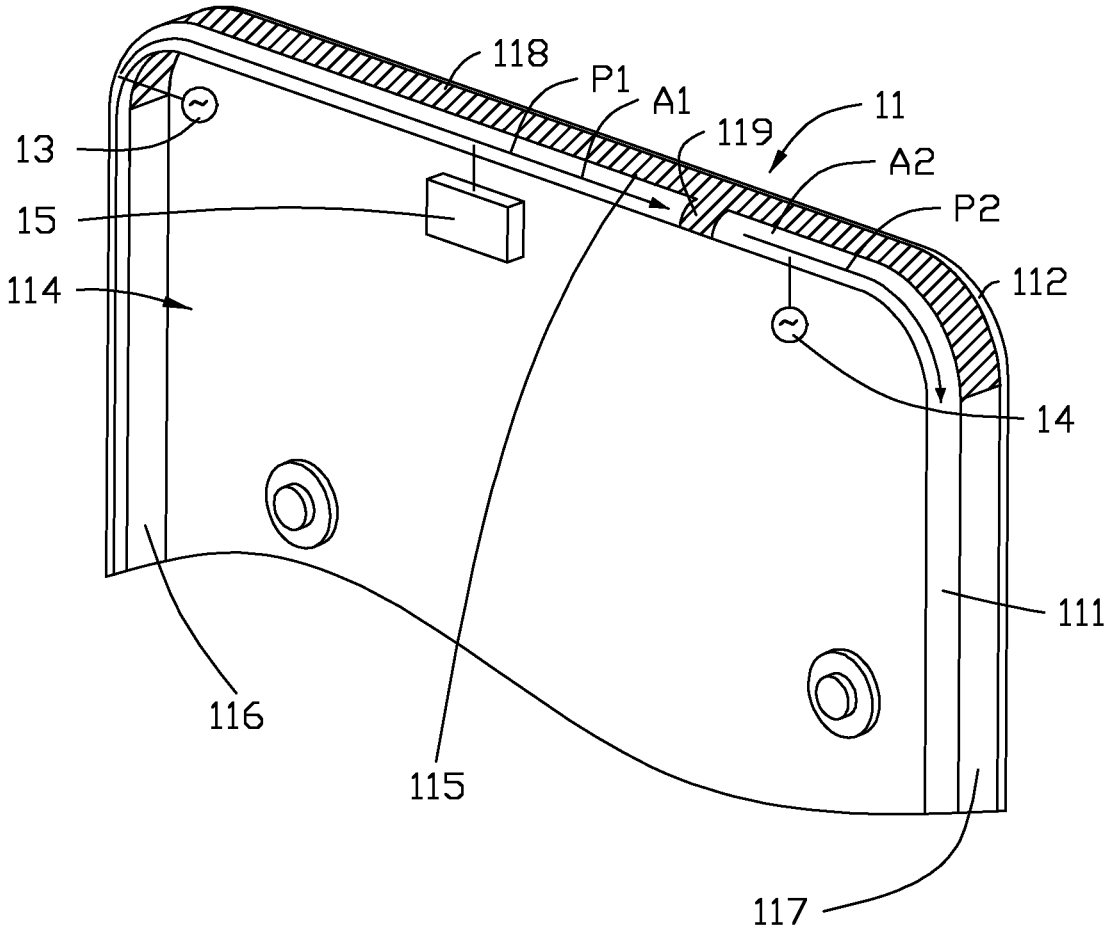
FIG. 9 is a current path distribution graph when the antenna structure of FIG. 1 works at a low frequency operation mode and a Global Positioning System (GPS) operation mode.

Per FIG. 9, when the current enters the long portion A1 from the first feed source 13, the current flows through the long portion A1 and towards the gap 119 (please see a path P1) to activate the low frequency operation mode. Since the antenna structure 100 includes the first switching circuit 15, the low frequency operation mode of the long portion A1 can be switched through the first switching circuit 15. Since the first switching circuit 15 includes the resonance circuit 155, the low frequency operation mode and the GPS operation mode can be active simultaneously. In this exemplary embodiment, a total current of the GPS operation mode is contributed by two current sources. One current source is from the low frequency operation mode (Per the path P1). The other current source is from the inductor L and the capacitor C of the resonance circuit 155 being impedance matched (e.g., path P2). In this exemplary embodiment, a current of the path P2 flows to one end of the short portion A2 away from the second feed source 14 from the other end of the short portion A2 adjacent to the second feed source 14.

Figure 10:
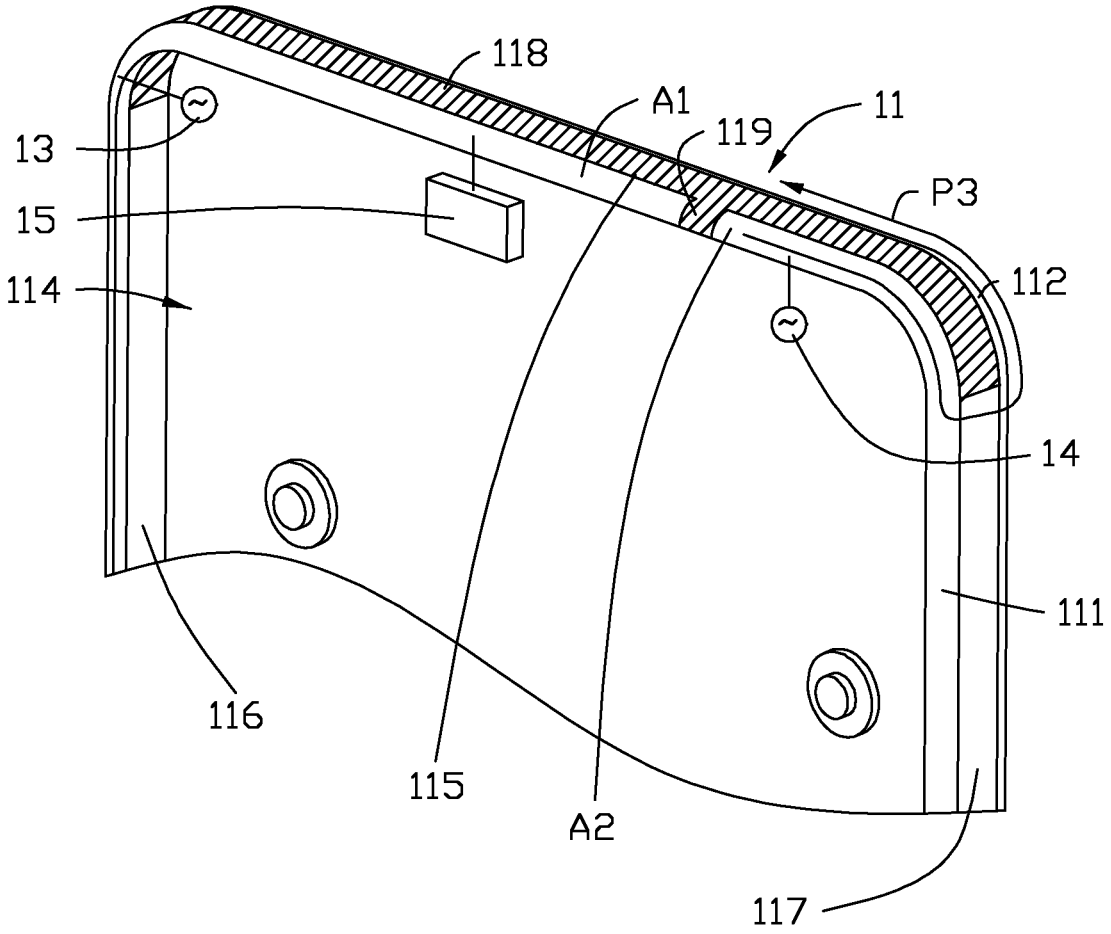
FIG. 10 is a current path distribution graph when the antenna structure of FIG. 1 works at a frequency band of about 1710-2690 MHz.

Per FIG. 10, when the current enters the short portion A2 from the second feed source 14, the current flows to the front frame 111, the second side portion 117, and the backboard 112 (e.g., path P3) to activate a third mode for generating radiation signals in a third frequency band (1710-2690 MHz) and containing the middle frequency operation mode, the high frequency operation mode, and the WIFI 2.4 GHz band. From FIG. 4 to FIG. 10, the backboard 112 serves as the ground of the antenna structure 100.

Figure 11:
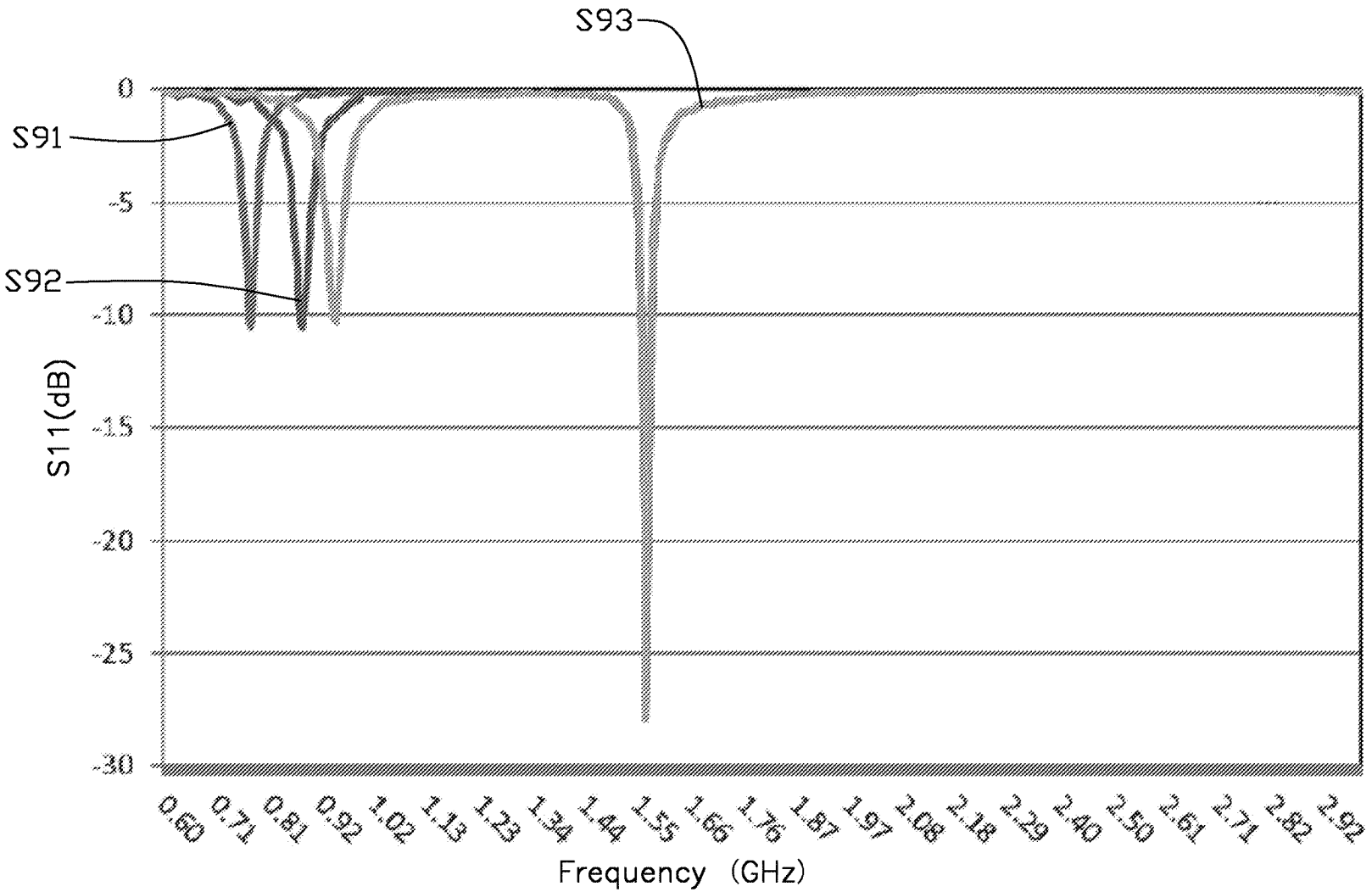
FIG. 11 is a scattering parameter graph when the antenna structure of FIG. 1 works at a low frequency operation mode and a GPS operation mode.

FIG. 11 illustrates a scattering parameter graph of the antenna structure 100, when the antenna structure 100 works at the low frequency operation mode and the GPS operation mode. Curve 91 illustrates a scattering parameter when the antenna structure 100 works at a LTE-A Band 28 (703-803 MHz). Curve 92 illustrates a scattering parameter when the antenna structure 100 works at a LTE-A Band 5 (869-894 MHz). Curve 93 illustrates a scattering parameter when the antenna structure 100 works at a LTE-A Band 8 (925-926 MHz) and the GPS band (1.575 GHz). In this exemplary embodiment, curve 91 and curve 92 respectively correspond to two different frequency bands and respectively correspond to two of the plurality of low frequency bands of the switching circuit 15.

Figure 12:
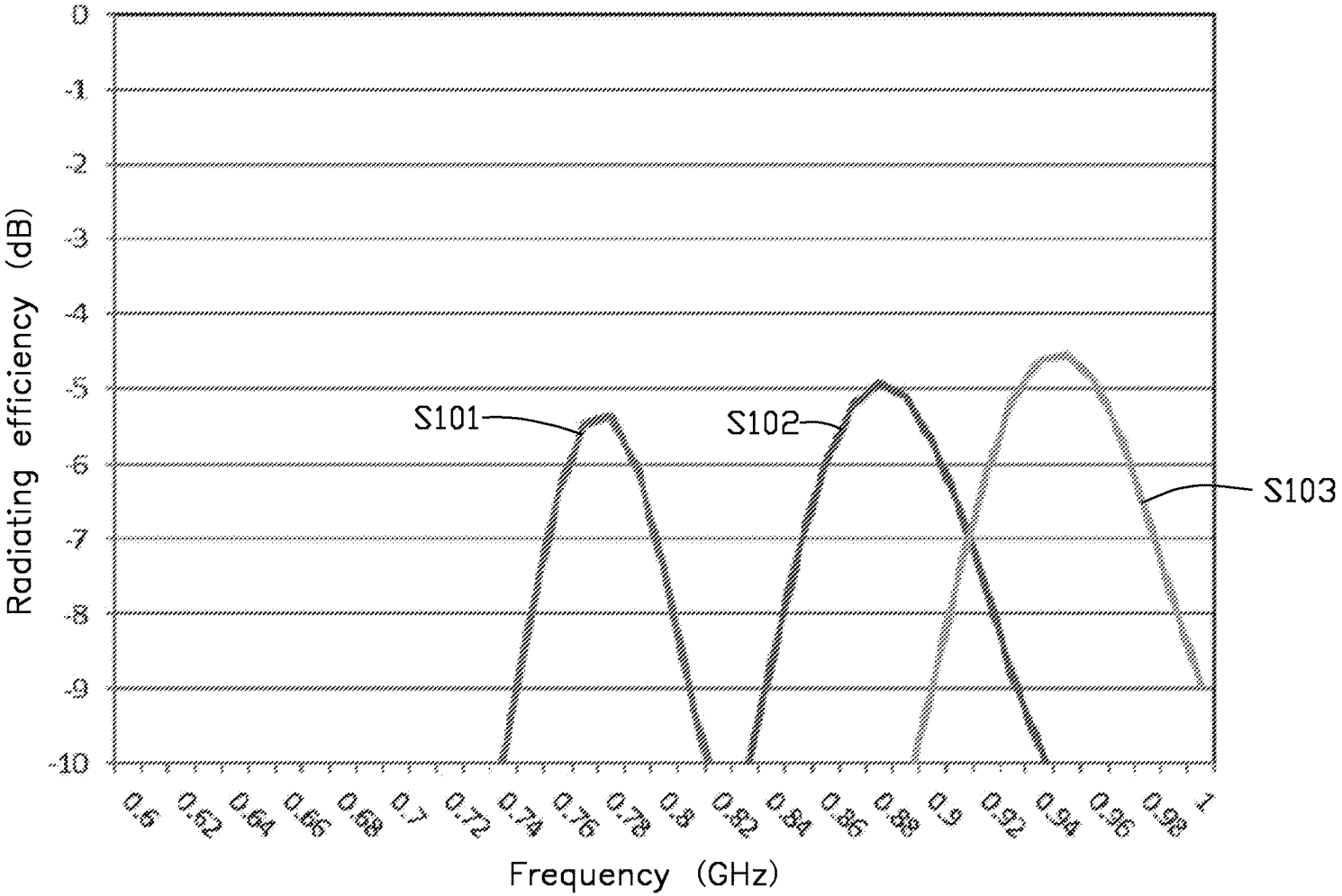
FIG. 12 is a radiating efficiency graph when the antenna structure of FIG. 1 works at a low frequency operation mode.

FIG. 12 illustrates a radiating efficiency graph of the antenna structure 100, when the antenna structure 100 works at the low frequency operation mode. Curve 101 illustrates a radiating efficiency when the antenna structure 100 works at a LTE-A Band 28 (703-803 MHz). Curve 102 illustrates a radiating efficiency when the antenna structure 100 works at a LTE-A Band 5 (869-894 MHz). Curve 103 illustrates a radiating efficiency when the antenna structure 100 works at a LTE-A Band 8 (925-926 MHz). In this exemplary embodiment, curve 101, curve 102, and curve 103 respectively correspond to three different frequency bands and respectively correspond to three of the plurality of low frequency bands of the switching circuit 15.

Figure 13:
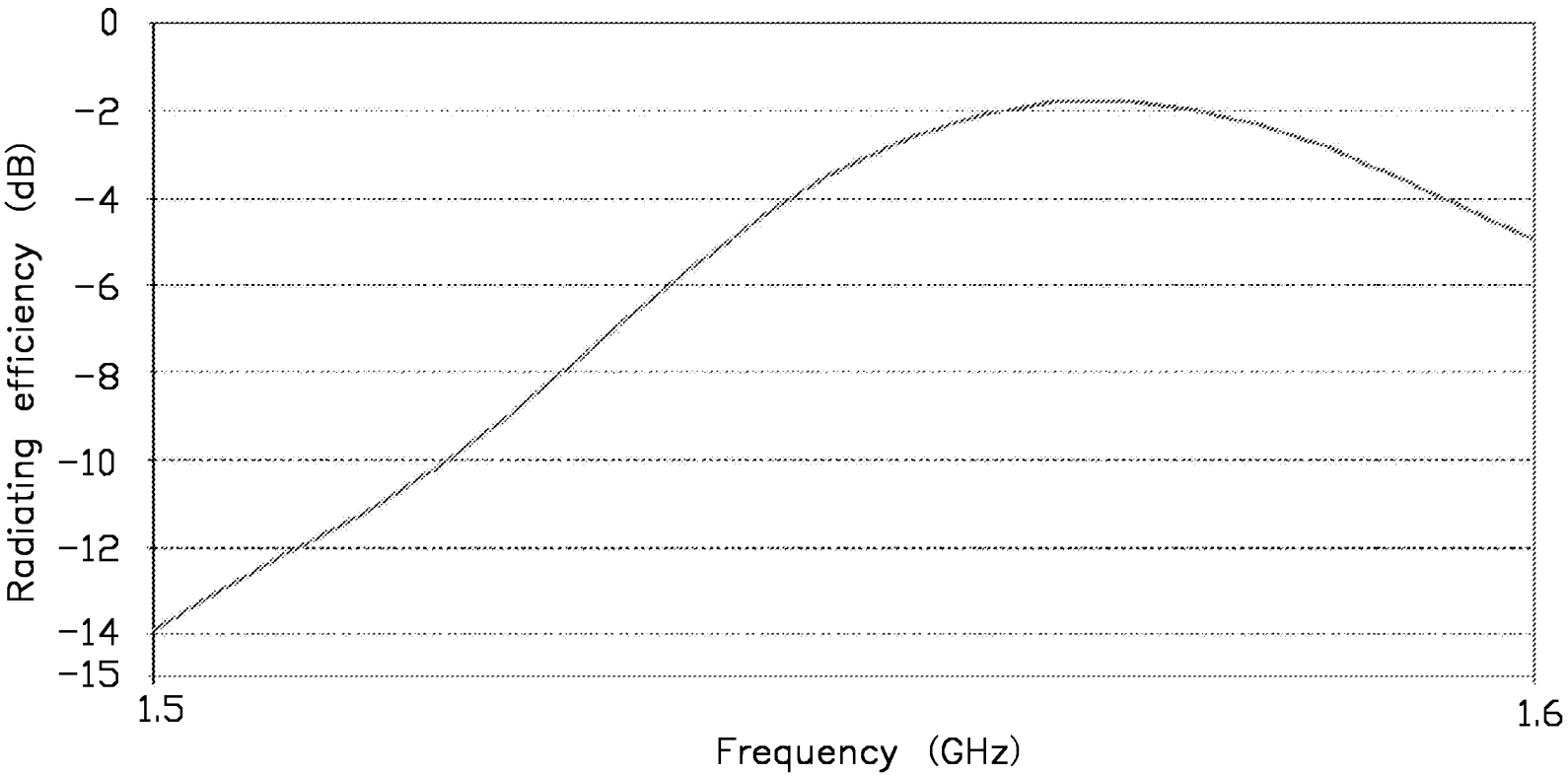
FIG. 13 is a radiating efficiency graph when the antenna structure of FIG. 1 works at a GPS operation mode.
Figure 14:
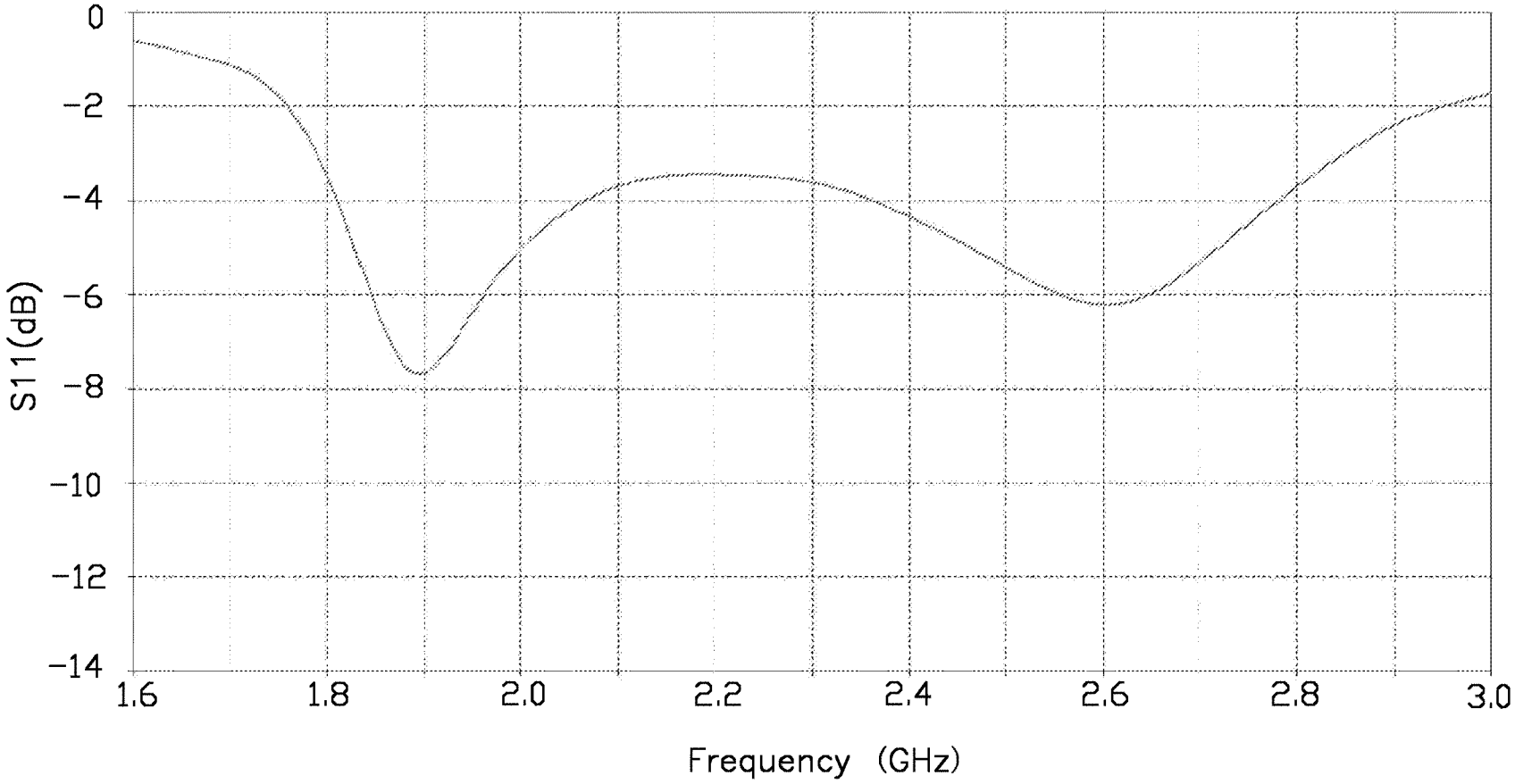
FIG. 14 is a scattering parameter graph when the antenna structure of FIG. 1 works at a frequency band of about 1710-2690 MHz.
Figure 15:
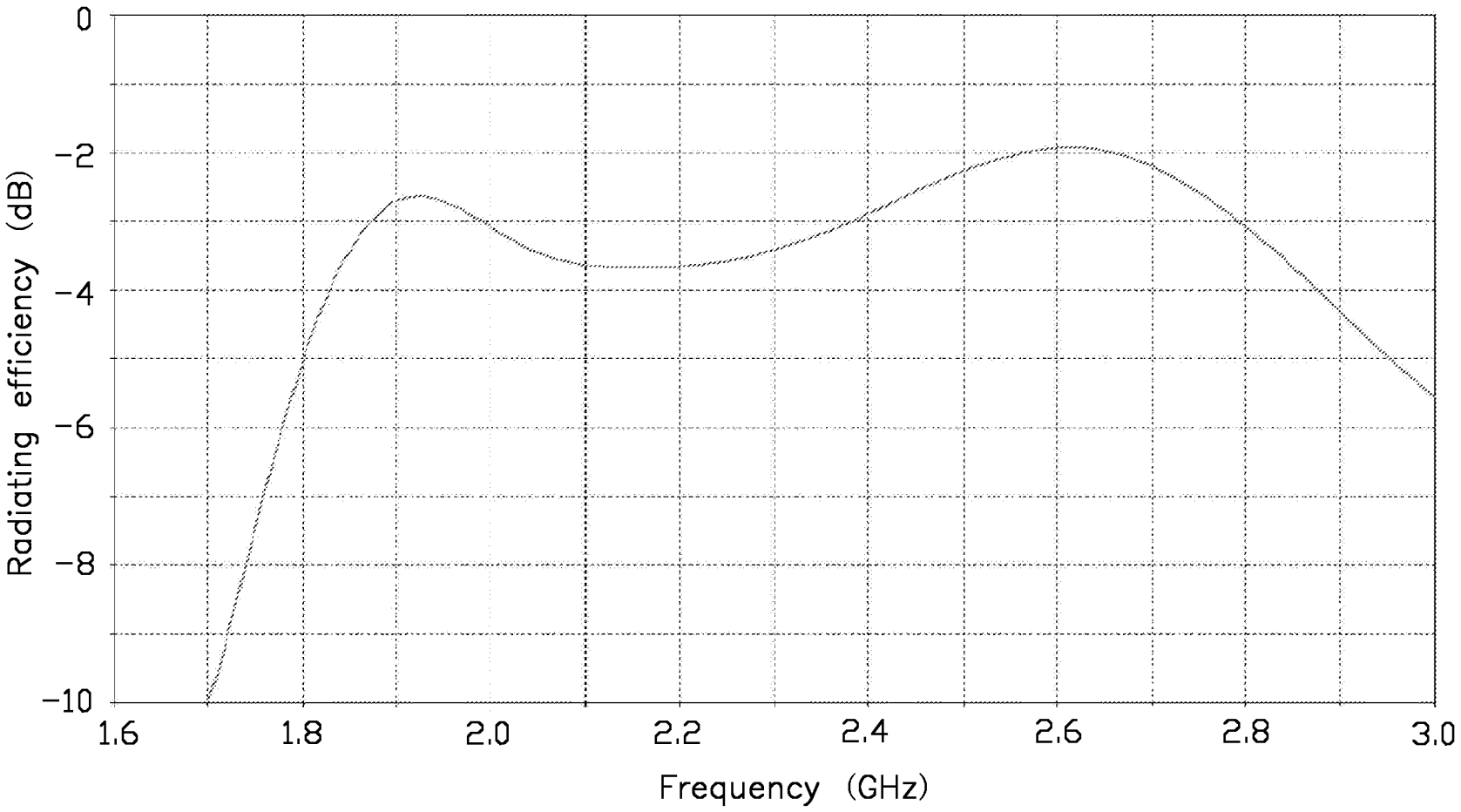
FIG. 15 is a radiating efficiency graph when the antenna structure of FIG. 1 works at a frequency band of about 1710-2690 MHz.

FIG. 13 illustrates a radiating efficiency graph of the antenna structure 100, when the antenna structure 100 works at the GPS operation mode. FIG. 14 illustrates a scattering parameter graph of the antenna structure 100, when the antenna structure 100 works at the frequency band of about 1710-2690 MHz (that is, the middle frequency operation mode, the high frequency operation mode, and the WIFI 2.4 GHz band). FIG. 15 illustrates a radiating efficiency graph of the antenna structure 100, when the antenna structure 100 works at the frequency band of about 1710-2690 MHz (that is, the middle frequency band, the high frequency band, and the WIFI 2.4 GHz band).

Per FIGS. 11 to 15, the antenna structure 100 can work at a low frequency band, for example, LTE-A band 28 (703-803 MHz), LTE-A Band 5 (869-894 MHz), and LTE-A Band 8 (925-926 MHz). The antenna structure 100 can also work at the GPS band (1.575 GHz) and the frequency band of about 1710-2690 MHz. That is, the antenna structure 100 can work at the low frequency band, the middle frequency band, and the high frequency band, and when the antenna structure 100 works at these frequency bands, a working frequency satisfies a design of the antenna and also has a good radiating efficiency.

Figure 16:
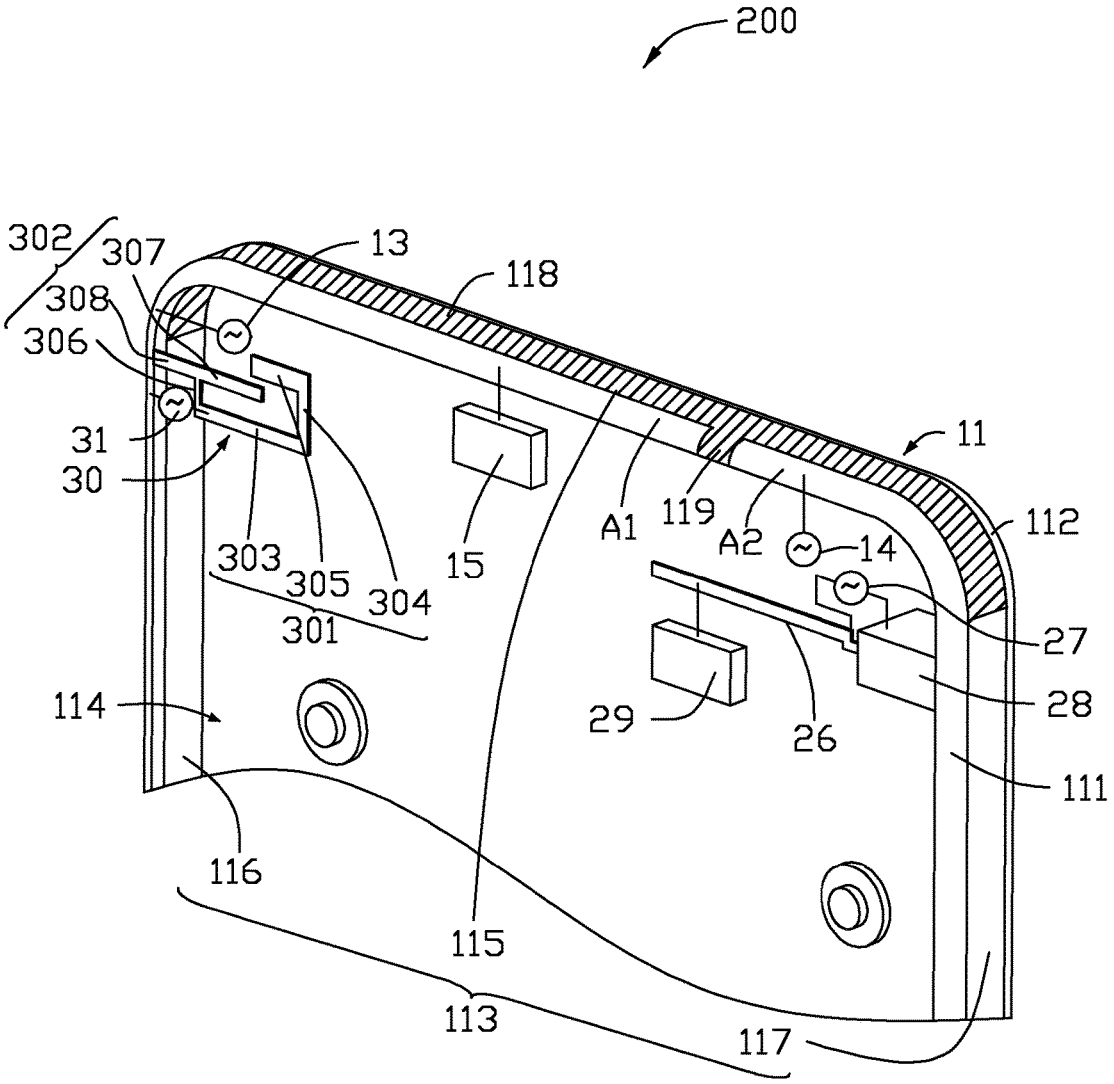
FIG. 16 is an isometric view of a second exemplary embodiment of a wireless communication device using a second exemplary antenna structure.

FIG. 16 illustrates a second exemplary embodiment of an antenna structure 200. The antenna structure 200 includes a metallic member 11, a first feed source 13, a second feed source 14, and a first switching circuit 15. The metallic member 11 includes a front frame 111, a backboard 112, and a side frame 113. The side frame 113 includes a top portion 115, a first side portion 116, and a second side portion 117. The side frame 113 defines a slot 118. The front frame 111 defines a gap 119. The front frame 111 is divided into two portions by the gap 119, these portions being a long portion A1 and a short portion A2 (relative to each other).

In this exemplary embodiment, the antenna structure 200 differs from the antenna structure 100 in that the antenna structure 200 further includes a first radiator 26, a third feed source 27, an isolating portion 28, a second switching circuit 29, a second radiator 30, and a fourth feed source 31.

The first radiator 26 is positioned in the receiving space 114. The first radiator 26 is positioned adjacent to the short portion A2 and is spaced apart from the backboard 112. In this exemplary embodiment, the first radiator 26 is substantially rectangular and is positioned parallel to the top portion 215. One end of the first radiator 26 is electrically connected to the isolating portion 28 and the other end of the first radiator 26 extends towards the first side portion 116. One end of the third feed source 27 is electrically connected to the first radiator 26 through a matching circuit (not shown). Another end of the third feed source 27 is electrically connected to the isolating portion 28 and supplies current to the first radiator 26.

In this exemplary embodiment, since a frequency band of the second feed source 14 approaches a frequency band of the third feed source 27, there can be interference with each other. The isolating portion 28 can extend a current path of the second feed source 14 and a current path of the third feed source 27, thereby improving isolation between the short portion A2 and the first radiator 26.

In this exemplary embodiment, the isolating portion 28 can be any shape and/or size. The isolating portion 28 can also be a planar metallic sheet and only to ensure that the isolating portion 28 can extend a current path of the third feed source 27, thereby improving isolation between the short portion A2 and the first radiator 26. For example, in this exemplary embodiment, the isolating portion 28 can be a block-shaped structure. The isolating portion 28 is positioned on the backboard 112 and extends from the second side portion 117 towards the first side portion 116.

Figure 17:
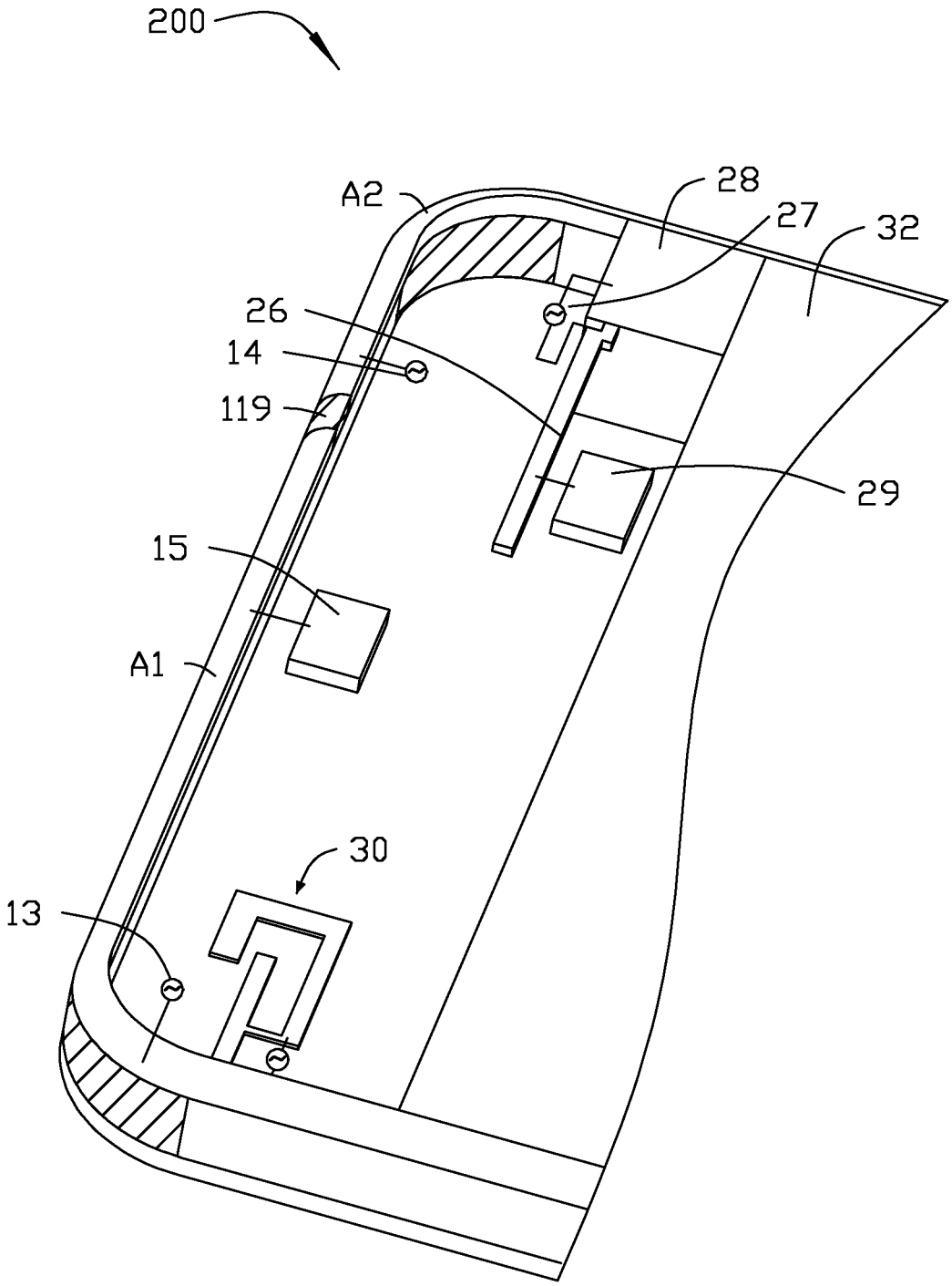
FIGS. 17 to 19 are isometric views of the antenna structure of FIG. 16, showing a location relationship of an isolating portion.

Per FIG. 17, in other exemplary embodiments, the antenna structure 200 further includes a metallic frame 32. The metallic frame 32 is positioned in the receiving space 114 and is connected to the metallic member 11. The isolating portion 28 is a block-shaped structure. The isolating portion 28 extends from the second side portion 117 towards the first side portion 116 and is connected to the metallic frame 32.

Figure 18:
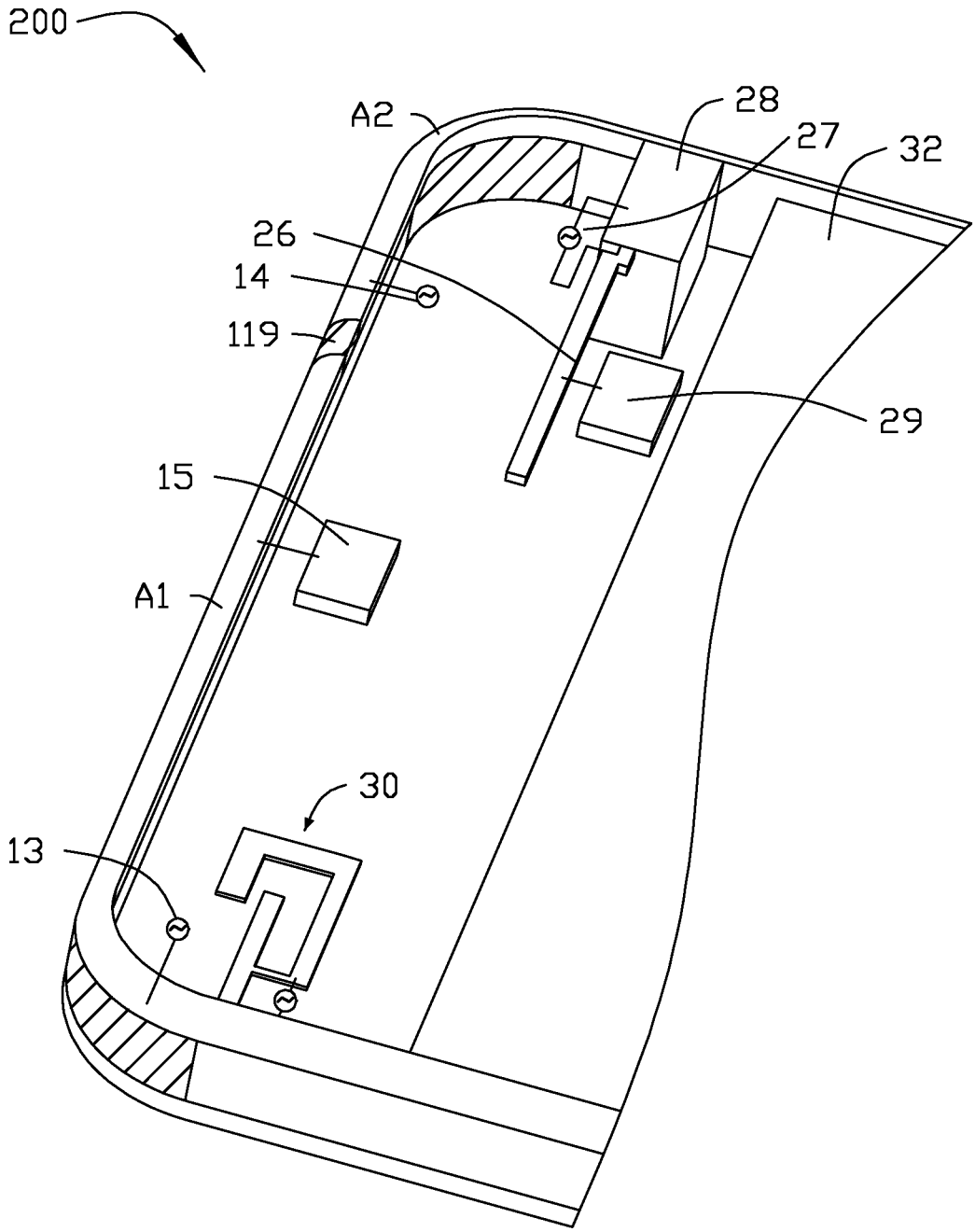

Per FIG. 18, in other exemplary embodiments, the antenna structure 200 further includes a metallic frame 32. The metallic frame 32 is positioned in the receiving space 114 and is connected to the metallic member 11. The isolating portion 28 is a block-shaped structure. The isolating portion 28 extends from the second side portion 117 towards the first side portion 116 and is spaced apart from the metallic member 11.

Figure 19:
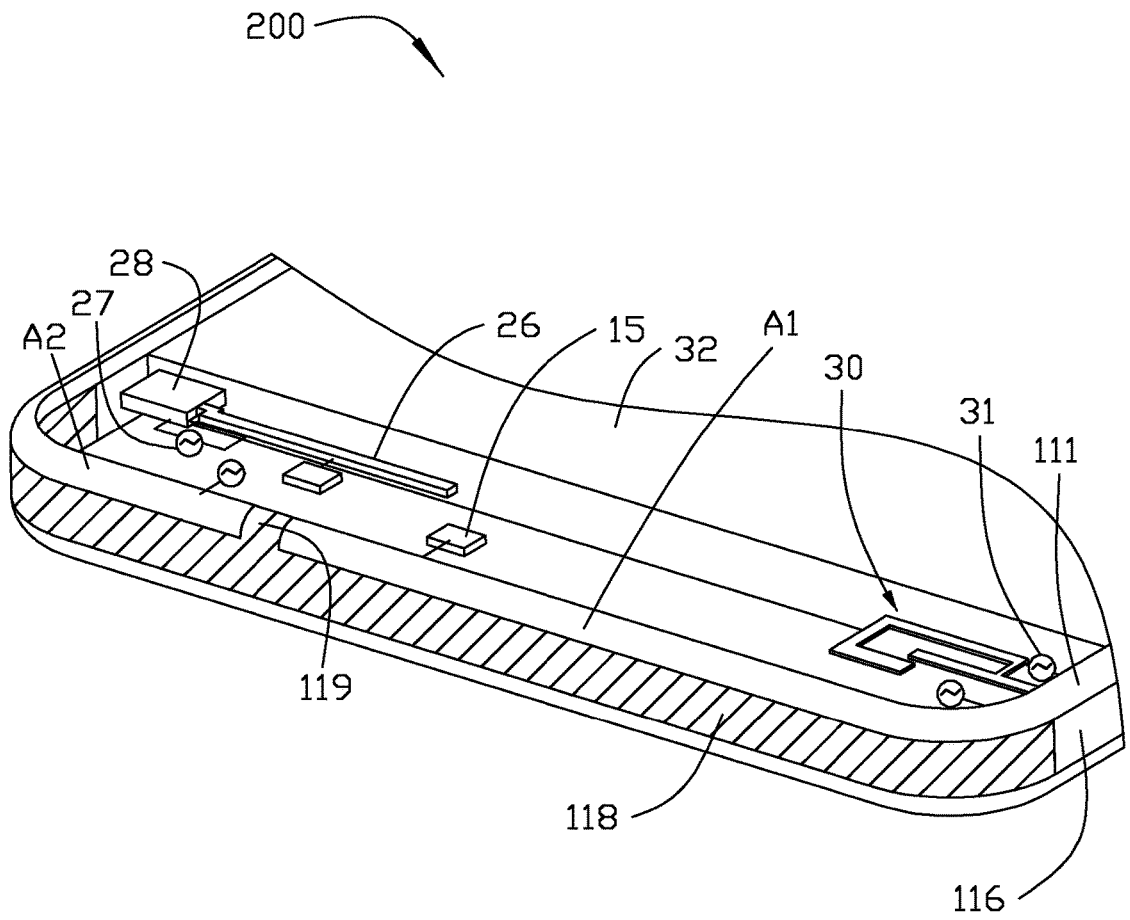

Per FIG. 19, in other exemplary embodiments, the antenna structure 200 further includes a metallic frame 32. The metallic frame 32 is positioned in the receiving space 114 and is connected to the metallic member 11. The isolating portion 28 is still block-shaped, but substantially thinner, thereby approaching a more substantially 2-dimensional rectangular shape. The isolating portion 28 is positioned at one side of the metallic frame 32. The isolating portion 28 is spaced apart from both the second side portion 117 and the backboard 112.

Per FIG. 16, one end of the second switching circuit 29 is electrically connected to the first radiator 26 and another end of the second switching circuit 29 is electrically connected to the backboard 112. The second switching circuit 29 can adjust the high frequency operation mode of the first radiator 26. The detail circuit and working principle of the second switching circuit 29 can consult a description of the first switching circuit 15 in FIG. 4.

The second radiator 30 is positioned in the receiving space 114 and is positioned adjacent to the long portion A1. In this exemplary embodiment, the second radiator 30 includes a first radiating portion 301 and a second radiating portion 302. The first radiating portion 301 is substantially U-shaped and includes a first radiating section 303, a second radiating section 304, and a third radiating section 305 connected in that order. The first radiating section 303 is substantially strip-shaped and is parallel to the top portion 215. The second radiating section 304 is substantially strip-shaped. One end of the second radiating section 304 is perpendicularly connected to one end of the first radiating section 303 adjacent to the second side portion 117. The other end of the second radiating section 304 extends along a direction parallel to the second side portion 117 towards the top portion 115 to form an L-shaped structure with the first radiating section 303. The third radiating section 305 is substantially strip-shaped. One end of the third radiating section 305 is connected to one end of the second radiating section 304 away from the first radiating section 303. The other end of the third radiating section 305 extends along a direction parallel to the first radiating section 303 towards the first side portion 116. The third radiating section 305 and the first radiating section 303 are positioned at a same side of the second radiating section 304 and are positioned at two ends of the second radiating section 304.

The second radiating portion 302 is substantially T-shaped and includes a first connecting section 306, a second connecting section 307, and a third connecting section 308. The first connecting section 306 is substantially strip-shaped. One end of the first connecting section 306 is electrically connected to one end of the first radiating section 303 away from the second radiating section 304. The other end of the first connecting section 306 extends a direction parallel to the second radiating section 304 towards the third radiating section 305. The second connecting section 307 is substantially strip-shaped. One end of the second connecting section 307 is perpendicularly connected to the first connecting section 306 away from the first radiating section 304. The other end of the second connecting section 307 extends along a direction parallel to the first radiating section 303 towards the second radiating section 304. The third connecting section 308 is substantially strip-shaped. The third connecting section 308 is connected to a junction of the first connecting section 306 and the second connecting section 307, extends along a direction parallel to the first radiating section 303 towards the first side portion 116 until the third connecting section 308 is connected to the front frame 111. The third connecting section 308 is collinear with the second connecting section 307.

The fourth feed source 31 is positioned at the front frame 111 and is electrically connected to a junction of the first radiating section 303 and the first connecting section 306. The fourth feed source 31 can provide a current to the first radiating portion 301 and the second radiating portion 302 to activate a working mode, for example, the WIFI 2.4 GHz mode and the WIFI 5 GHz mode.

In this exemplary embodiment, when the antenna structure 200 works at the low frequency operation mode and the GPS operation mode, a current path distribution graph of the antenna structure 200 is consistent with the current path distribution graph of the antenna structure 100 shown in FIG. 9.

In this exemplary embodiment, when the antenna structure 200 works at the middle frequency operation mode, a current path distribution graph of the antenna structure 200 is consistent with the current path distribution graph of the antenna structure 100 shown in FIG. 10.

Figure 20:
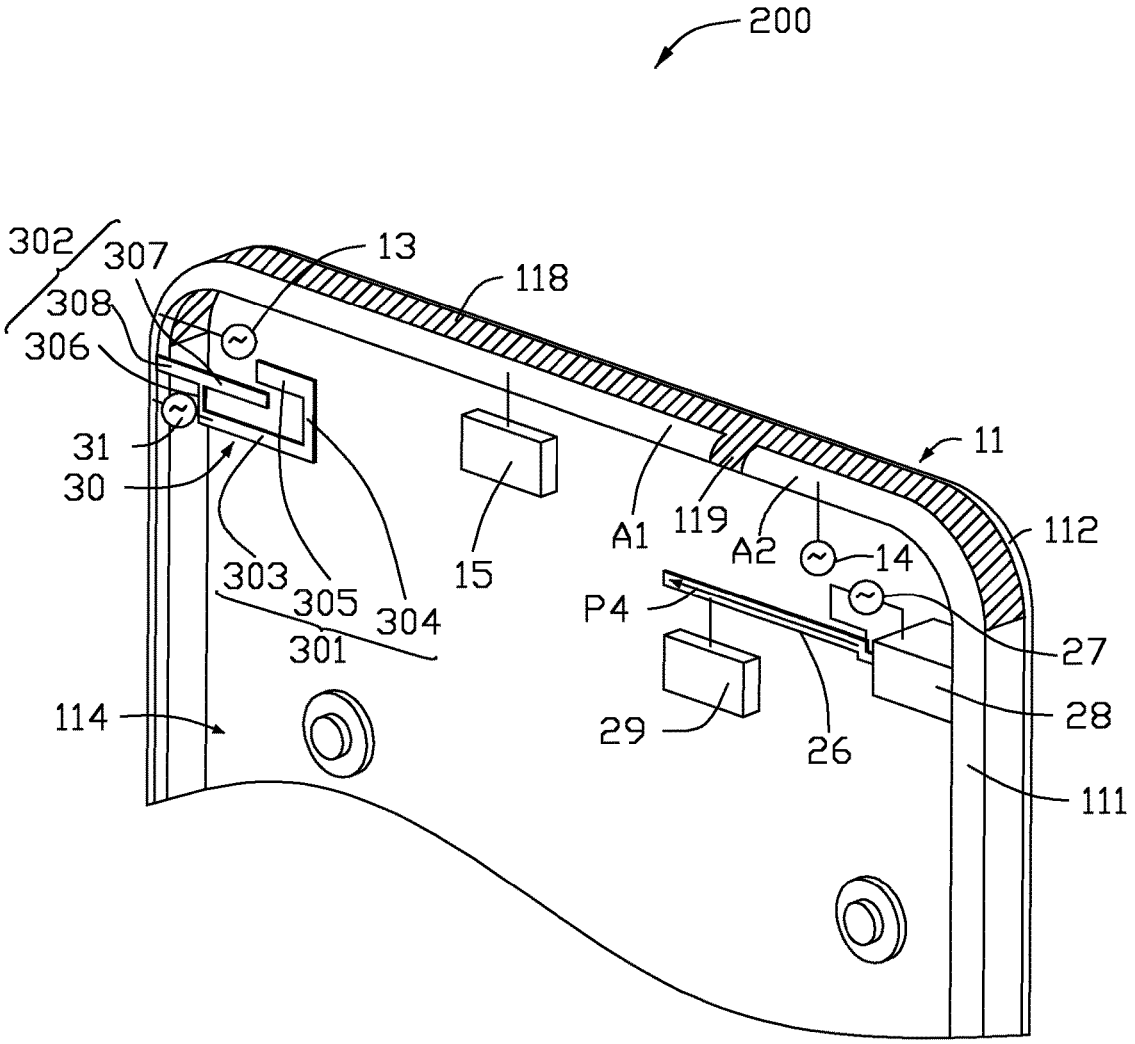
FIG. 20 is a current path distribution graph when the antenna structure of FIG. 16 works at a high frequency operation mode.

Per FIG. 20, when the current enters the first radiator 26 from the third feed source 27, the current flows to one end of the first radiator 26 away from the third feed source 27 (e.g., path P4) to activate a fourth mode to generate radiation signals in a fourth frequency band. In this exemplary embodiment, the fourth mode is a high frequency operation mode. Since the antenna structure 200 includes the second switching circuit 29, the high frequency operation mode can be switched through the second switching circuit 29, for example, the antenna structure 200 can be switched to an LTE-A Band 40 band (2300-2400 MHz) or LTE-A Band 41 (2496-2690 MHz), and the high frequency operation mode and middle frequency operation mode can be active simultaneously.

Figure 21:
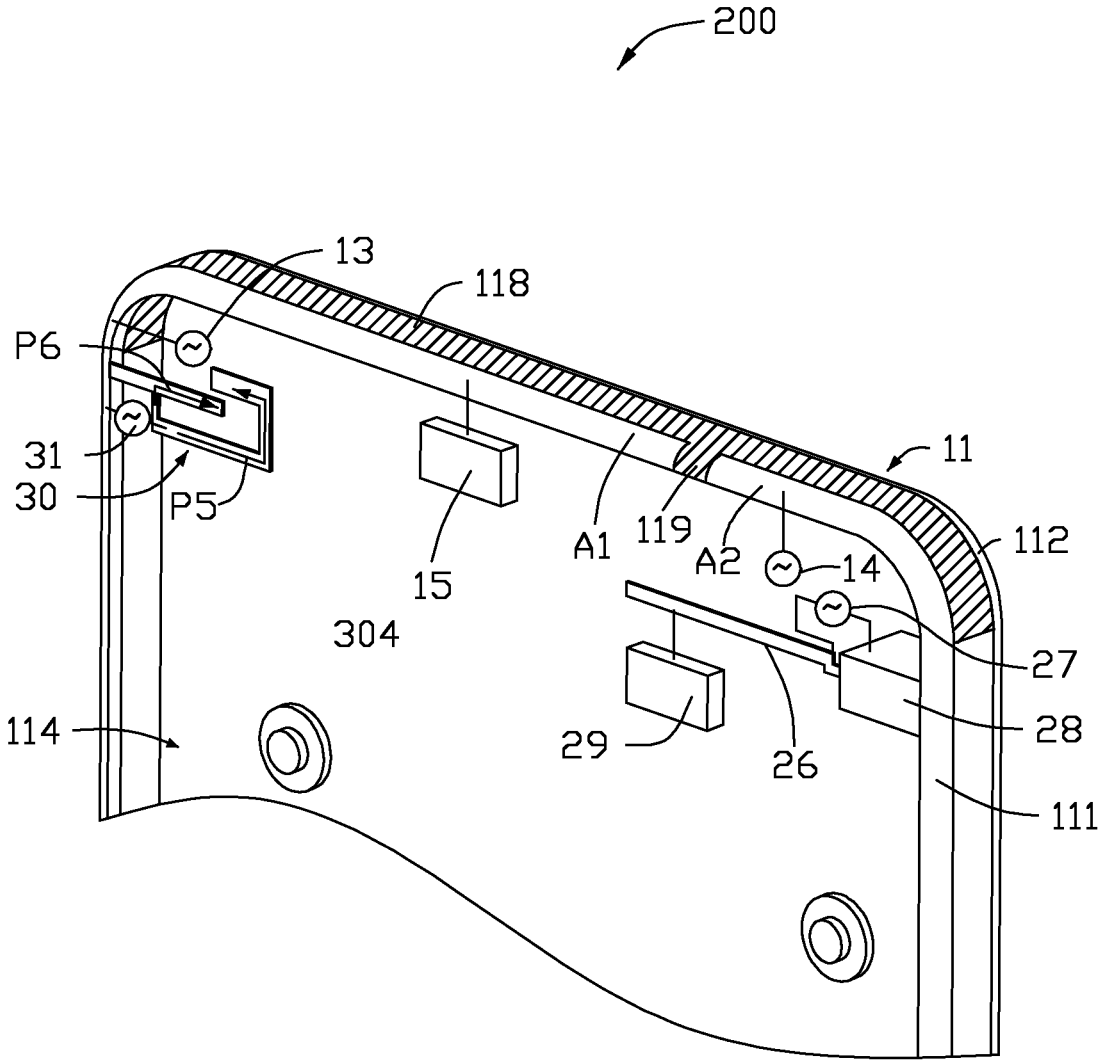
FIG. 21 is a current path distribution graph when the antenna structure of FIG. 16 works at a dual-band WIFI operation mode.

Per FIG. 21, when the current enters the second radiator 30 from the fourth feed source 31, the current flows to the first radiating section 303, the second radiating section 304, and the third radiating section 305 (e.g., path P5) to activate a fifth mode to generate radiation signals in a fifth frequency band. In this exemplary embodiment, the fifth mode is a WIFI 2.4 GHz mode. When the current enters the second radiator 30 from the fourth feed source 31, the current also flows to the first connecting section 306 and the second connecting section 307 (e.g., path P6) to activate a sixth mode to generate radiation signals in a sixth frequency band. In this exemplary embodiment, the sixth mode is a WIFI 5 GHz mode.

In this exemplary embodiment, when the antenna structure 200 works at the low frequency operation mode and the GPS operation mode, a scattering parameter graph and a radiating efficiency graph of the antenna structure 200 are consistent with the scattering parameter graph and a radiating efficiency graph of the antenna structure 100 shown in FIG. 10, FIG. 11, and FIG. 12.

Figure 22:
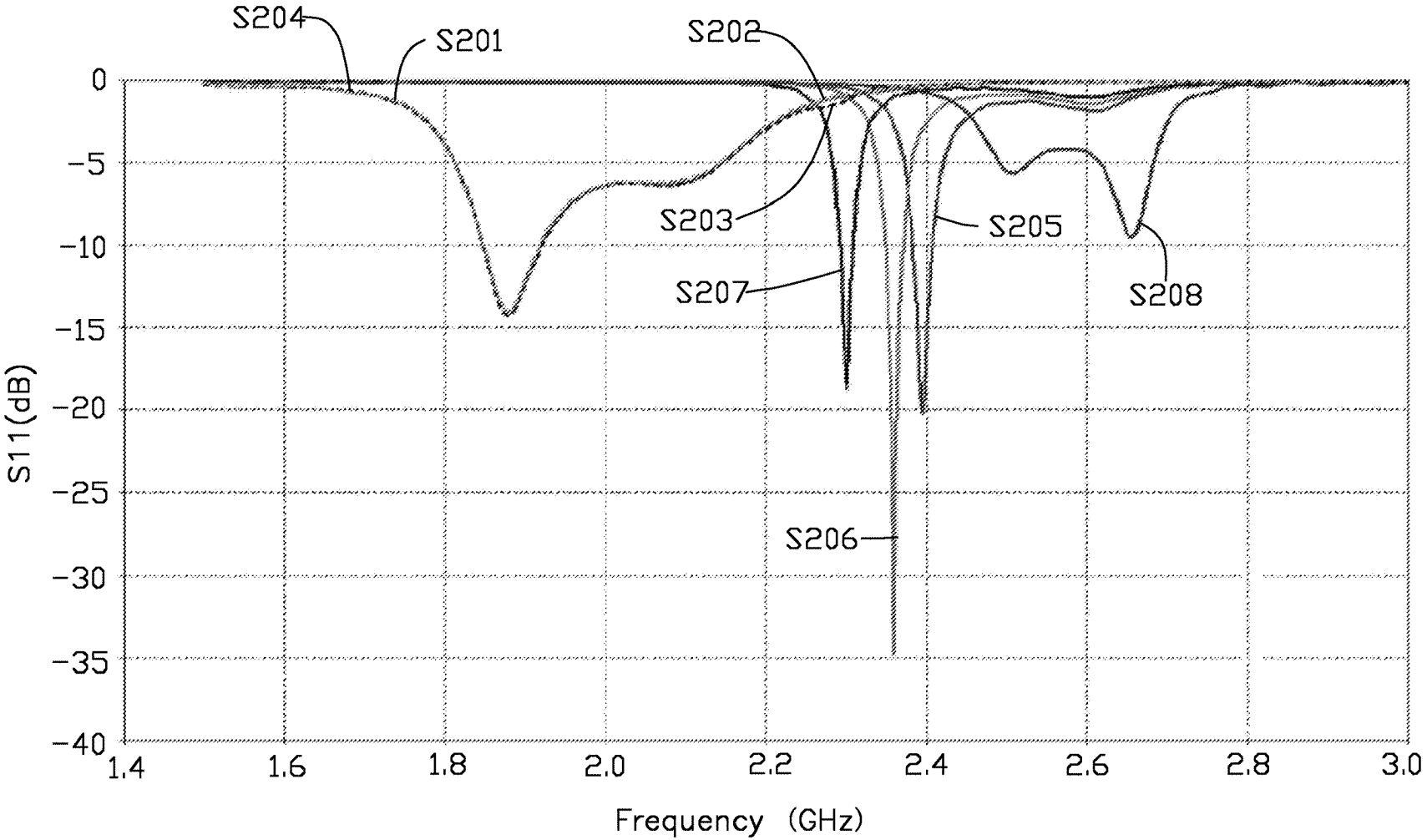
FIG. 22 is a scattering parameter graph when the antenna structure of FIG. 16 works at a middle frequency operation mode and a high frequency operation mode.

FIG. 22 illustrates a scattering parameter graph of the antenna structure 200, when the antenna structure 200 works at the middle frequency operation mode and the high frequency operation mode. Curve 201 illustrates a scattering parameter when the inductance value of the switching element 153 of the first switching circuit 15 is about 0.13 pf. Curve 202 illustrates a scattering parameter when the inductance value of the switching element 153 of the first switching circuit 15 is about 0.15 pf. Curve 203 illustrates a scattering parameter when the inductance value of the switching element 153 of the first switching circuit 15 is about 0.2 pf. Curve 204 illustrates a scattering parameter when the first switching circuit 15 is in an open-circuit state (that is, the first switching circuit 15 does not switch to any switching element 153). Curve 205 illustrates a scattering parameter when the inductance value of the switching element 153 of the second switching circuit 29 is about 0.13 pf. Curve 206 illustrates a scattering parameter when the inductance value of the switching element 153 of the second switching circuit 29 is about 0.15 pf. Curve 207 illustrates a scattering parameter when the inductance value of the switching element 153 of the second switching circuit 29 is about 0.2 pf. Curve 208 illustrates a scattering parameter when the second switching circuit 29 is in an open-circuit state (that is, the second switching circuit 29 does not switch to any switching element).

Figure 23:
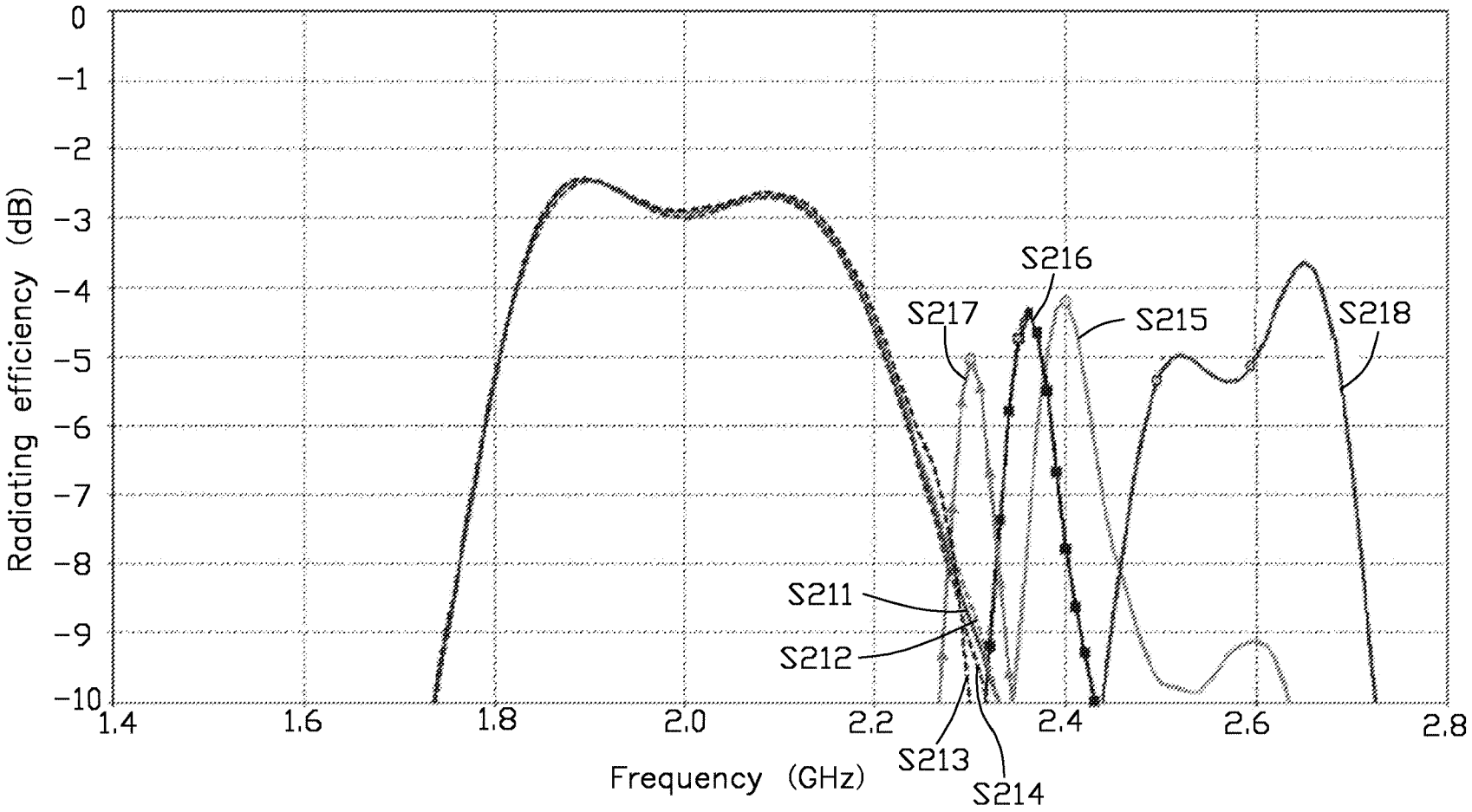
FIG. 23 is a radiating efficiency graph when the antenna structure of FIG. 16 works at a middle frequency operation mode and a high frequency operation mode.

FIG. 23 illustrates a radiating efficiency graph of the antenna structure 200, when the antenna structure 200 works at the middle frequency operation mode and the high frequency operation mode. Curve 211 illustrates a radiating efficiency when the inductance value of the switching element 153 of the first switching circuit 15 is about 0.13 pf. Curve 212 illustrates a radiating efficiency when the inductance value of the switching element 153 of the first switching circuit 15 is about 0.15 pf. Curve 213 illustrates a radiating efficiency when the inductance value of the switching element 153 of the first switching circuit 15 is about 0.2 pf. Curve 214 illustrates a radiating efficiency when the first switching circuit 15 is in an open-circuit state (that is, the first switching circuit 15 does not switch to any switching element 153). Curve 215 illustrates a radiating efficiency when the inductance value of the switching element 153 of the second switching circuit 29 is about 0.13 pf. Curve 216 illustrates a radiating efficiency when the inductance value of the switching element 153 of the second switching circuit 29 is about 0.15 pf. Curve 217 illustrates a radiating efficiency when the inductance value of the switching element 153 of the second switching circuit 29 is about 0.2 pf. Curve 218 illustrates a radiating efficiency when the second switching circuit 29 is in an open-circuit state (that is, the second switching circuit 29 does not switch to any switching element).

Figure 24:
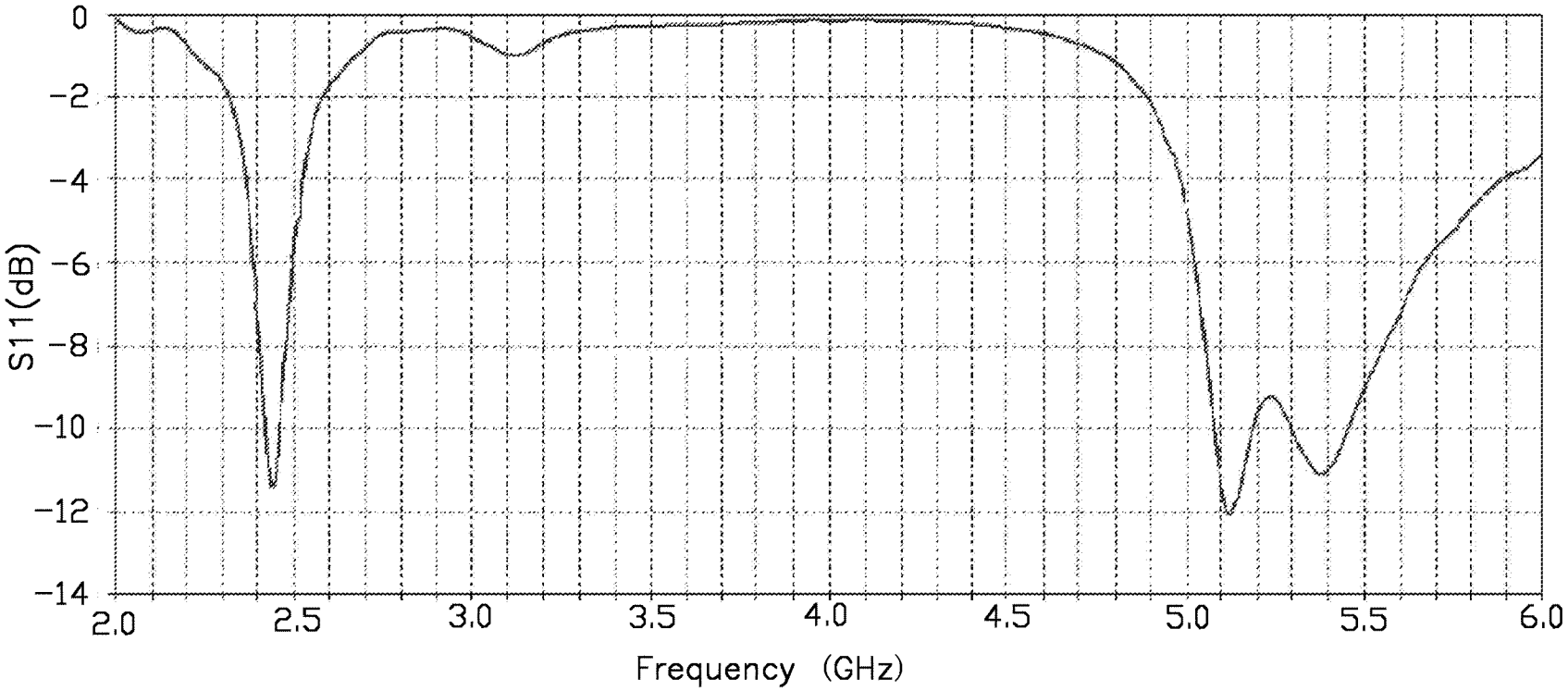
FIG. 24 is a scattering parameter graph when the antenna structure of FIG. 16 works at a WIFI 2.4 GHz mode and a WIFI 5 GHz mode.
Figure 25:
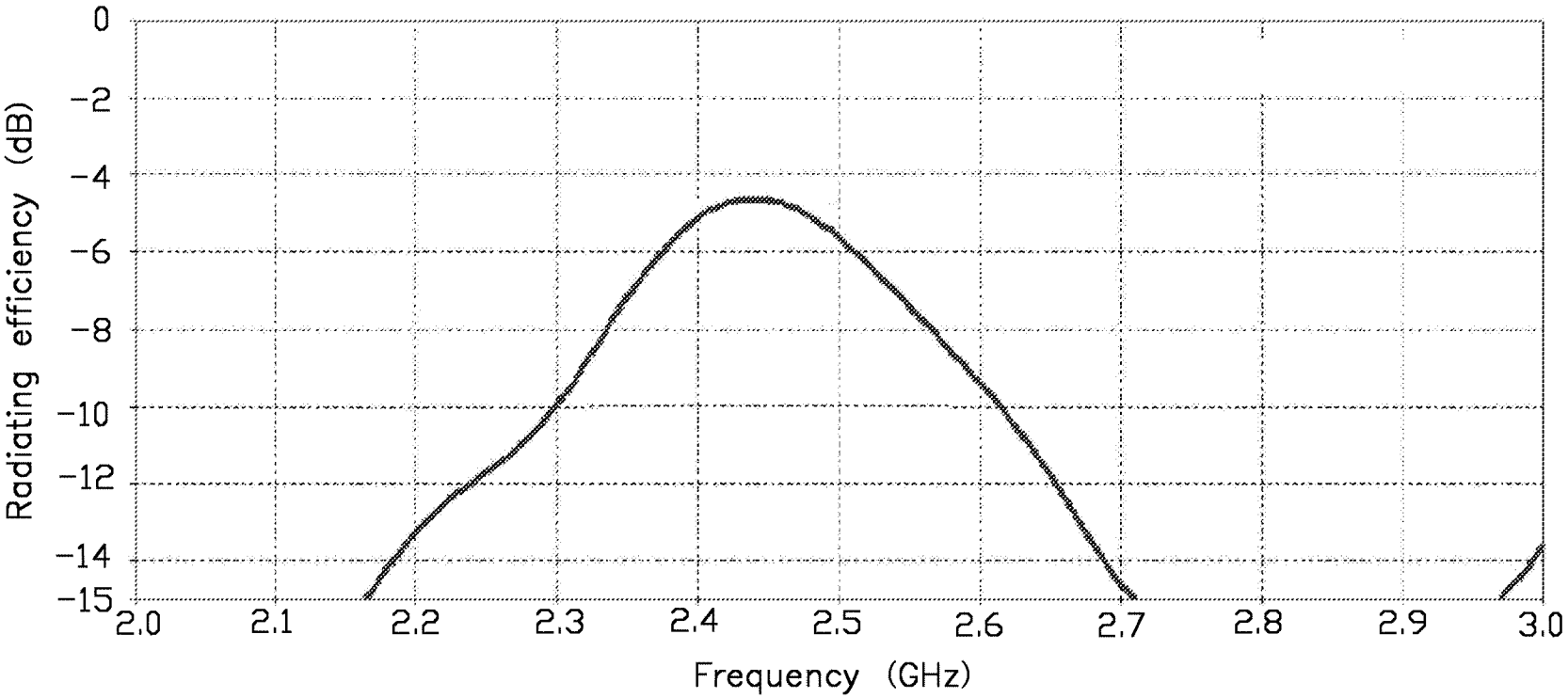
FIG. 25 is a radiating efficiency graph when the antenna structure of FIG. 16 works at a WIFI 2.4 GHz mode.
Figure 26:
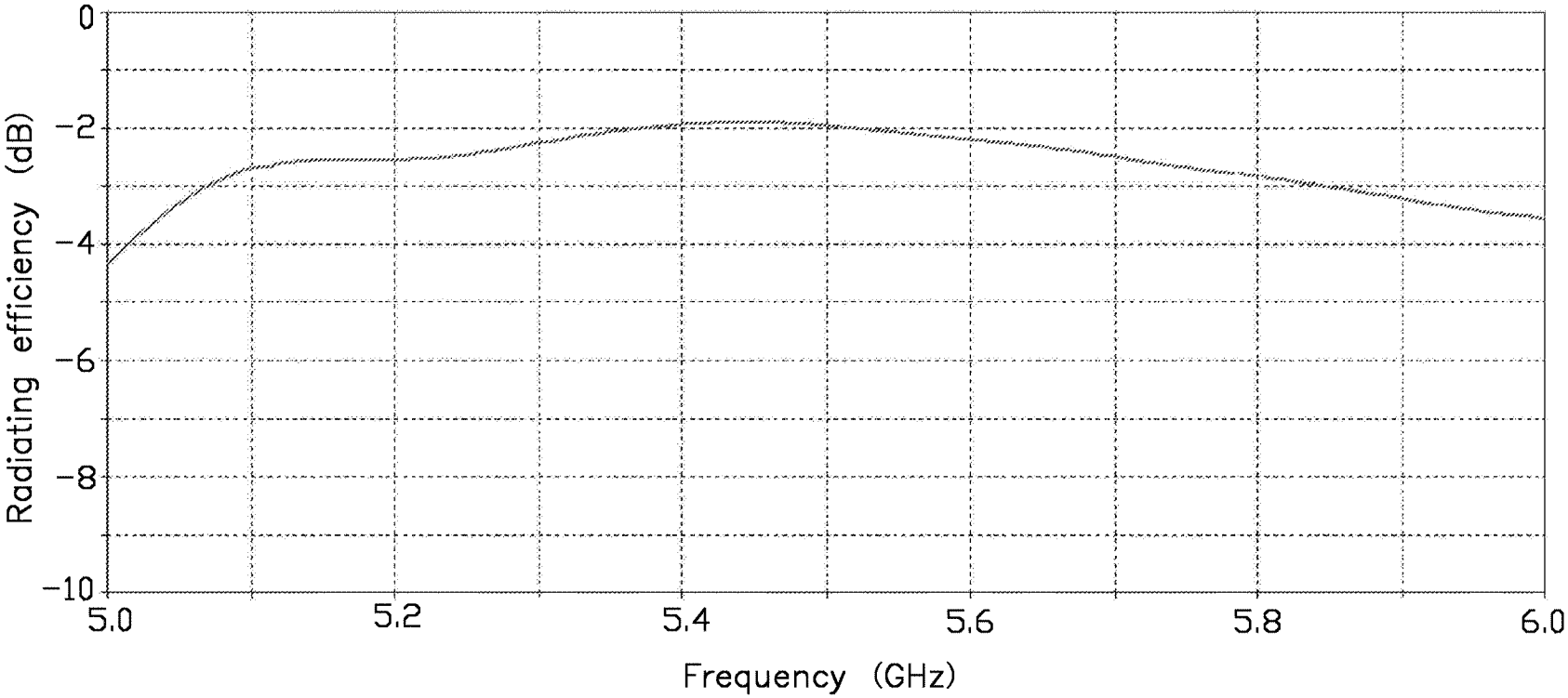
FIG. 26 is a radiating efficiency graph when the antenna structure of FIG. 16 works at a WIFI 5 GHz mode.

FIG. 24 illustrates a scattering parameter graph of the antenna structure 200, when the antenna structure 200 works at the WIFI 2.4 GHz band and WIFI 5 GHz band. FIG. 25 illustrates a radiating efficiency graph of the antenna structure 200, when the antenna structure 200 works at the WIFI 2.4 GHz band. FIG. 26 illustrates a radiating efficiency graph of the antenna structure 200, when the antenna structure 200 works at the WIFI 5 GHz band.

In view of FIGS. 11 to 13 and FIGS. 22 to 26, the antenna structure 200 can work at a low frequency band, for example, LTE-A band 28 (703-803 MHz), LTE-A Band 5 (869-894 MHz), and LTE-A Band 8 (925-926 MHz). The antenna structure 200 can also work at the GPS band (1.575 GHz), the middle frequency band (1805-2170 MHz), the high frequency band (2300-2400 MHz and 2496-2690 MHz), and the WIFI 2.4/5 GHz dual-frequency bands. That is, the antenna structure 200 can work at the low frequency band, the middle frequency band, the high frequency band, and the WIFI 2.4/5G dual-frequency bands, and when the antenna structure 200 works at these frequency bands, a working frequency satisfies a design of the antenna and also has a good radiating efficiency.

As described above, the long portion A1 can activate a first mode to generate radiation signals in a low frequency band, the short portion A2 can activate a third mode to generate radiation signals in a middle frequency band and a high frequency band. The first radiator 26 can activate a fourth mode to generate radiation signals in a high frequency band. The wireless communication device 400 can use the first radiator 26, through carrier aggregation (CA) technology of LTE-A, to receive and/or transmit wireless signals at multiple frequency bands simultaneously. In detail, the wireless communication device 400 can use the CA technology and use at least two of the long portion A1, the short portion A2, and the first radiator 26 to receive and/or transmit wireless signals at multiple frequency bands simultaneously.

In other exemplary embodiments, a location of the first radiator 26 and the second switching circuit 29 can be exchanged with a location of the second radiator 30. One end of the first radiator is electrically connected to the front frame 111. The other end of the first radiator 26 extends towards the second side portion 117. One end of the second switching circuit 29 is electrically connected to the first radiator 26 and the other end of the second switching circuit 29 is electrically connected to the backboard 112. The third feed source 27 is positioned on the front frame 111 and is electrically connected to the first radiator 26. The second radiator 30 is positioned in the receiving space 114 and is positioned adjacent to the short portion A2. One end of the third connecting section 308 of the second radiator 30 connected to front frame 111 is changed to be electrically connected to the isolating portion 28. One end of the fourth feed source 31 is electrically connected to a junction of the first radiating section 303 and the first connecting section 306. The other end of the fourth feed source 31 is electrically connected to the isolating portion 28.

In addition, the antenna structure 100/200 includes the housing 11. The slot 118 and the gap 119 are both defined on the front frame 111 and the side frame 113 instead of the backboard 112. Then the backboard 112 forms an all-metal structure. That is, the backboard 112 does not define any other slot and/or gap and has a good structural integrity and an aesthetic quality.

Figure 27:
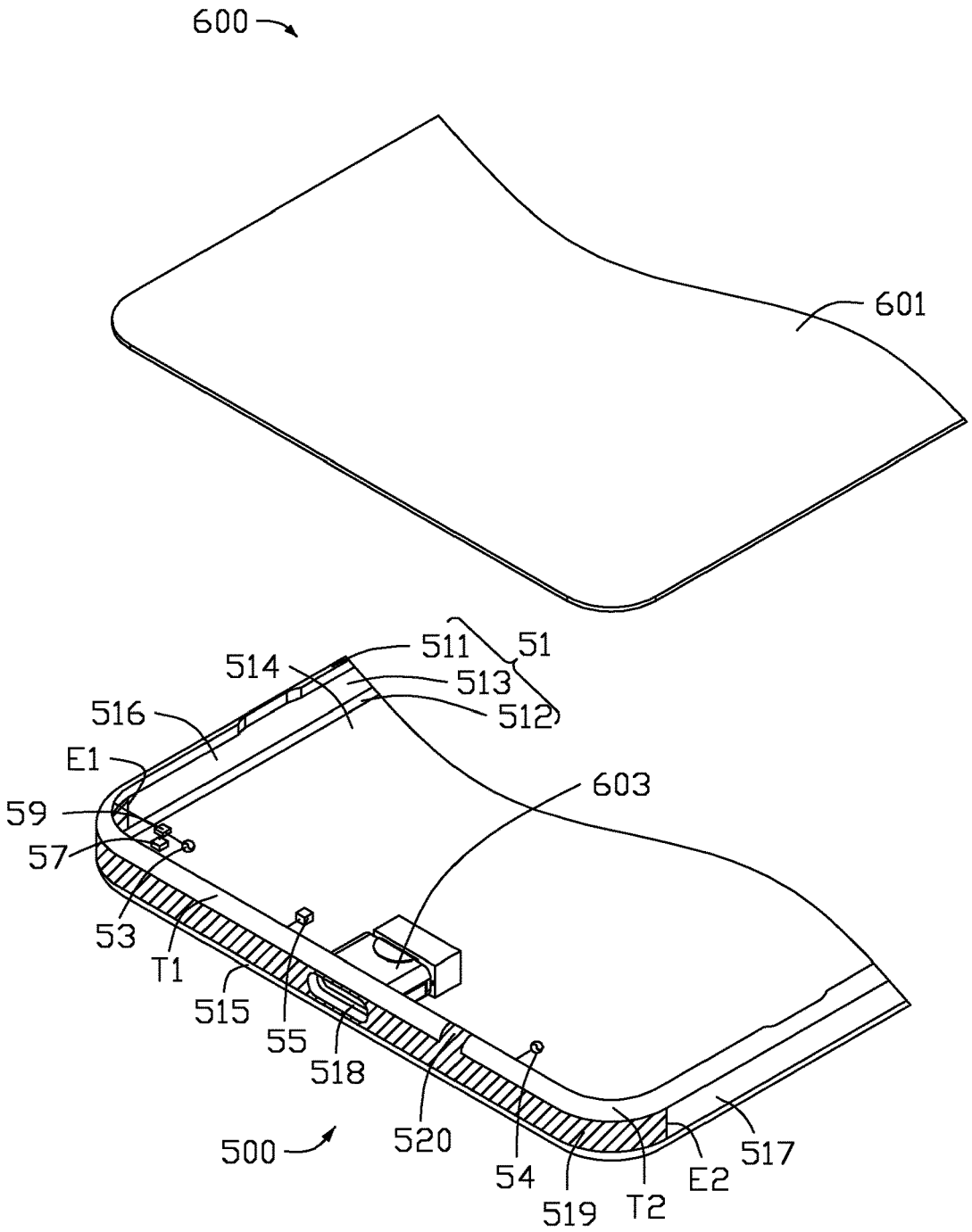
FIG. 27 is an isometric view of a third exemplary embodiment of a wireless communication device using a third exemplary antenna structure.

Exemplary Embodiments 3-5:

FIG. 27 illustrates an embodiment of a wireless communication device 600 using a third exemplary antenna structure 500. The wireless communication device 600 can be a mobile phone or a personal digital assistant, for example. The antenna structure 500 can receive and/or transmit wireless signals.

Figure 28:
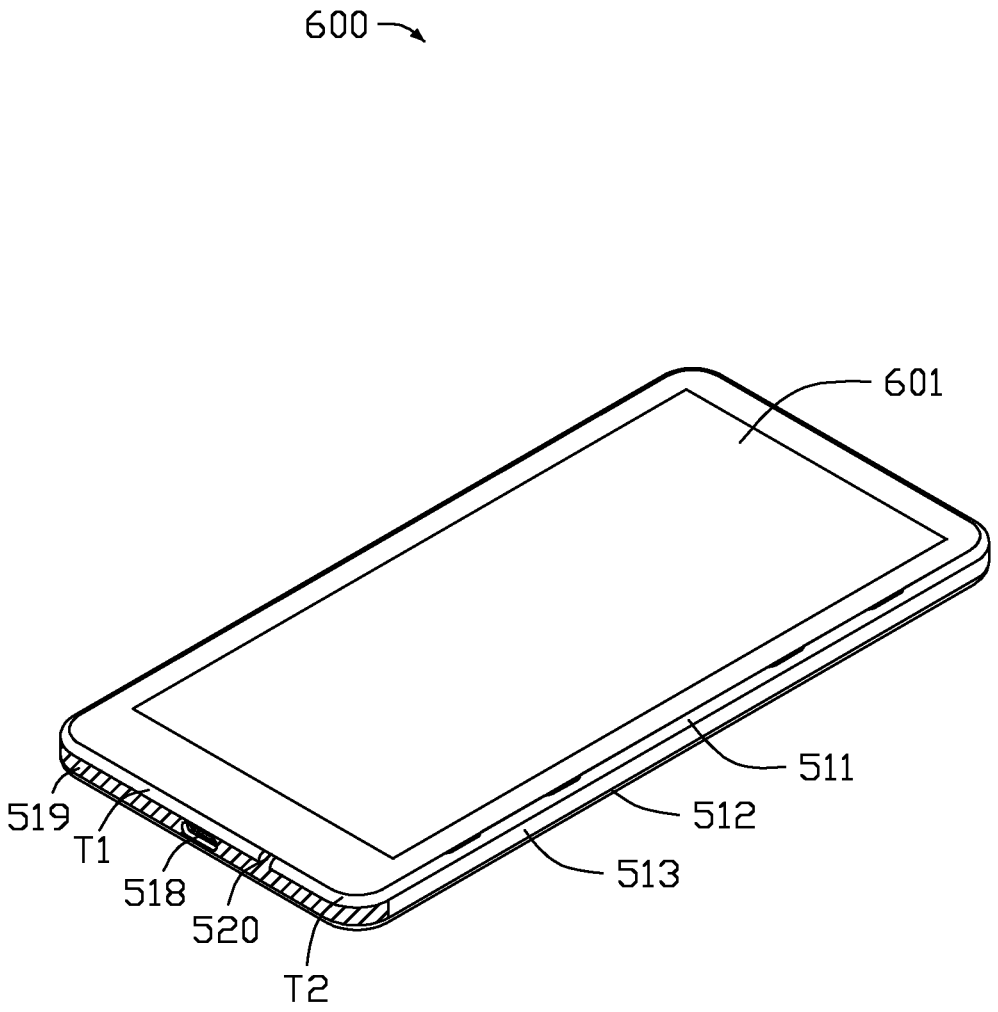
FIG. 28 is an assembled, isometric view of the wireless communication device of FIG. 27.
Figure 29:
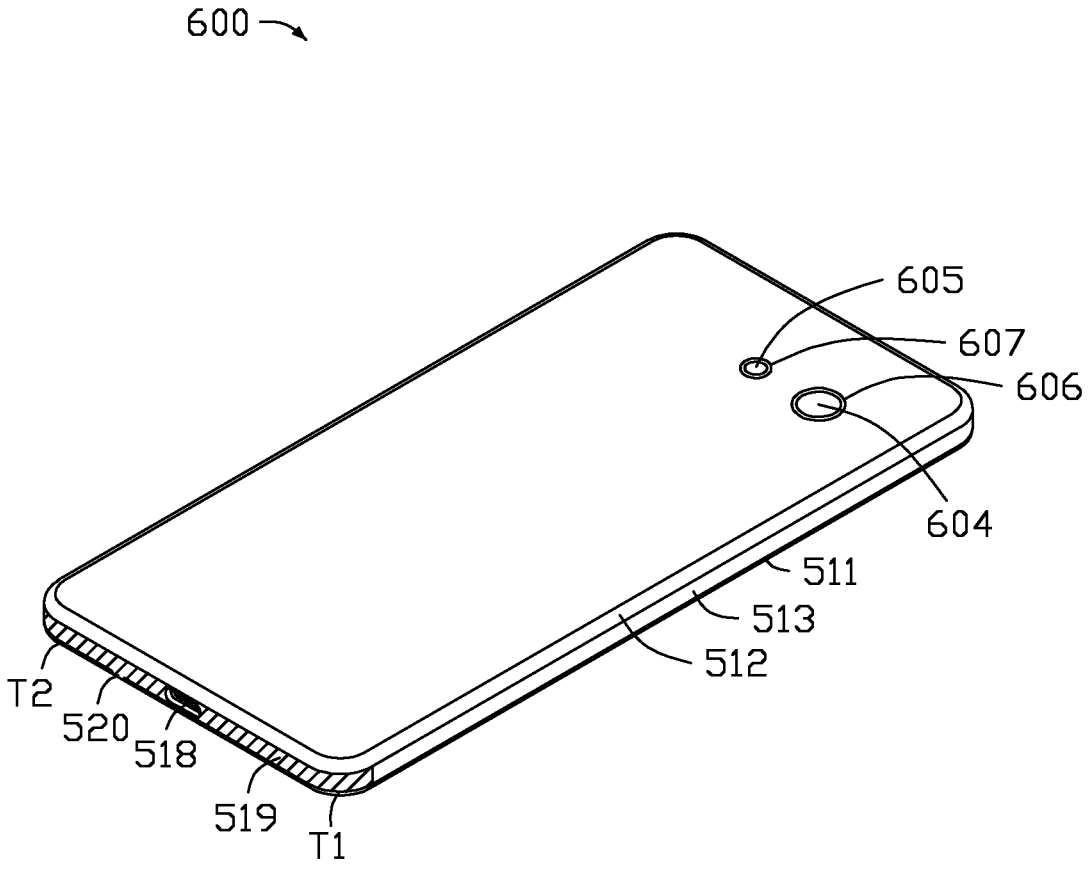
FIG. 29 is similar to FIG. 28, but shown from another angle.

Per FIG. 28 and FIG. 29, the antenna structure 500 includes a housing 51, a first feed source 53, a second feed source 54, a first switching circuit 55, and a second switching circuit 57. The housing 51 can be a metal housing of the wireless communication device 600. In this exemplary embodiment, the housing 51 is made of metallic material and includes a front frame 511, a backboard 512, and a side frame 513. The front frame 511, the backboard 512, and the side frame 513 can be integral with each other. The front frame 511, the backboard 512, and the side frame 513 cooperatively form the metal housing of the wireless communication device 600.

The front frame 511 defines an opening (not shown). The wireless communication device 600 includes a display 601. The display 601 is received in the opening. The display 601 has a display surface. The display surface is exposed at the opening and is positioned parallel to the backboard 512.

The backboard 512 is positioned opposite to the front frame 511. The backboard 512 is an integral and single metallic sheet. The backboard 512 defines holes 606, 607 for exposing a camera lens 604 and a flash light 605. The backboard 512 does not define any slot, break line, and/or gap for dividing the backboard 512. The backboard 512 serves as a ground of the antenna structure 500 and the wireless communication device 600.

In other exemplary embodiments, the wireless communication device 600 further includes a shielding mask or a middle frame (not shown). The shielding mask is positioned at the surface of the display 601 towards the backboard 512 and shields against electromagnetic interference. The middle frame is positioned at the surface of the display 601 towards the backboard 512 and is configured for supporting the display 601. The shielding mask or the middle frame is made of metallic material. The shielding mask or the middle frame is electrically connected to the backboard 512 and serves as ground of the antenna structure 500 and the wireless communication device 600.

The side frame 513 is positioned between the front frame 511 and the backboard 512. The side frame 513 is positioned around a periphery of the front frame 511 and a periphery of the backboard 512. The side frame 513 forms a receiving space 514 together with the display 601, the front frame 511, and the backboard 512. The receiving space 514 can receive a printed circuit board, a processing unit, or other electronic components or modules.

The side frame 513 includes an end portion 515, a first side portion 516, and a second side portion 517. In this exemplary embodiment, the end portion 515 is a bottom portion of the wireless communication device 600. The end portion 515 connects the front frame 511 and the backboard 512. The first side portion 516 is positioned apart from and parallel to the second side portion 517. The end portion 515 has first and second ends. The first side portion 516 is connected to the first end of the end portion 515 and the second side portion 517 is connected to the second end of the end portion 515. The first side portion 516 connects the front frame 511 and the backboard 512. The second side portion 517 also connects the front frame 511 and the backboard 512.

The side frame 513 defines a through hole 518 and a slot 519. The front frame 511 defines a gap 520. In this exemplary embodiment, the through hole 518 is defined at a middle part of the end portion 515 and passes through the end portion 515. The wireless communication device 600 further includes an electronic element 603. In this exemplary embodiment, the electronic element 603 is a Universal Serial Bus (USB) module. The electronic element 603 is positioned in the receiving space 514. The electronic element 603 corresponds to the through hole 518 and is partially exposed from the through hole 518. A USB device can be inserted in the through hole 518 and be electrically connected to the electronic element 603.

In this exemplary embodiment, the slot 519 is defined at the end portion 515 and communicates with the through hole 518. The slot 519 further extends to the first side portion 516 and the second side portion 517. In other exemplary embodiments, the slot 519 can only be defined at the end portion 515 and does not extend to any one of the first side portion 516 and the second side portion 517. In other exemplary embodiments, the slot 519 can be defined at the end portion 515 and extends to one of the first side portion 516 and the second side portion 517.

The gap 520 communicates with the slot 519 and extends across the front frame 511. In this exemplary embodiment, the gap 520 is positioned adjacent to the second side portion 517. The front frame 511 is divided into two portions by the gap 520, these portions being a long portion T1 and a short portion T2 (long and short relative to each other). A first portion of the front frame 511 extending from a first side of the gap 520 to a first end E1 of the slot 519 forms the long portion T1. A second portion of the front frame 511 extending from a second side of the gap 520 to a second end E2 of the slot 519 forms the short portion T2.

In this exemplary embodiment, the gap 520 is not positioned at a middle portion of the end portion 515. The long portion T1 is longer than the short portion T2.

In this exemplary embodiment, the slot 519 and the gap 520 are both filled with insulating material, for example, plastic, rubber, glass, wood, ceramic, or the like, thereby isolating the long portion T1, the short portion T2, and the backboard 512.

In this exemplary embodiment, the slot 519 is defined on the end of the side frame 513 adjacent to the backboard 512 and extends to the front frame 511. Then the long portion T1 and the short portion T2 are fully formed by a portion of the front frame 511. In other exemplary embodiments, a position of the slot 519 can be adjusted. For example, the slot 519 is defined on the end of the side frame 513 adjacent to the backboard 512 and extends towards the front frame 511. Then the long portion T1 and the short portion T2 are formed by a portion of the front frame 511 and a portion of the side frame 513.

In this exemplary embodiment, except for the through hole 518, the slot 519, and the gap 520, a lower half portion of the front frame 511 and the side frame 513 does not define any other slot, break line, and/or gap. That is, there is only one gap 520 defined on the lower half portion of the front frame 511.

Figure 31:
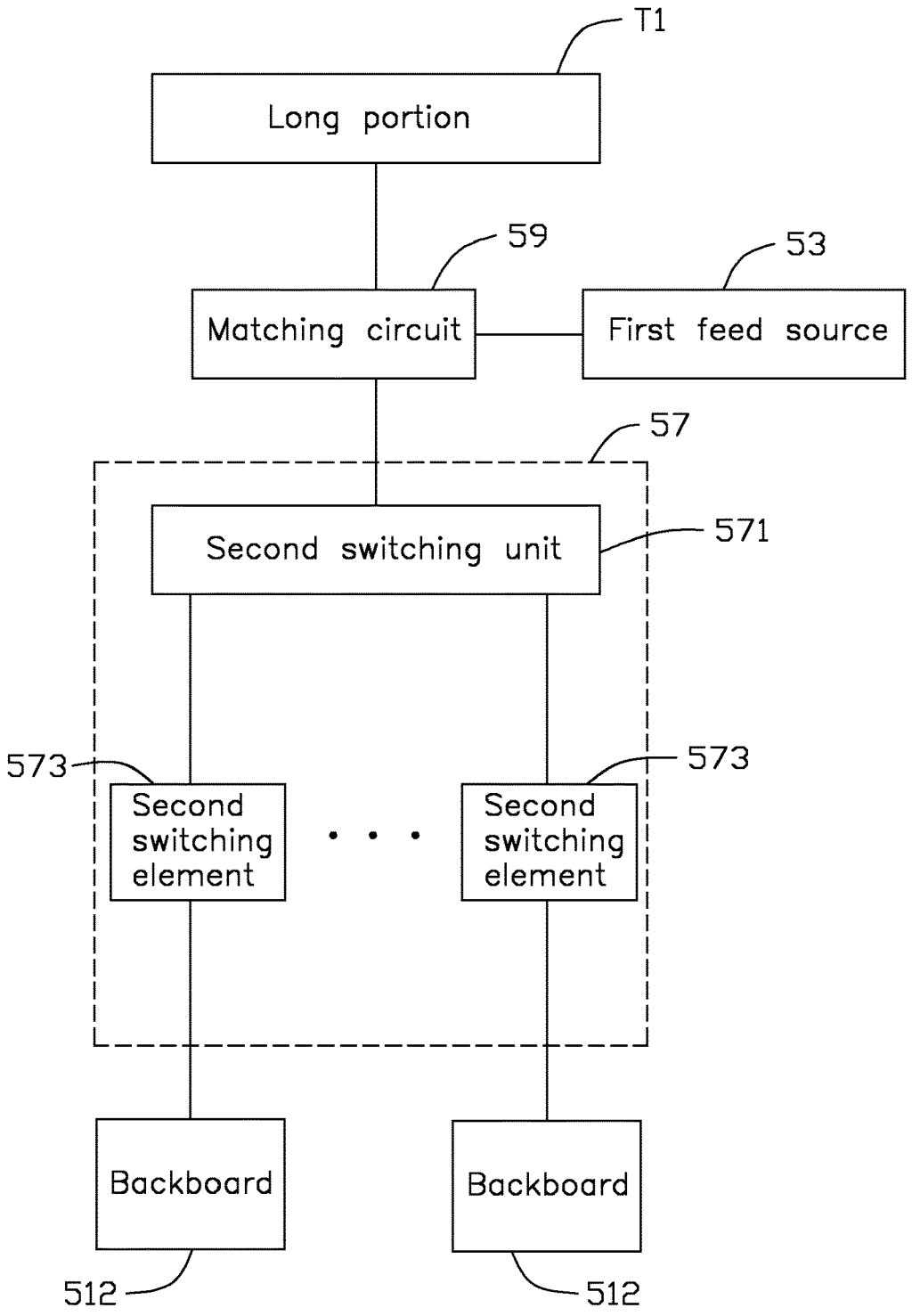
FIG. 31 is a circuit diagram of a second switching circuit of the antenna structure of FIG. 27.

Per FIG. 27 and FIG. 31, through a matching circuit 59, the first feed source 53 is electrically connected to the end of the long portion T1 adjacent to the first side portion 516. The first feed source 53 can feed current to the long portion T1 and activate the long portion T1 in a first mode to generate radiation signals in a first frequency band.

Through a matching circuit (not shown), the second feed source 54 can be electrically connected to the end of the short portion T2 adjacent to the gap 520. The second feed source 54 can feed current to the short portion T2 and activate the short portion T2 in a second mode to generate radiation signals in a second frequency band.

Figure 30:
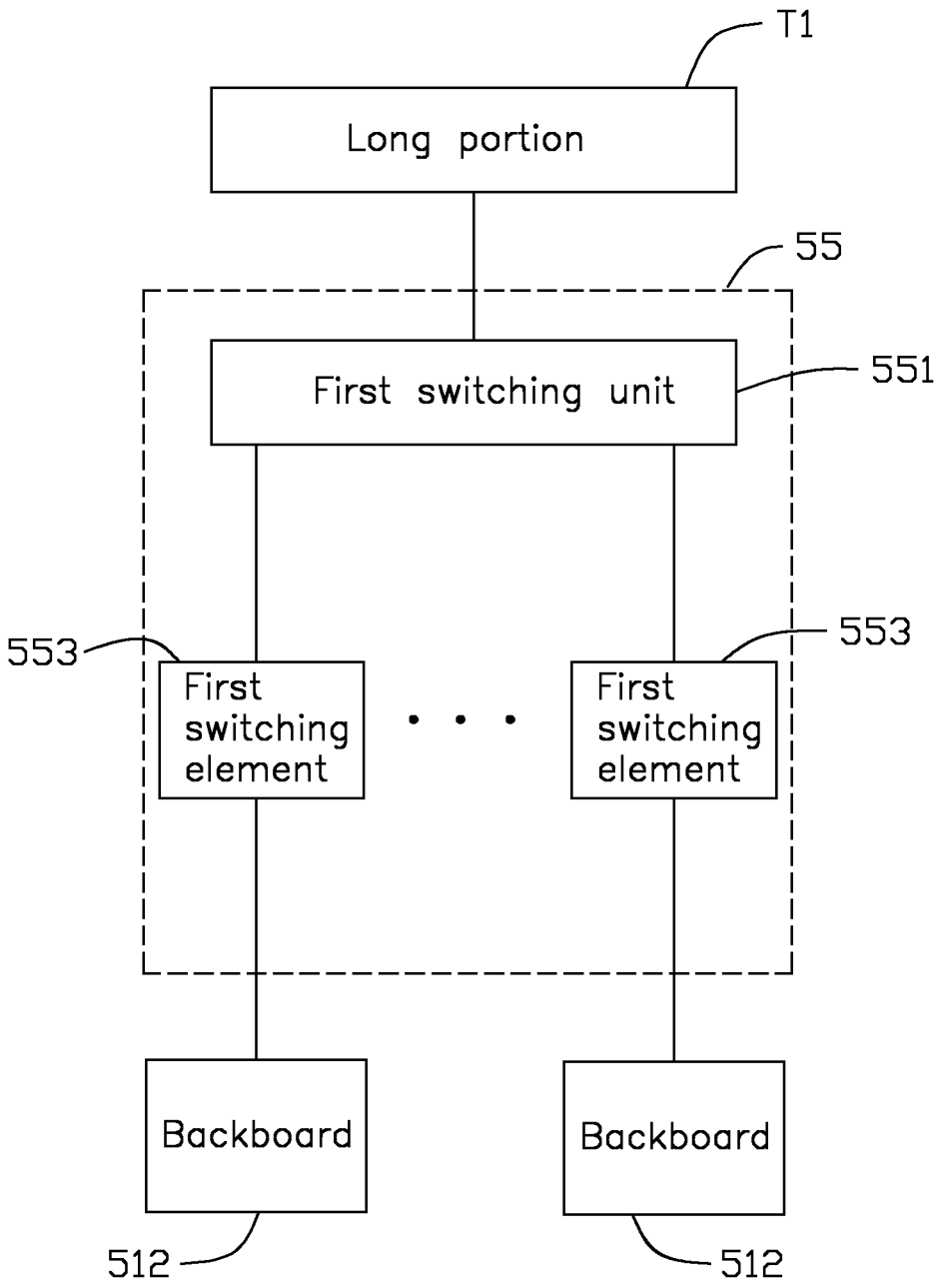
FIG. 30 is a circuit diagram of a first switching circuit of the antenna structure of FIG. 27.

Per FIG. 30, the first switching circuit 55 is electrically connected to a middle portion of the long portion T1. The first switching circuit 55 includes a first switching unit 551 and a plurality of first switching elements 553. The first switching unit 551 is electrically connected to the long portion T1. The first switching elements 553 can be an inductor, a capacitor, or a combination of the inductor and the capacitor.

The first switching elements 553 are connected in parallel. One end of each first switching element 553 is electrically connected to the first switching unit 551. The other end of each first switching element 553 is electrically connected to the backboard 512.

Per FIG. 27 and FIG. 31, one end of the matching circuit 59 is electrically connected to the long portion T1. Another end of the matching circuit 59 is electrically connected to the first feed source 53. One end of the second switching circuit 57 is electrically connected to the matching circuit 59. Another end of the second switching circuit 57 is electrically connected to the backboard 512. In this exemplary embodiment, the second switching circuit 57 includes a second switching unit 571 and a plurality of second switching elements 573. The second switching unit 571 is electrically connected to the matching circuit 59 and then is electrically connected to the long portion T1 through the matching circuit 59. The second switching elements 573 can be an inductor, a capacitor, or a combination of the inductor and the capacitor. The second switching elements 573 are connected in parallel. One end of each second switching element 573 is electrically connected to the second switching unit 571. The other end of each second switching element 573 is electrically connected to the backboard 512.

Through controlling the first switching unit 551 and/or the second switching unit 571, the long portion T1 can be switched to connect with different first switching elements 553 and/or second switching elements 573. Since each first switching element 553 and second switching element 573 has a different impedance, a frequency band of the first mode of the long portion T1 can be adjusted through switching the first switching unit 551 and/or the second switching unit 571, for example, the frequency band of the first mode of the long portion T1 can be offset towards a lower frequency or towards a higher frequency (relative to each other).

Figure 32:
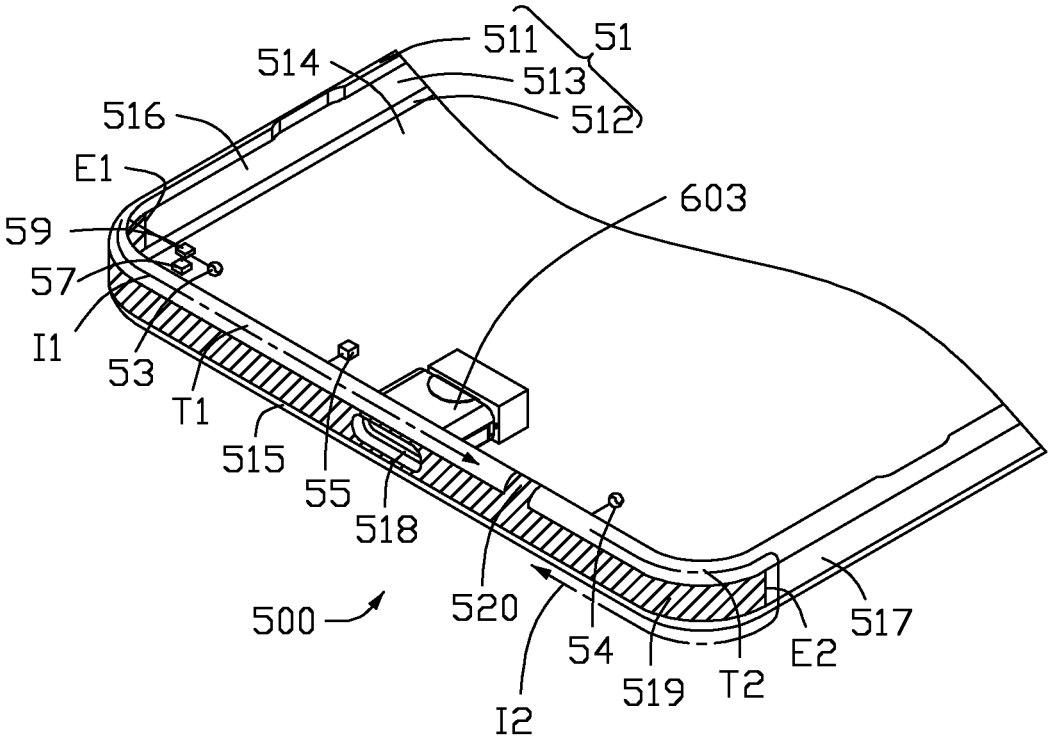
FIG. 32 is a current path distribution graph of the antenna structure of FIG. 27.

Per FIG. 32, when the current enters the long portion T1 from the first feed source 53, the current flows through the long portion T1 and towards the gap 520 (e.g., path I1) to activate the first mode, to generate radiation signals in the first frequency band. When the current enters the short portion T2 from the second feed source 54, the current flows through the front frame 511, the second side portion 517, and the backboard 512 (e.g., path I2) to activate the second mode, to generate radiation signals in the second frequency band. In this exemplary embodiment, the first mode is a low frequency operation mode. The first frequency band is a frequency band of about 704-960 MHz. The second mode is low to middle frequency operation modes. The second frequency band is a frequency band of about 1710-2690 MHz.

Since the antenna structure 500 includes the first switching circuit 55 and the second switching circuit 57, the low frequency operation mode of the long portion T1 can be switched through the first switching circuit 55 and the second switching circuit 57 in coordination with each other. The middle frequency operation mode and the high frequency operation mode of the antenna structure 500 are not thereby affected.

Figure 33:
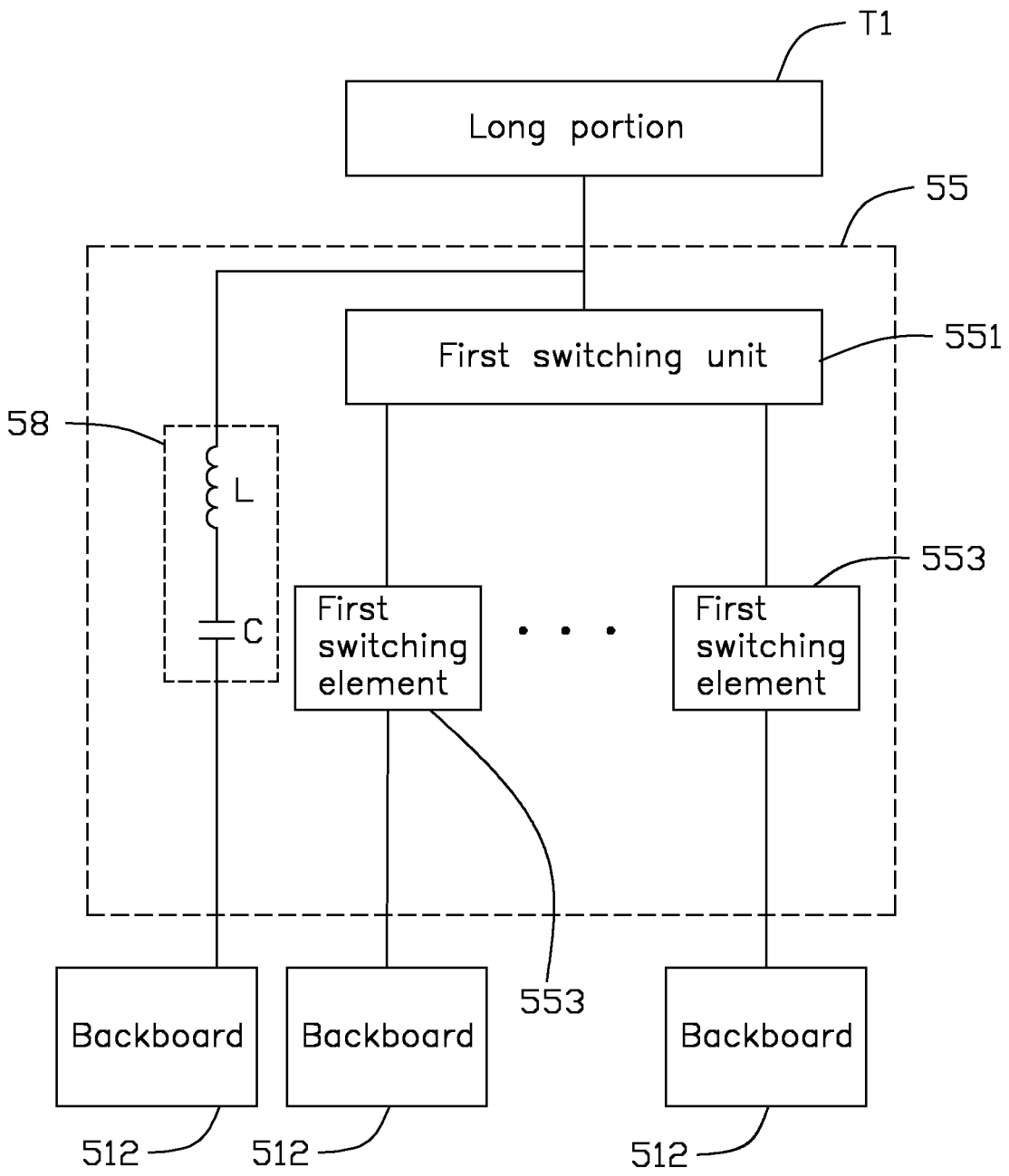
FIG. 33 is a circuit diagram of the first switching circuit of FIG. 30, showing the first switching circuit includes a resonance circuit.

Per FIG. 33, the antenna structure 500 further includes a resonance circuit 58. In one exemplary embodiment, the antenna structure 500 includes one resonance circuit 58. The resonance circuit 58 includes an inductor L and a capacitor C connected in series. The resonance circuit 58 is electrically connected between the long portion T1 and the backboard 512. The resonance circuit 58 is electrically connected in parallel to the first switching unit 551 and at least one first switching element 553.

Figure 34:
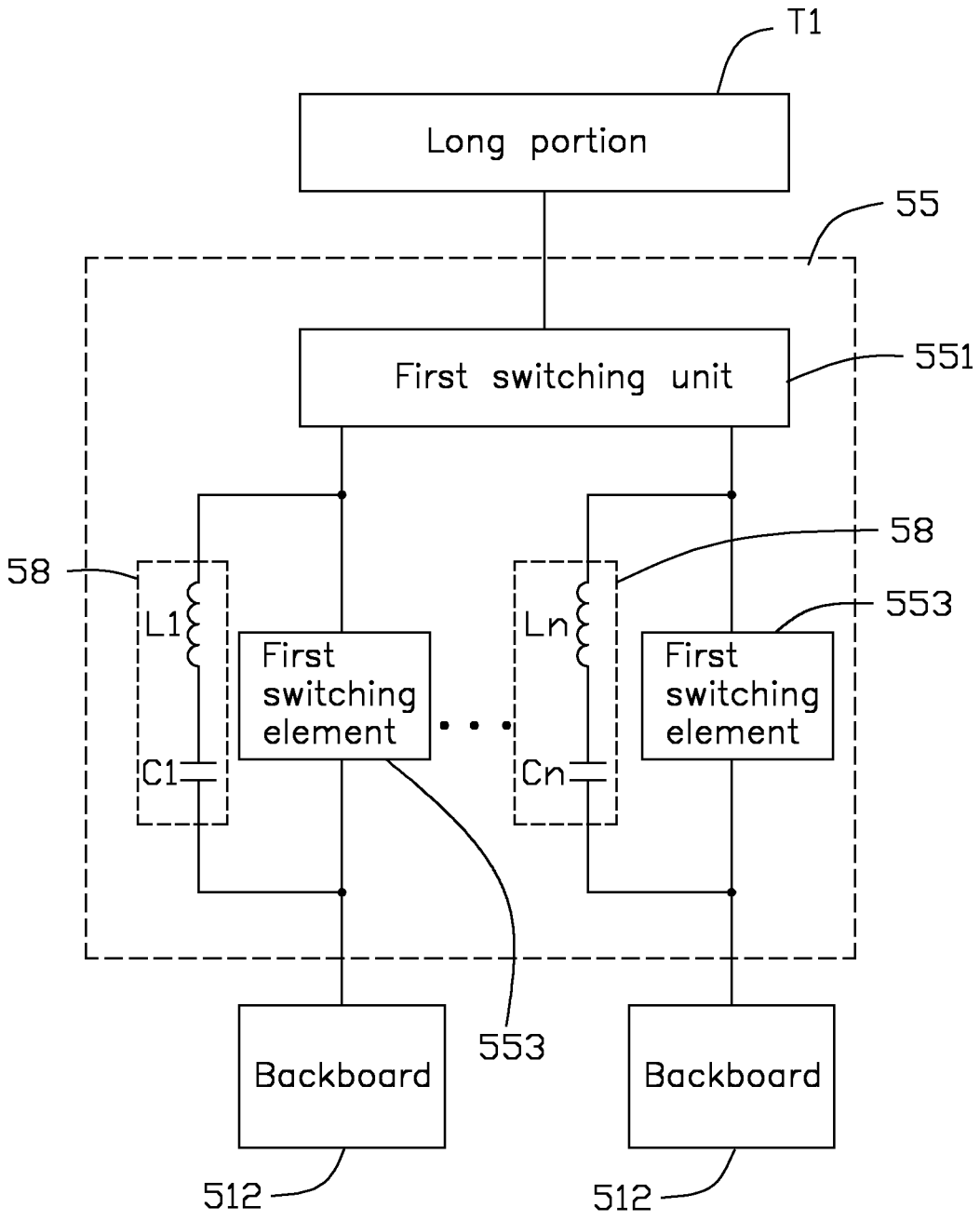
FIG. 34 is similar to FIG. 33, but shown the first switching circuit includes another resonance circuit.

Per FIG. 34, in another exemplary embodiment, the antenna structure 500 includes a plurality of resonance circuits 58. The number of the resonance circuits 58 is equal to the number of first switching elements 553. Each resonance circuit 58 includes inductors L1-Ln and capacitors C1-Cn connected in series. Each resonance circuit 58 is electrically connected in parallel to one of the first switching elements 553 between the first switching unit 551 and the backboard 512.

Per FIG. 30, FIG. 31, FIG. 33, and FIG. 34, the backboard 512 can be replaced by the shielding mask or the middle frame for grounding the first switching circuit 55 and/or the second switching circuit 57.

Figure 35:
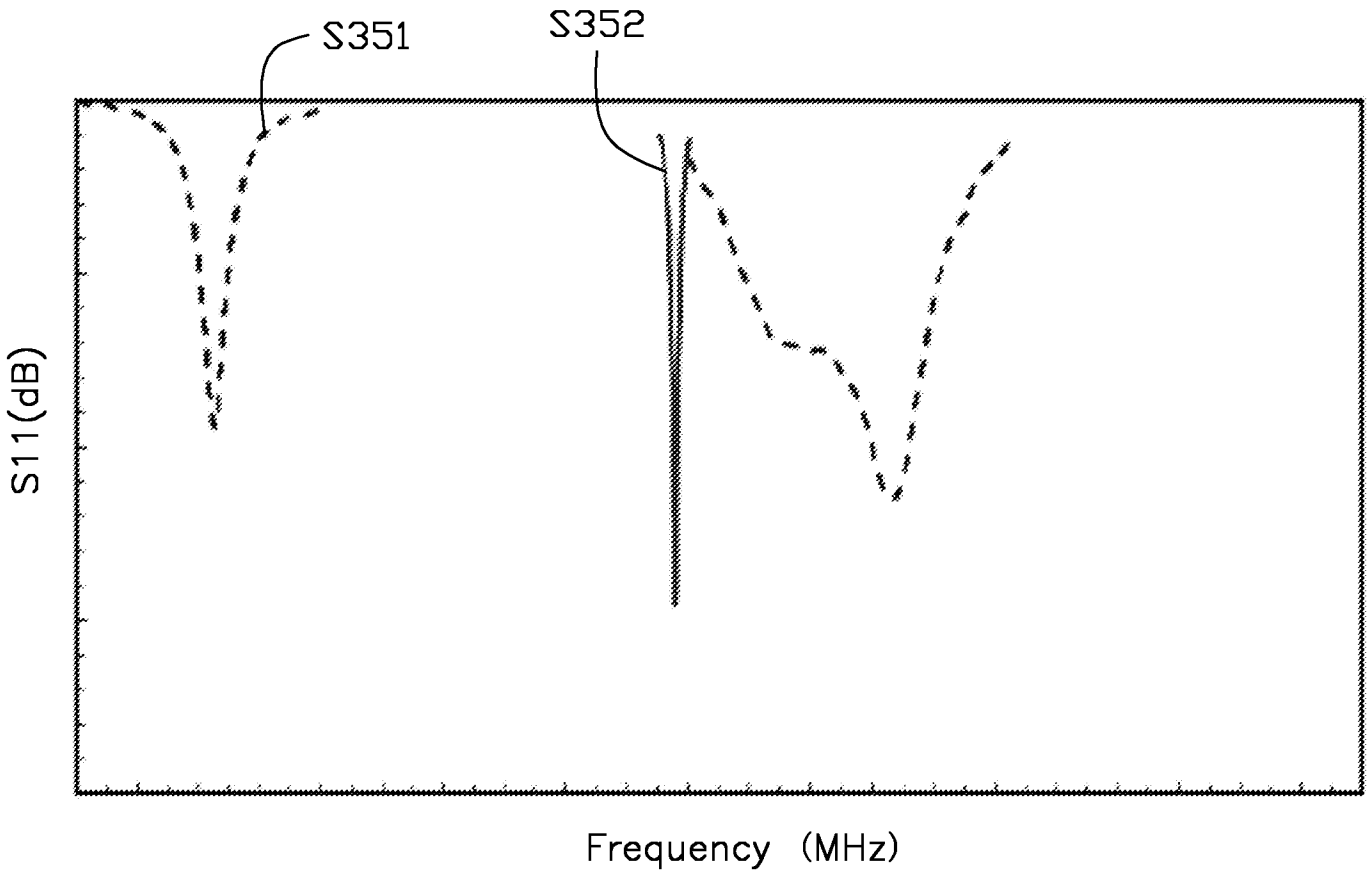
FIG. 35 is a schematic diagram of the antenna structure of FIG. 27, showing the first switching circuit of FIG. 33 includes a resonance circuit and generates a resonance mode.

Per FIG. 35, when the antenna structure 500 does not include the resonance circuit 58 of FIG. 33, the antenna structure 500 works at the first mode (please see the curve S351). When the antenna structure 500 includes the resonance circuit 58, the long portion T1 of the antenna structure 500 can activate an additional resonance mode (that is, a third mode, please see the curve S352) to generate radiation signals in a third frequency band. The third mode can effectively broaden an applied frequency band of the antenna structure 500.

Figure 36:
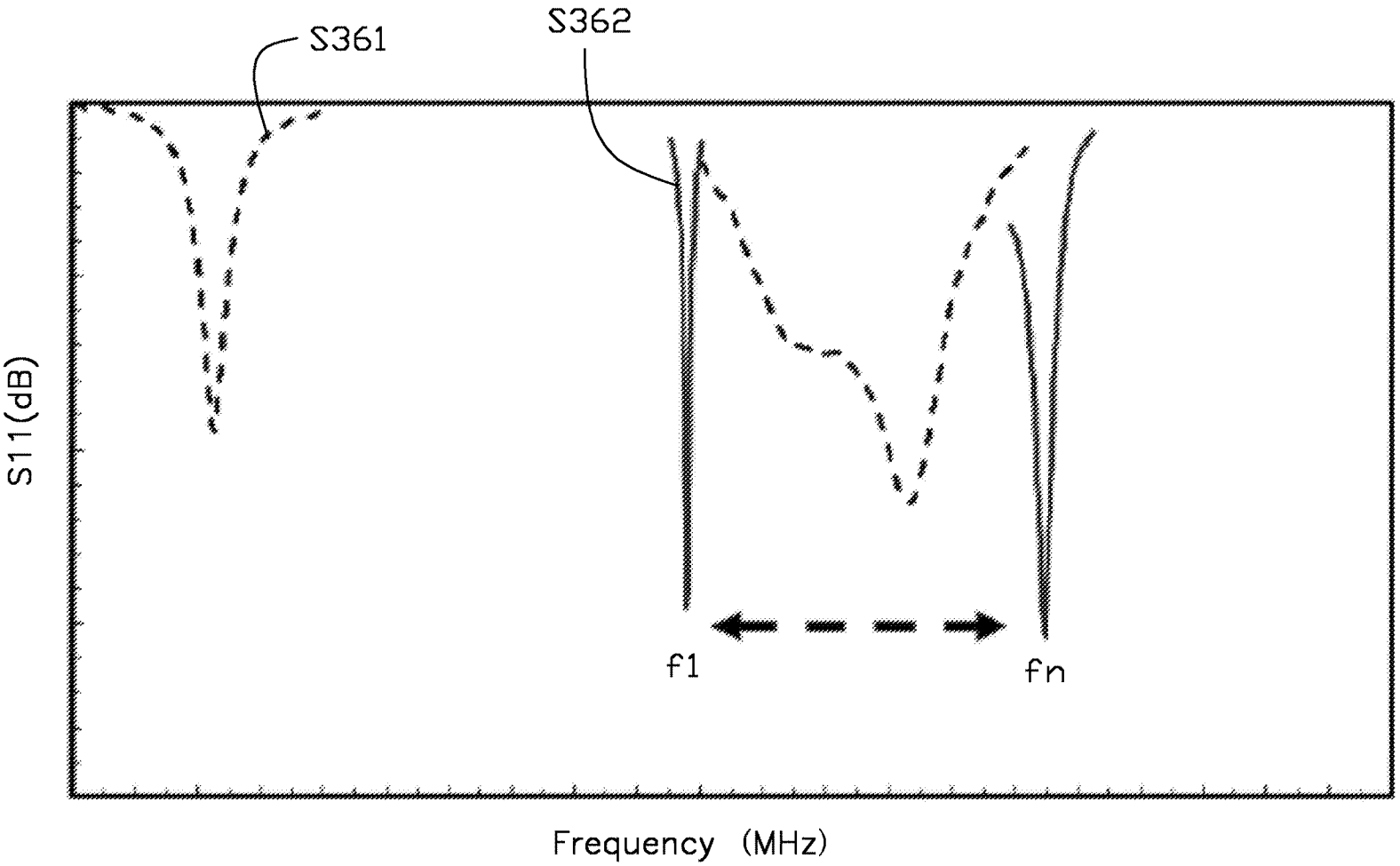
FIG. 36 is a schematic diagram of the antenna structure of FIG. 27, showing the first switching circuit of FIG. 34 includes a resonance circuit and generates a resonance mode.

Per FIG. 36, when the antenna structure 500 does not include the resonance circuit 58 of FIG. 34, the antenna structure 500 works at the first mode (please see the curve S361). When the antenna structure 500 includes the resonance circuit 58, the long portion T1 of the antenna structure 500 can activate the additional resonance mode (please see the curve S362), that is, the third mode. The third mode can effectively broaden an applied frequency band of the antenna structure 500.

In one exemplary embodiment, inductance values of the inductors L1-Ln and capacitance values of the capacitors C1-Cn of the resonance circuit 58 can cooperatively decide a frequency band of the resonance mode when the first mode switches. For example, in one exemplary embodiment, as illustrated in FIG. 36, when the first switching unit 551 switches to different first switching elements 553 through setting the inductance value and the capacitance value of the resonance circuit 58, the resonance mode of the antenna structure 500 can also be switched. For example, the resonance mode of the antenna structure 500 can be moved from f1 to fn.

In other exemplary embodiments, the frequency band of the resonance mode can be fixed through setting the inductance value and the capacitance value of the resonance circuit 58. Then no matter to which first switching element 553 the first switching unit 551 is switched, the frequency band of the resonance mode is fixed and keeps unchanged.

In other exemplary embodiments, the resonance circuit 58 is not limited to include the inductor L and the capacitor C, and can include other resonance components.

Figure 37:
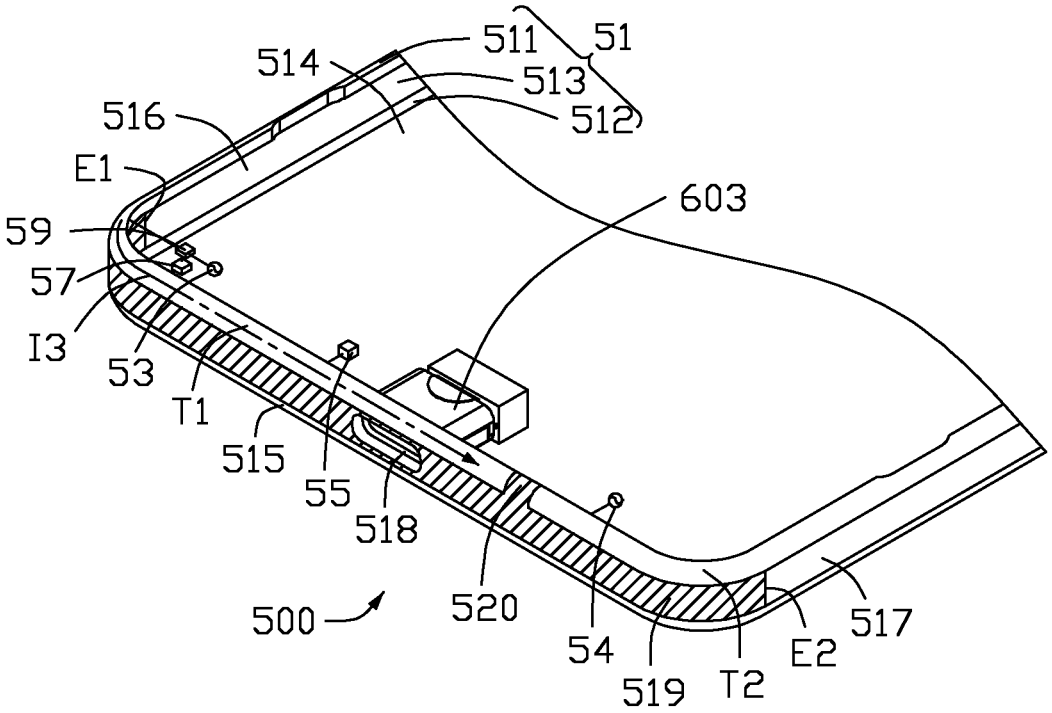
FIG. 37 is a current path distribution graph when the antenna structure of FIG. 27 includes a resonance circuit and works at a low frequency operation mode.

Per FIG. 37, when the current enters the long portion T1 from the first feed source 53, the current flows through the long portion T1 and towards the gap 520 (e.g., path I3) to activate the first mode, to generate radiation signals in a first frequency band. Since the antenna structure 500 includes the first switching circuit 55 and the second switching circuit 57, the low frequency operation mode of the long portion T1 can be switched through the first switching circuit 55 and the second switching circuit 57 in coordination with each other, and the middle frequency operation mode and the high frequency operation mode of the antenna structure 500 are not affected. In this exemplary embodiment, the first mode is a low frequency operation mode. The first frequency band is a frequency band of about 704-960 MHz.

Figure 38:
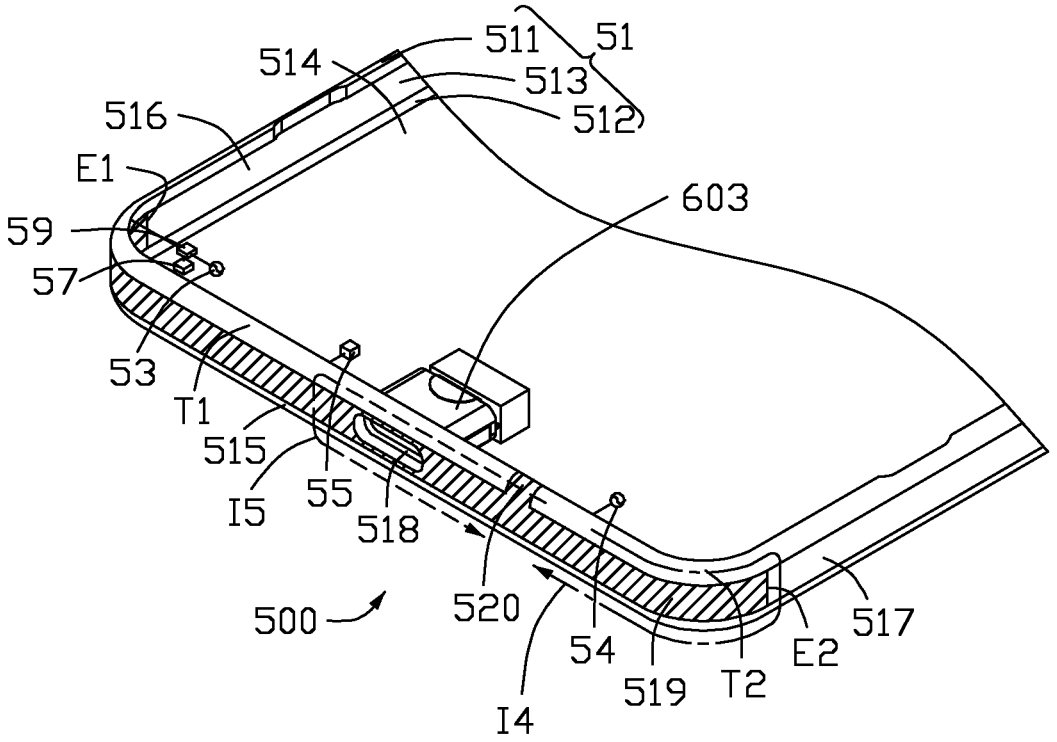
FIG. 38 is a current path distribution graph when the antenna structure of FIG. 27 includes a resonance circuit and works at a frequency band of about 1710-2690 MHz.

Per FIG. 38, when the current enters the short portion T2 from the second feed source 54, the current flows through the front frame 511, the second side portion 517, and the backboard 512 (e.g., path I4) to activate the second mode, to generate radiation signals in the second frequency band. When the current enters the short portion T2 from the second feed source 54, the current is coupled to the long portion T1 through the gap 520, flows through the resonance circuit 58 of the first switching circuit 55, and flows to the backboard 512 (e.g., path I4). Then, through a coupling of the gap 520 and a configuration of the resonance circuit 58, the short portion T2 further activates the third mode, to generate radiation signals in the third frequency band. In this exemplary embodiment, the second mode is a middle frequency operation mode. The second frequency band is a frequency band of about 1710-2400 MHz. The third mode is a high frequency operation mode and the third frequency band is about 2400-2690 MHz.

Figure 39:
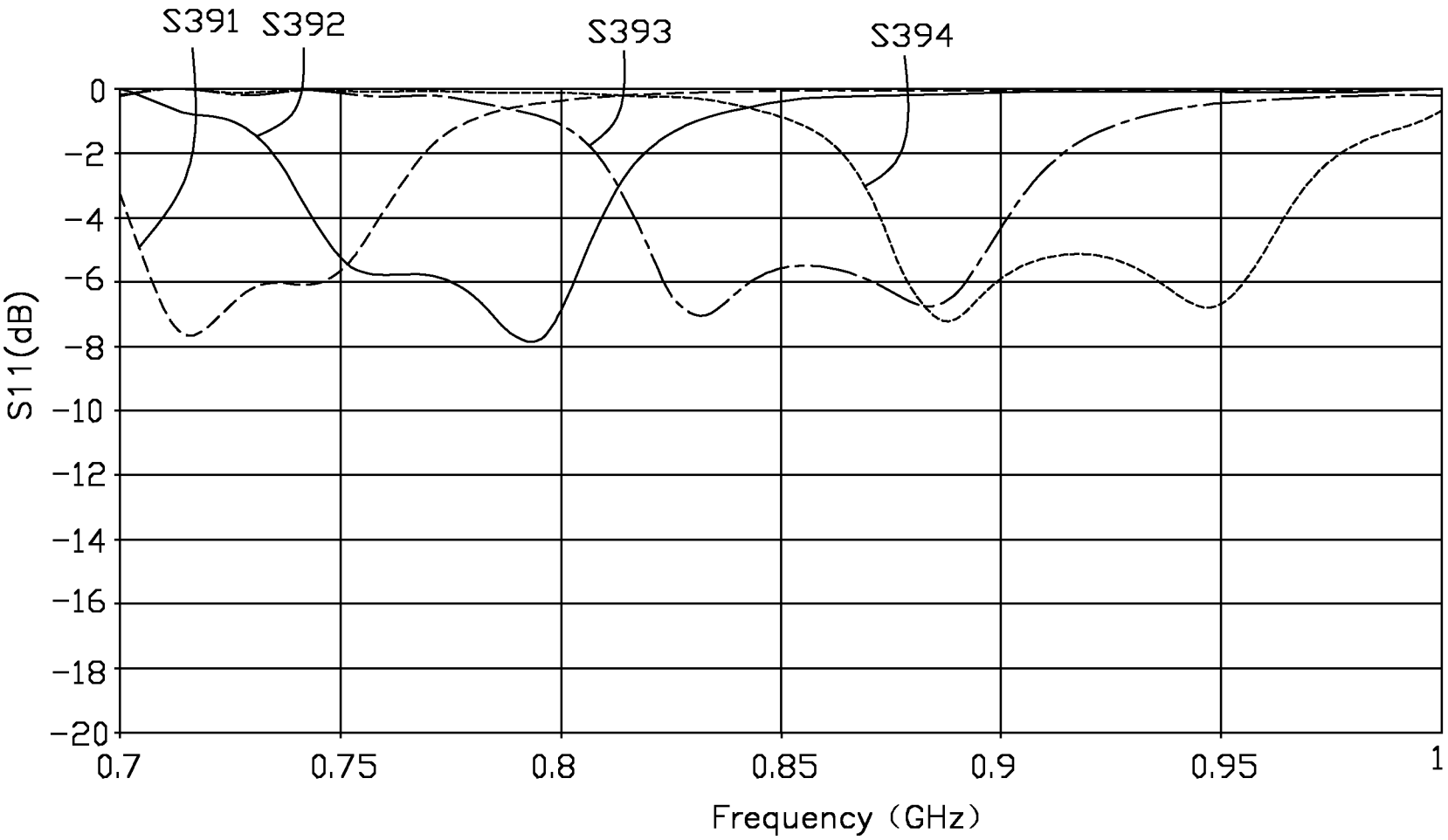
FIG. 39 is a scattering parameter graph when the antenna structure of FIG. 27 works at a low frequency operation mode.

FIG. 39 illustrates a scattering parameter graph of the antenna structure 500, when the antenna structure 500 works at the low frequency operation mode. Curve S391 illustrates a scattering parameter when the antenna structure 500 works at a frequency band of about 704-746 MHz. Curve S392 illustrates a scattering parameter when the antenna structure 500 works at a frequency band of about 746-787 MHz. Curve S393 illustrates a scattering parameter when the antenna structure 500 works at a frequency band of about 824-894 MHz. Curve S394 illustrates a scattering parameter when the antenna structure 500 works at a frequency band of about 880-960 MHz. Curves S391-S394 respectively correspond to four different frequency bands and respectively correspond to four of the plurality of low frequency operation modes of the first switching circuit 55 and the second switching circuit 57.

Figure 40:
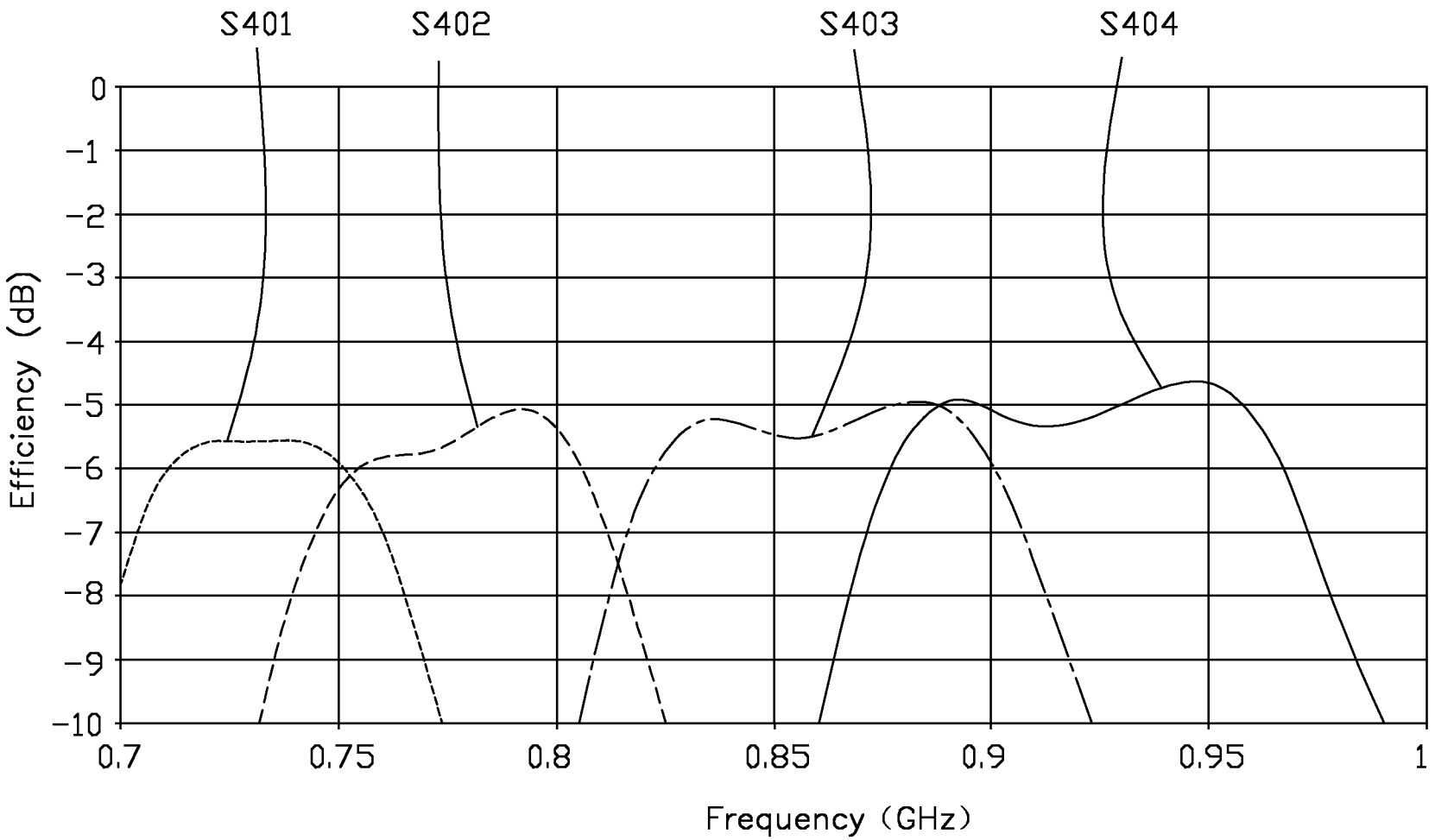
FIG. 40 is a radiating efficiency graph when the antenna structure of FIG. 27 works at a low frequency operation mode.

FIG. 40 illustrates a radiating efficiency graph of the antenna structure 500, when the antenna structure 500 works at the low frequency operation mode. Curve S401 illustrates a radiating efficiency when the antenna structure 500 works at a frequency band of about 704-746 MHz. Curve S402 illustrates a radiating efficiency when the antenna structure 500 works at a frequency band of about 746-787 MHz. Curve S403 illustrates a radiating efficiency when the antenna structure 500 works at a frequency band of about 824-894 MHz. Curve S404 illustrates a radiating efficiency when the antenna structure 500 works at a frequency band of about 880-960 MHz. Curves S401-S404 respectively correspond to four different frequency bands and respectively correspond to four of the plurality of low frequency operation modes of the first switching circuit 55 and the second switching circuit 57.

Figure 41:
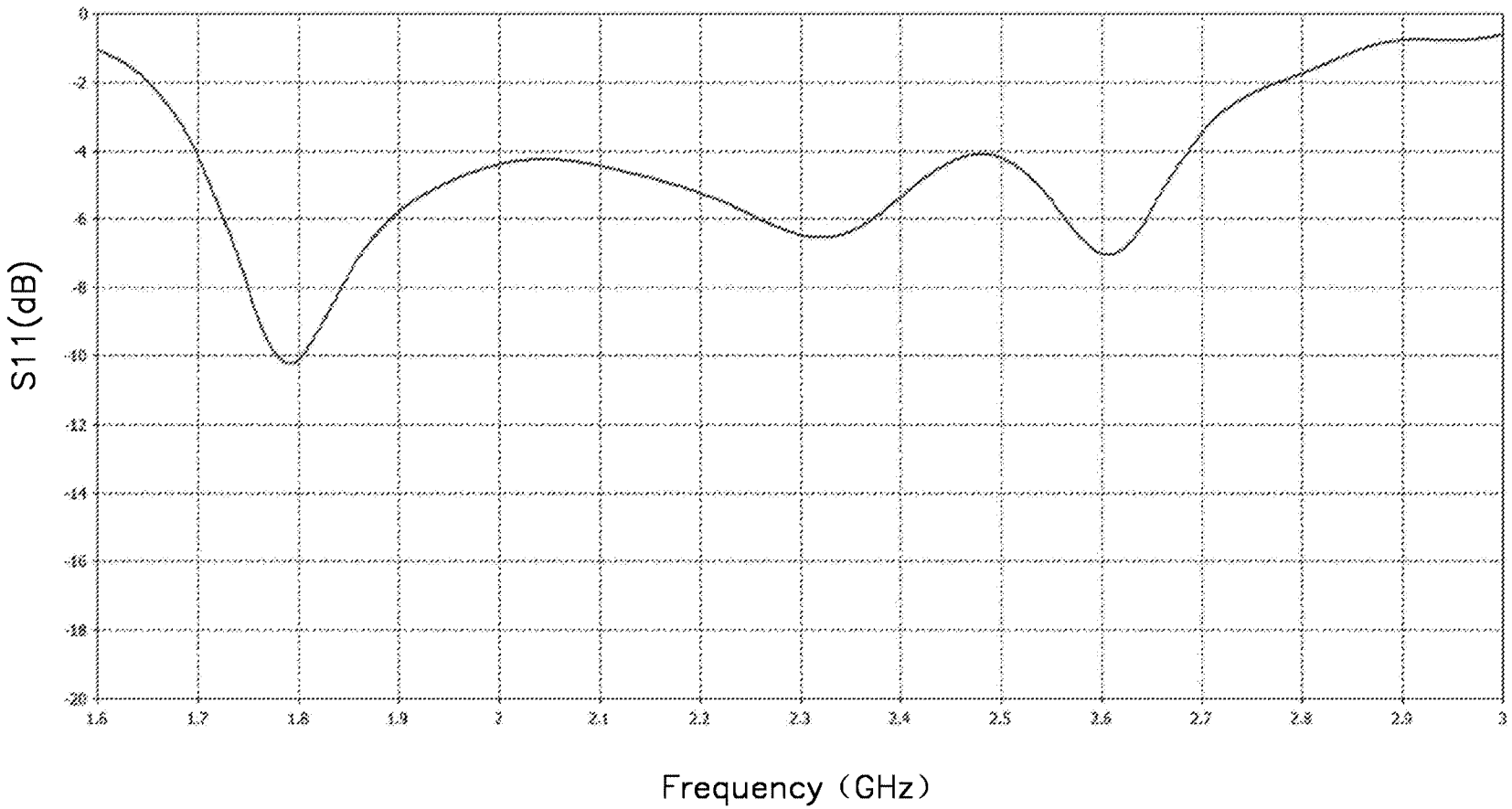
FIG. 41 is a scattering parameter graph when the antenna structure of FIG. 27 works at a frequency band of about 1710-2690 MHz.
Figure 42:
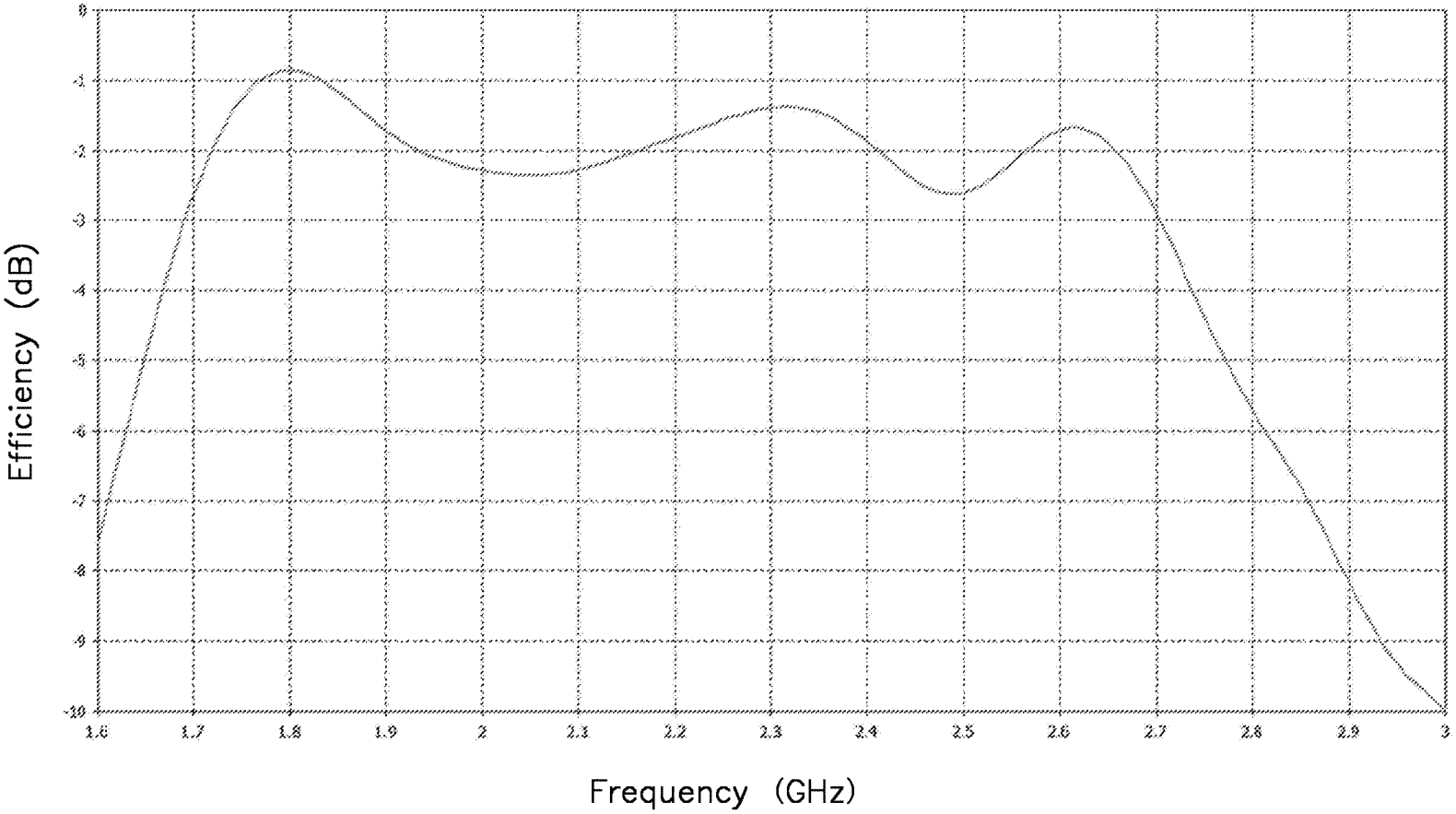
FIG. 42 is a radiating efficiency graph when the antenna structure of FIG. 27 works at a frequency band of about 1710-2690 MHz.

FIG. 41 illustrates a scattering parameter graph of the antenna structure 500, when the antenna structure 500 works at the middle, high frequency operation modes (1710-2690 MHz). FIG. 42 illustrates a radiating efficiency graph of the antenna structure 500, when the antenna structure 500 works at the middle, high frequency operation modes (1710-2690 MHz).

In view of FIGS. 39 to 42, the antenna structure 500 can work at a low frequency band, for example, frequency bands of about 704-746 MHz, 746-787 MHz, 824-894 MHz, and 880-960 MHz. The antenna structure 500 can also work at the middle frequency band and the high frequency band (1710-2690 MHz). That is, the antenna structure 500 can work at the low frequency band, the middle frequency band, and the high frequency band, and when the antenna structure 500 works at these frequency bands, a working frequency satisfies a design of the antenna and also has a good radiating efficiency.

Figure 43:
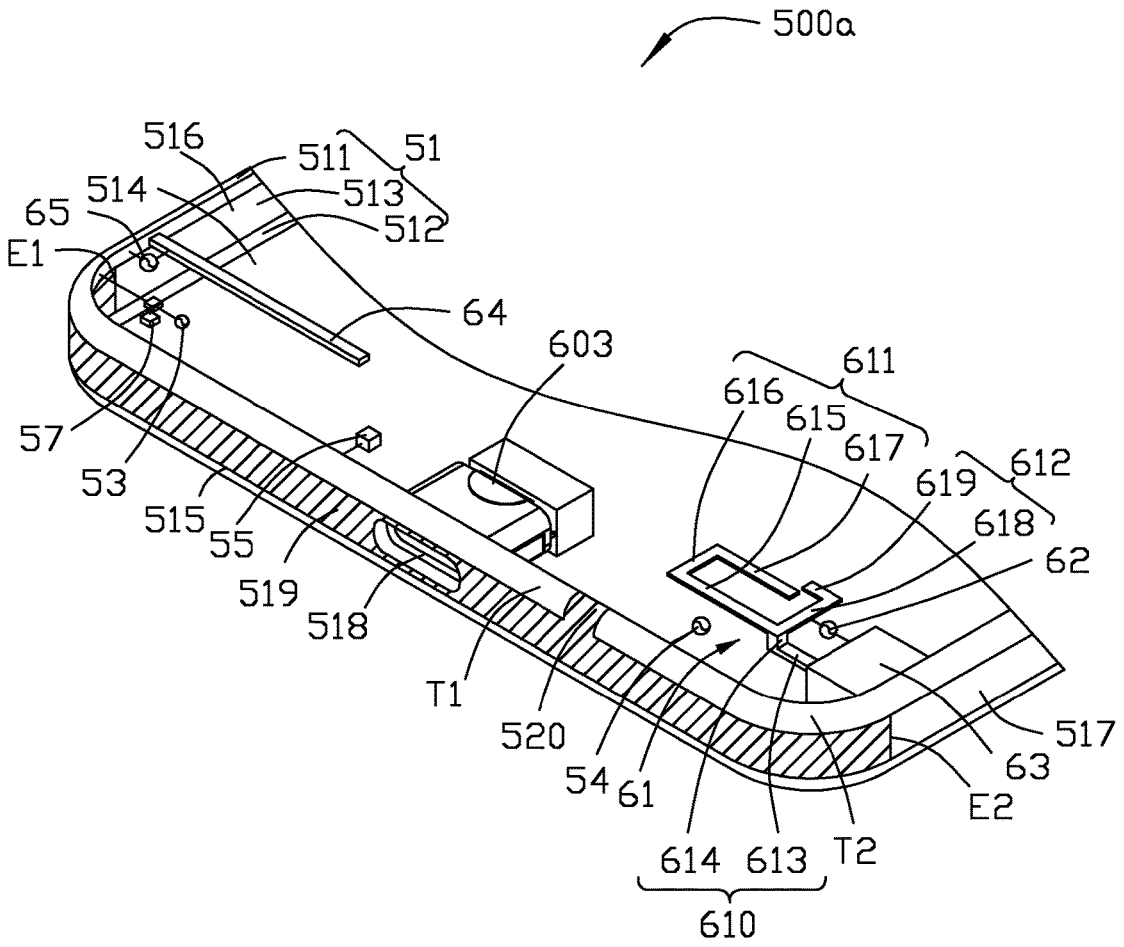
FIG. 43 is an isometric view of a fourth exemplary embodiment of a wireless communication device using a fourth exemplary antenna structure.

FIG. 43 illustrates a fourth exemplary antenna structure 500*a*. The antenna structure 500*a* includes a housing 51, a first feed source 53, a second feed source 54, a first switching circuit 55, and a second switching circuit 57. The housing 51 includes a front frame 511, a backboard 512, and a side frame 513. The side frame 513 includes an end portion 515, a first side portion 516, and a second side portion 517. The side frame 513 defines a slot 519. The front frame 511 defines a gap 520. The front frame 511 is divided into two portions by the gap 520. The two portions include a long portion T1 and a short portion T2.

In this exemplary embodiment, the antenna structure 500*a* differs from the antenna structure 500 in that the antenna structure 500*a* further includes a first radiator 61, a third feed source 62, an isolating portion 63, a second radiator 64, and a fourth feed source 65.

The first radiator 61 is positioned in the receiving space 514. The first radiator 61 is positioned adjacent to the short portion T2 and is spaced apart from the backboard 512. The first radiator 61 includes a first radiating portion 610, a second radiating portion 611, and a third radiating portion 612. The first radiating portion 610 is substantially L-shaped and includes a first radiating arm 613 and a second radiating arm 614. The first radiating arm 613 is substantially a strip. One end of the first radiating arm 613 is electrically connected to the isolating portion 63 and extends along a direction parallel to the end portion 515 towards the first side portion 516. The second radiating arm 614 is substantially a strip and is coplanar with the first radiating arm 613. The second radiating arm 614 is perpendicularly connected to the end of the first radiating arm 613 adjacent to the first side portion 516 and extends along a direction perpendicular to and away from the backboard 512.

The second radiating portion 611 is substantially U-shaped and includes a first radiating section 615, a second radiating section 616, and a third radiating section 617, connected in that order. The first radiating section 615, the second radiating section 616, and the third radiating section 617 are coplanar with each other and are positioned at a plane parallel to the plane of the first radiating arm 613. The first radiating section 615 is substantially rectangular and is positioned parallel to the end portion 515. One end of the first radiating section 615 is perpendicularly connected to the end of the second radiating arm 614 away from the first radiating arm 613 and extends along a direction towards the first side portion 516. The second radiating section 616 is substantially a strip. One end of the second radiating section 616 is perpendicularly connected to the end of the first radiating section 615 away from the second radiating arm 614. Another end of the second radiating section 616 extends along a direction parallel to the second side portion 517 and away from the end portion 515 to form an L-shaped structure with the first radiating section 615.

The third radiating section 617 is substantially rectangular. One end of the third radiating section 617 is connected to the end of the second radiating section 616 away from the first radiating section 615. Another end of the third radiating section 617 extends along a direction parallel to the first radiating section 615 towards the second side portion 517. The third radiating section 617 and the first radiating section 615 are positioned at the same side of the second radiating section 616. The third radiating section 617 and the first radiating section 615 are positioned at two ends of the second radiating section 616.

The third radiating portion 612 is substantially L-shaped and includes a first connecting section 618 and a second connecting section 619. The first connecting section 618 is substantially rectangular. One end of the first connecting section 618 is electrically connected to a junction of the second radiating arm 614 and the first radiating section 615. Another end of the first connecting section 618 extends along a direction parallel to the second radiating section 616 towards the third radiating section 617, until it passes over the third radiating section 617. The second connecting section 619 is substantially rectangular. One end of the second connecting section 619 is perpendicularly connected to the end of the first connecting section 618 away from the first radiating section 615. Another end of the second connecting section 619 extends along a direction parallel to the first radiating section 615 towards the second radiating section 616. The extension continues until the second connecting section 619 is collinear with an end of the third radiating section 617.

One end of the third feed source 62 is electrically connected to the first radiator 61 through a matching circuit (not shown), for example, the first connecting section 618 of the first radiator 61. Another end of the third feed source 62 is electrically connected to the isolating portion 63 to feed current to the second radiating portion 611 and the third radiating portion 612, and generates different working modes, for example, a WIFI 2.4 GHz mode and a WIFI 5 GHz mode.

In this exemplary embodiment, since a frequency band of the second feed source 54 approaches a frequency band of the third feed source 62, there can be interference with each other. The isolating portion 63 can extend a current path of the second feed source 54 and a current path of the third feed source 62, thereby improving isolation between the short portion T2 and the first radiator 61.

In this exemplary embodiment, the isolating portion 63 can be any shape and/or size. The isolating portion 63 can also be a planar metallic sheet or a metallic housing and only to ensure that the isolating portion 63 can extend a current path of the second feed source 54 and the third feed source 62, thereby improving isolation between the short portion T2 and the first radiator 61. For example, in this exemplary embodiment, the isolating portion 63 can be a block-shaped structure. The isolating portion 63 is positioned on the backboard 512 and extends from the second side portion 517 towards the first side portion 516. In other exemplary embodiments, the isolating portion 63 can also be positioned on the middle frame.

The second radiator 64 is positioned in the receiving space 514 and adjacent to the long portion T1. The second radiator 64 is spaced apart from the backboard 512. In this exemplary embodiment, the second radiator 64 is substantially a strip and is parallel to the end portion 515. The second radiator 64 is connected to the position of the front frame 511 adjacent to the first feed source 53 and extends along a direction towards the second side portion 517. The fourth feed source 65 is positioned at the front frame 511. The fourth feed source 65 is electrically connected to the second radiator 64 and supplies current to the second radiator 64.

In this exemplary embodiment, when the antenna structure 500*a* works at the low frequency operation mode, a current path distribution graph of the antenna structure 500*a* is consistent with the current path distribution graph of the antenna structure 500 shown in FIG. 37.

Figure 44:
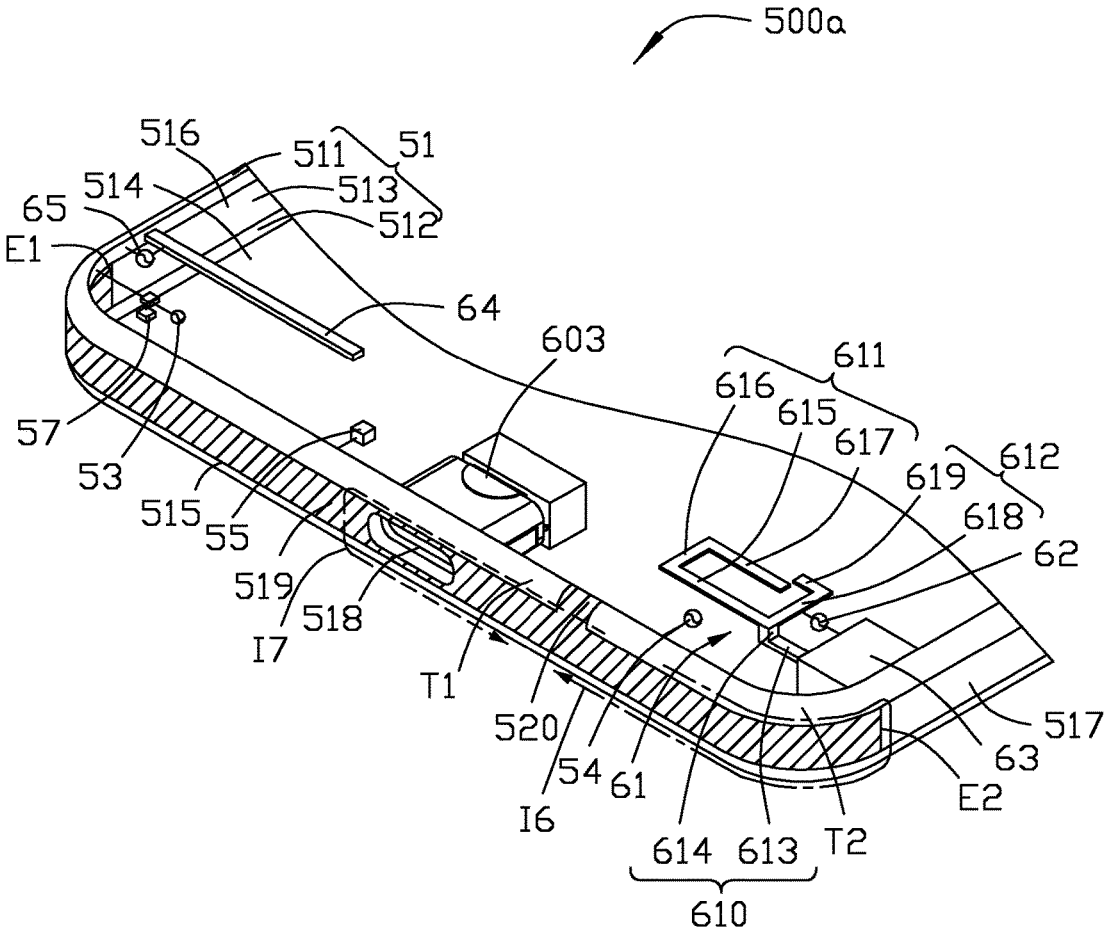
FIG. 44 is a current path distribution graph when the antenna structure of FIG. 43 works at a frequency band of about 1710-2400 MHz.

Per FIG. 44, when the current enters the short portion T2 from the second feed source 54, the current flows to the front frame 511, the second side portion 517, and the backboard 512 (e.g., path I6) to activate a second mode, to generate radiation signals in a second frequency band. When the current enters the short portion T2 from the second feed source 54, the current is coupled to the long portion T1 through the gap 520, flows through the resonance circuit 58 of the first switching circuit 55, and flows to the backboard 512 (e.g., path I7). Then, through a coupling of the gap 520 and a configuration of the resonance circuit 58, the short portion T2 further activates a third mode to generate radiation signals in a third frequency band. In this exemplary embodiment, the second mode is a middle frequency operation mode. The second frequency band is a frequency band of about 1710-2170 MHz. The third mode is a high frequency operation mode. The third frequency band is a frequency band of about 2300-2400 MHz (LTE-A band 40).

Figure 45:
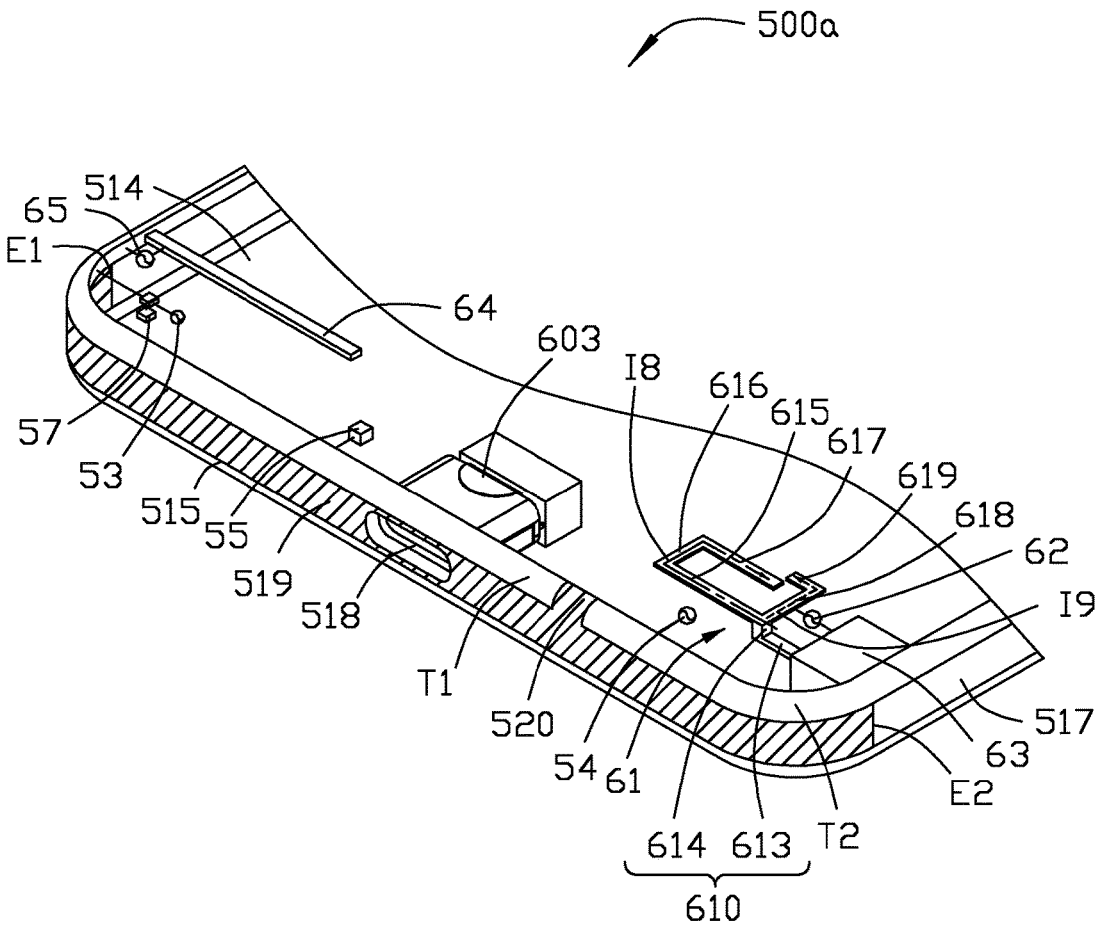
FIG. 45 is a current path distribution graph when the antenna structure of FIG. 43 works at a dual-band WIFI mode.

Per FIG. 45, when the current enters the first radiator 61 from the third feed source 62, the current flows to the first radiating section 615, the second radiating section 616, and the third radiating section 617 (e.g., path I8) to activate a fourth mode to generate radiation signals in a fourth frequency band. In this exemplary embodiment, the fourth mode is a WIFI 2.4 GHz mode.

When the current enters the first radiator 61 from the third feed source 62, the current flows to the first connecting section 618 and the second connecting section 619 (e.g, path I9) to activate a fifth mode to generate radiation signals in a fifth frequency band. In this exemplary embodiment, the fifth mode is a WIFI 5 GHz mode.

Figure 46:
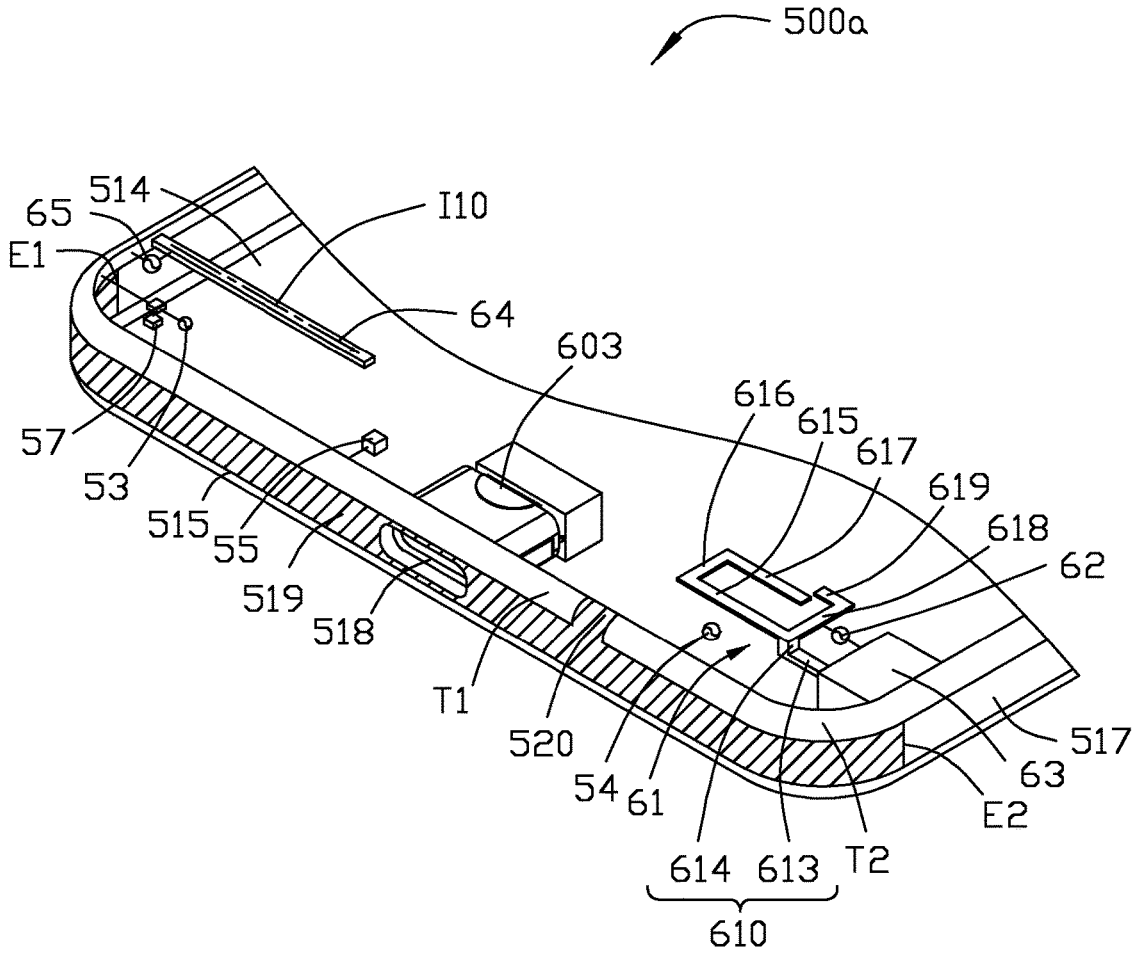
FIG. 46 is a current path distribution graph when the antenna structure of FIG. 43 works at a frequency band of about 2496-2690 MHz.

Per FIG. 46, when the current enters the second radiator 64 from the fourth feed source 65, the current flows to the end of the second radiator 64 away from the fourth feed source 65 (e.g., path I10) to activate a sixth mode to generate radiation signals in a sixth frequency band. In this exemplary embodiment, the sixth mode is a high frequency operation mode. The sixth frequency band is a frequency band of about 2496-2690 MHz.

In this exemplary embodiment, when the antenna structure 500*a* works at the low frequency operation mode, a scattering parameter graph and a radiating efficiency graph of the antenna structure 500*a* are consistent with the scattering parameter graph and a radiating efficiency graph of the antenna structure 500 shown in FIG. 39 and FIG. 40.

Figure 47:
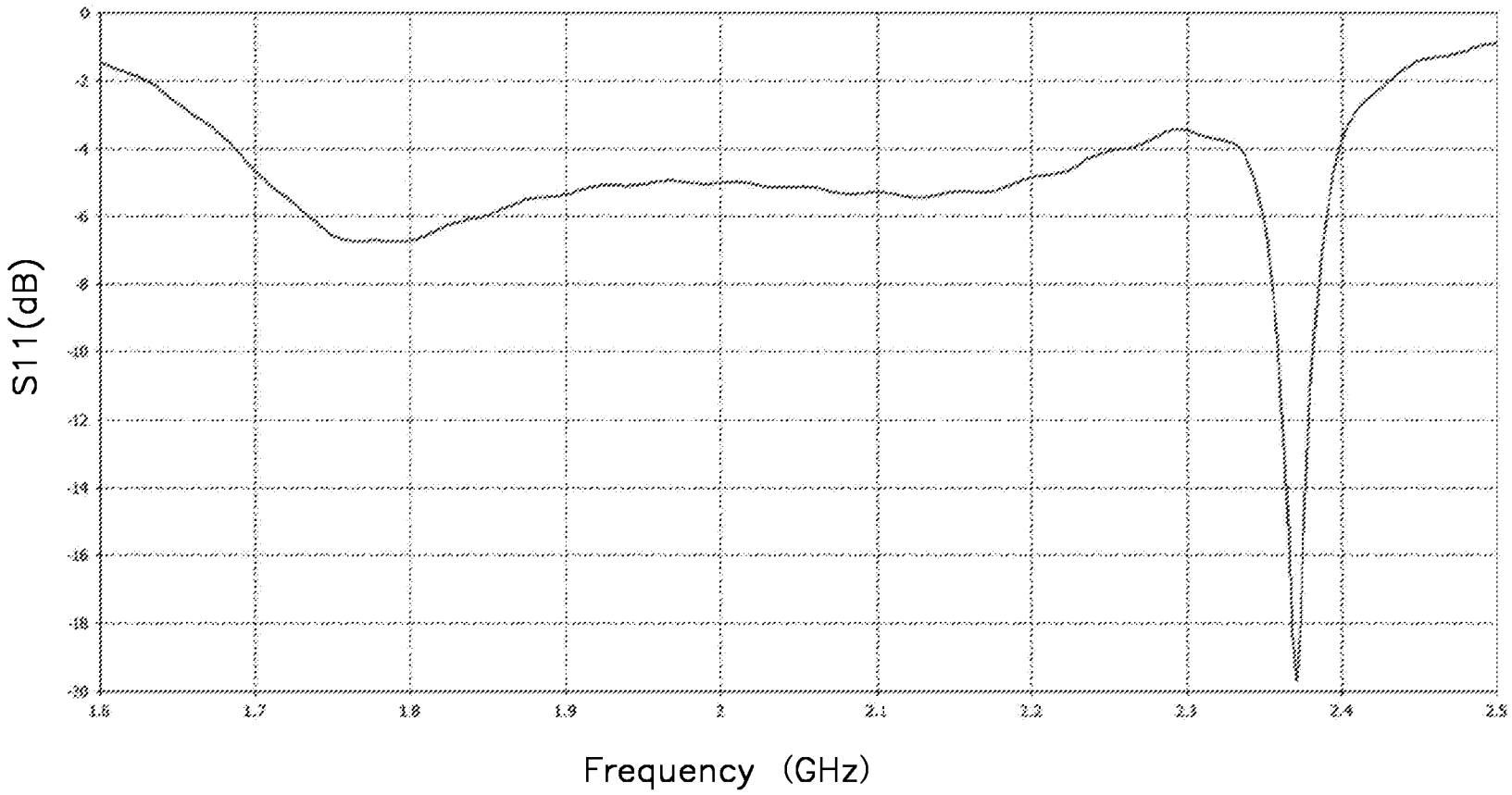
FIG. 47 is a scattering parameter graph when the antenna structure of FIG. 43 works at a frequency band of about 1710-2400 MHz.
Figure 48:
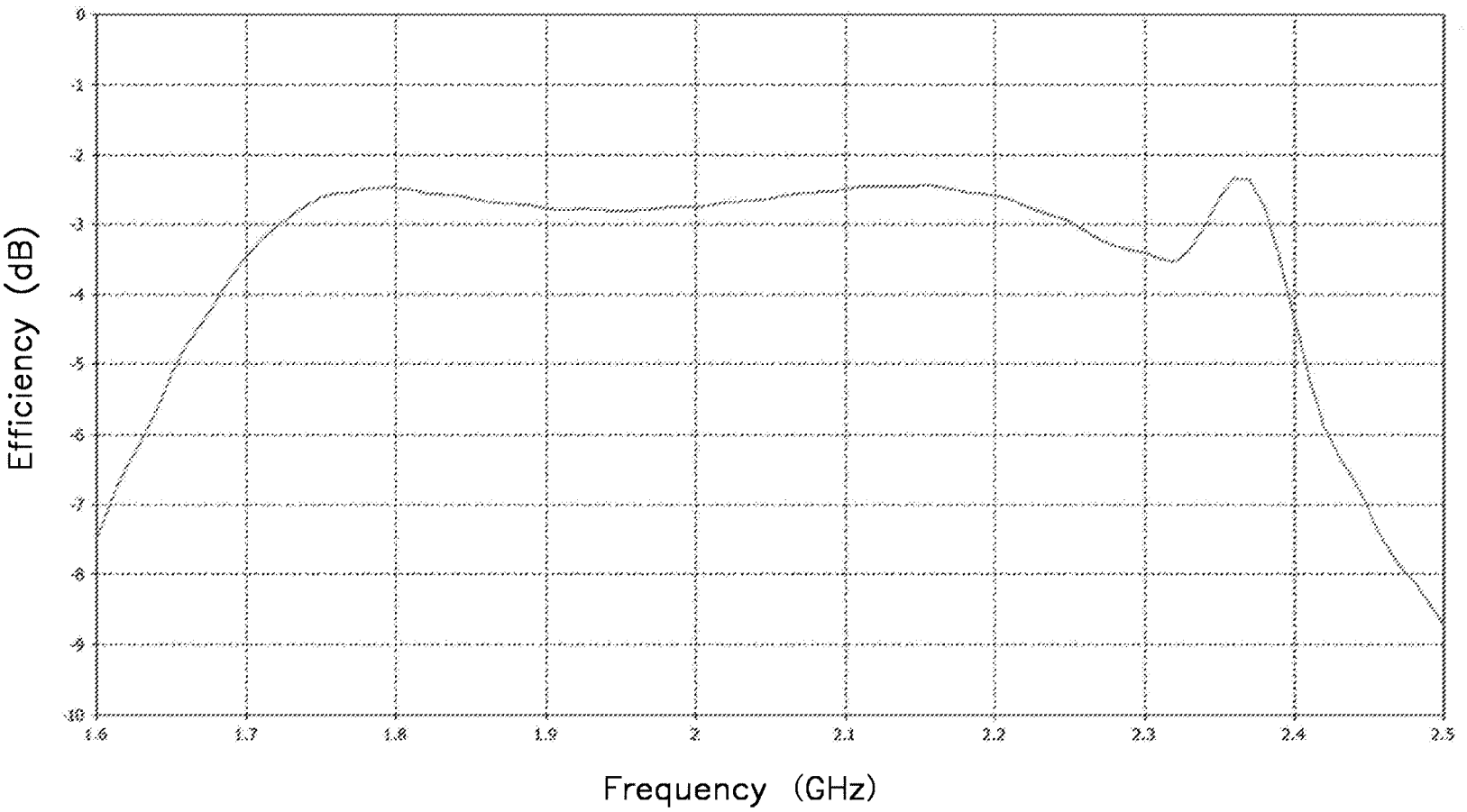
FIG. 48 is a radiating efficiency graph when the antenna structure of FIG. 43 works at a frequency band of about 1710-2400 MHz.

FIG. 47 illustrates a scattering parameter graph of the antenna structure 500*a*, when the antenna structure 500*a* works at frequency bands of about 1710-2170 MHz and 2300-2400 MHz (a LTE-A middle frequency band and LTE-A band 40). FIG. 48 illustrates a radiating efficiency graph of the antenna structure 500*a*, when the antenna structure 500*a* works at frequency bands of about 1710-2170 MHz and 2300-2400 MHz (a LTE-A middle frequency band and LTE-A band 40).

Figure 49:
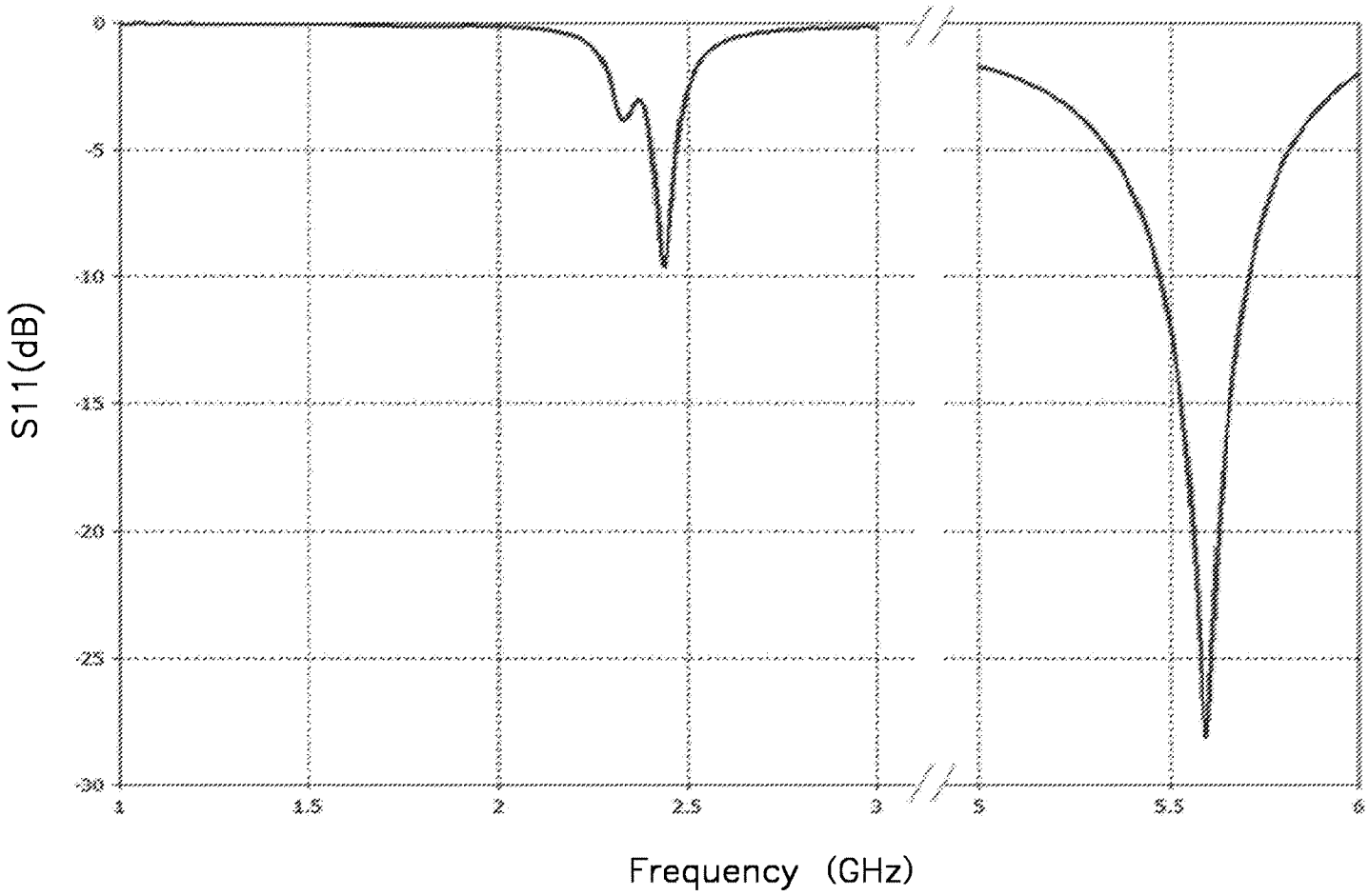
FIG. 49 is a scattering parameter graph when the antenna structure of FIG. 43 works at a WIFI 2.4 GHz mode and a WIFI 5 GHz mode.
Figure 50:
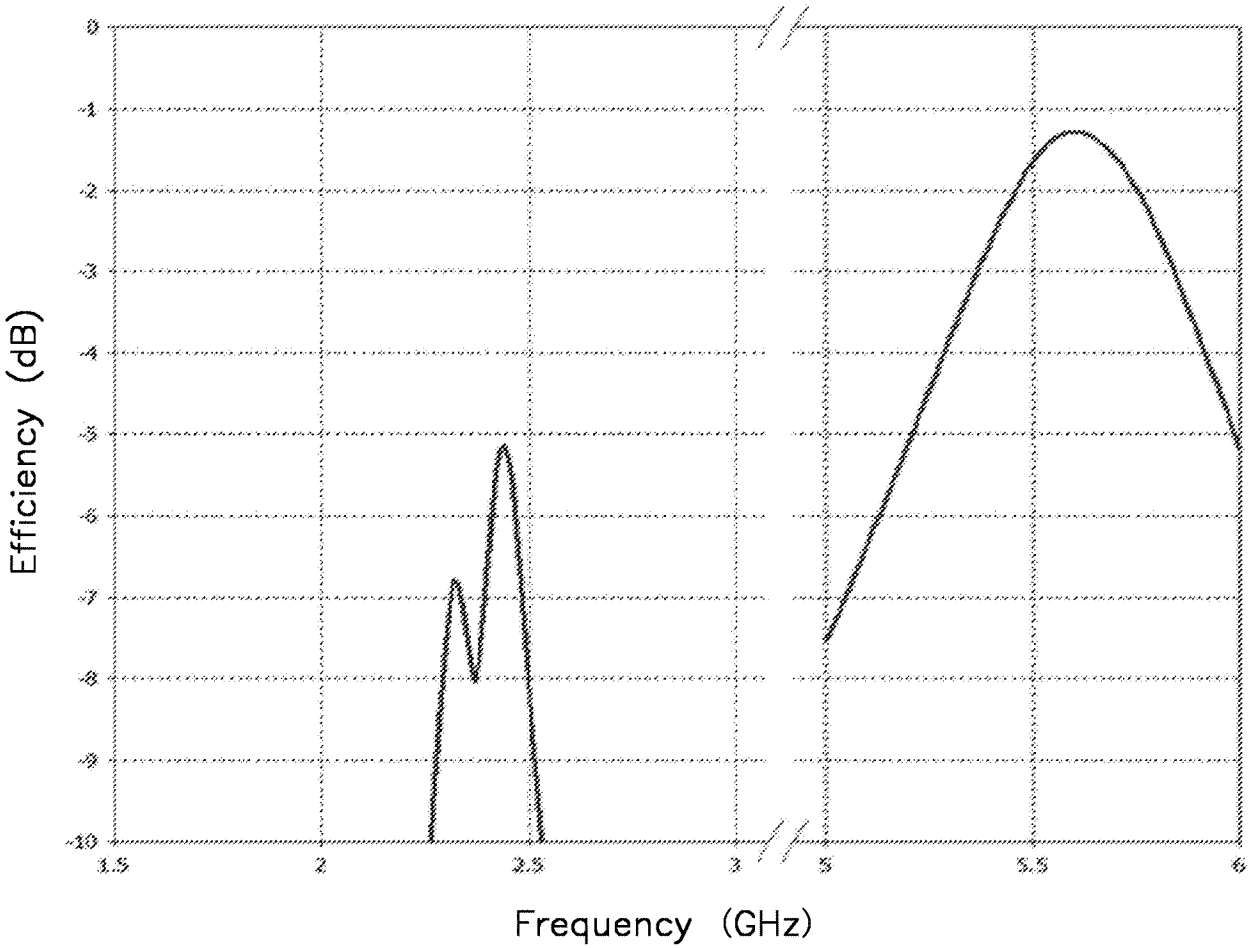
FIG. 50 is a radiating efficiency graph when the antenna structure of FIG. 43 works at a WIFI 2.4 GHz mode and a WIFI 5 GHz mode.

FIG. 49 illustrates a scattering parameter graph of the antenna structure 500*a*, when the antenna structure 500*a* works at WIFI 2.4 GHz mode and WIFI 5 GHz mode. FIG. 50 illustrates a radiating efficiency graph of the antenna structure 500*a*, when the antenna structure 500*a* works at WIFI 2.4 GHz mode and WIFI 5 GHz mode.

Figure 51:
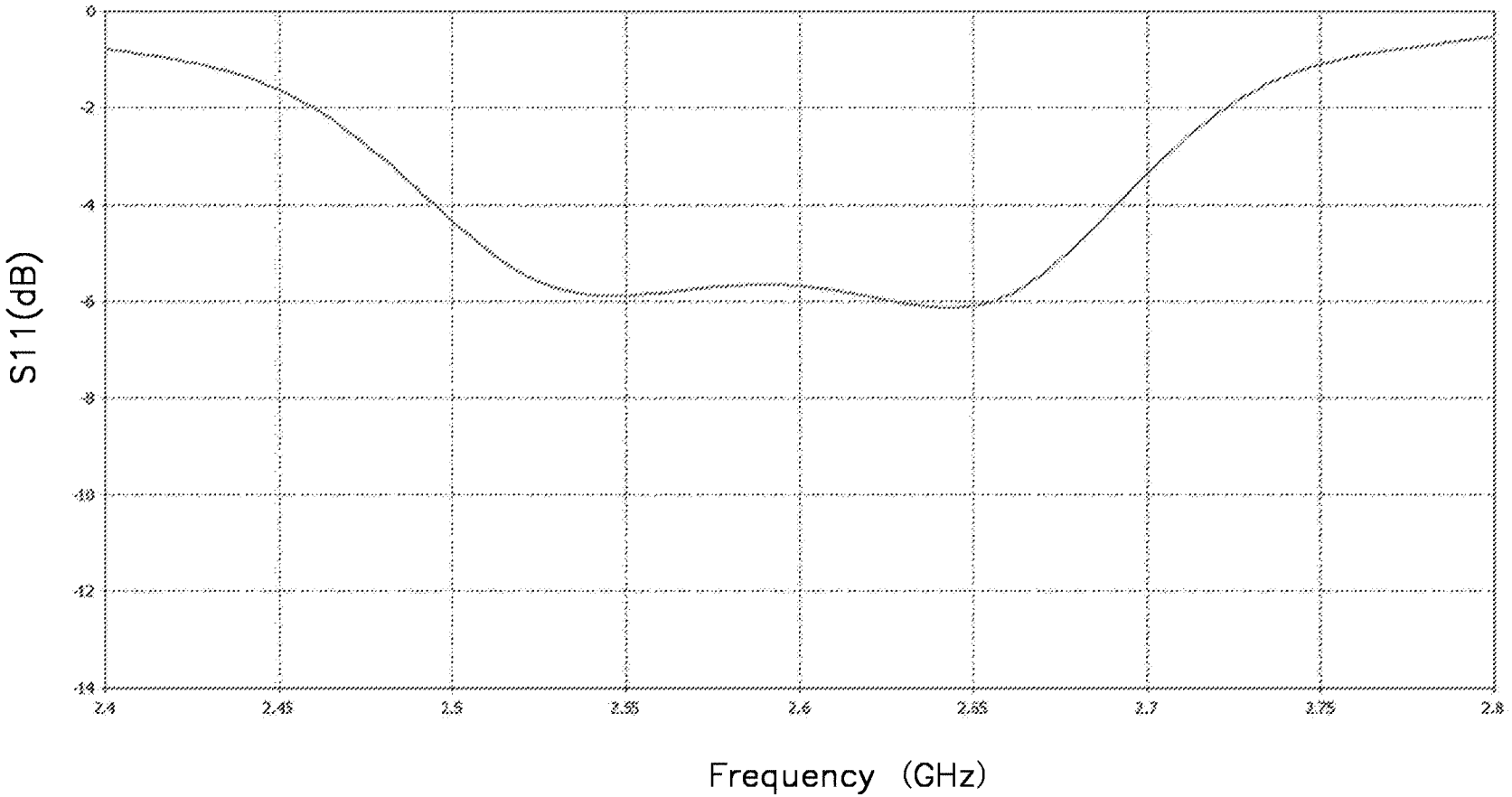
FIG. 51 is a scattering parameter graph when the antenna structure of FIG. 43 works at a frequency band of about 2496-2690 MHz.
Figure 52:
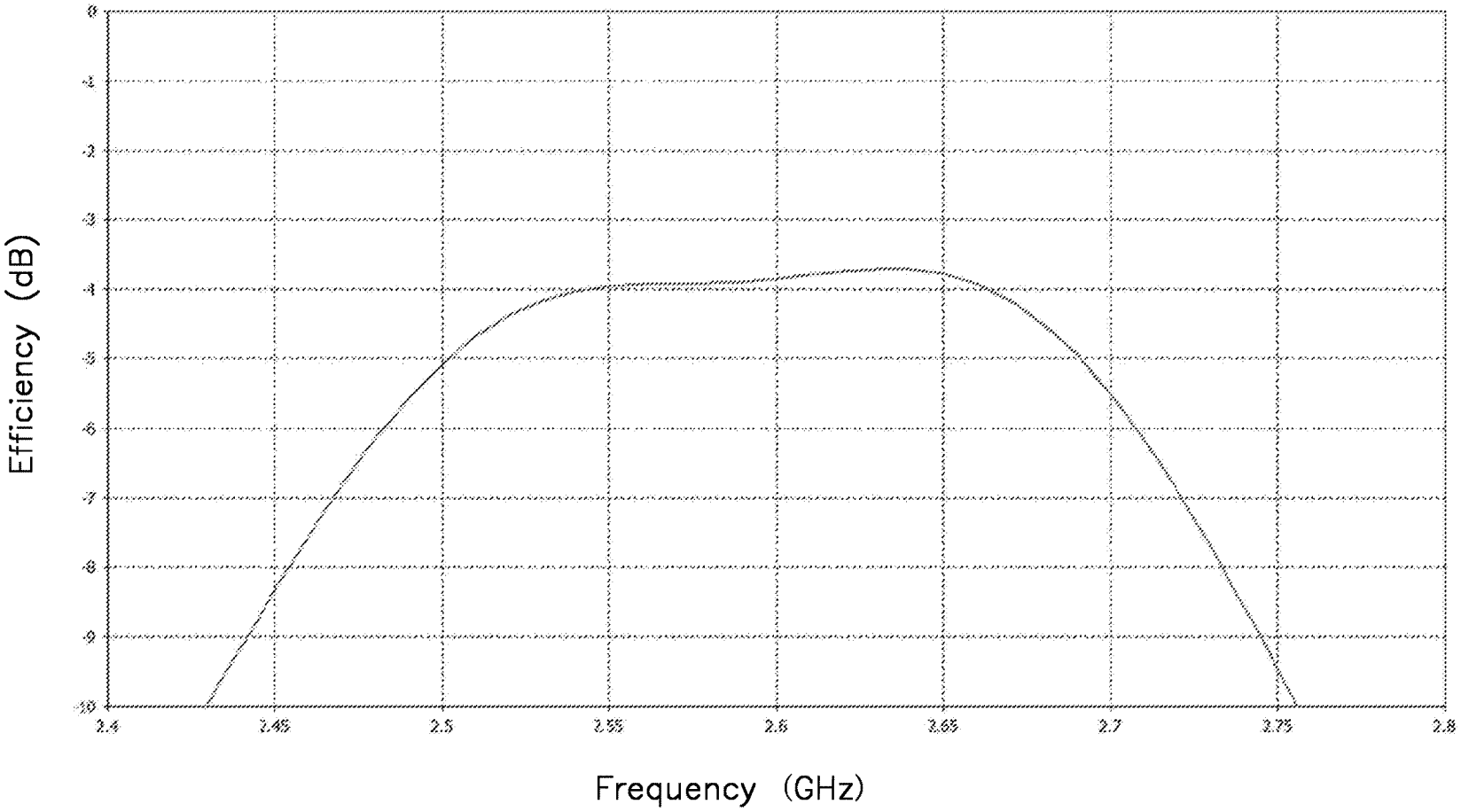
FIG. 52 is a radiating efficiency graph when the antenna structure of FIG. 43 works at a frequency band of about 2496-2690 MHz.

FIG. 51 illustrates a scattering parameter graph of the antenna structure 500*a*, when the antenna structure 500*a* works at LTE-A Band 41 mode (2496-2690 MHz). FIG. 52 illustrates a radiating efficiency graph of the antenna structure 500*a*, when the antenna structure 500*a* works at LTE-A Band 41 mode (2496-2690 MHz).

In view of FIGS. 39 to 40 and FIGS. 47 to 52, the antenna structure 500*a* can work at a low frequency band, for example, frequency bands of about 704-746 MHz, 746-787 MHz, 824-894 MHz, and 880-960 MHz. The antenna structure 500*a* can also work at the middle frequency band (1710-2170 MHz), the high frequency band (2300-2400 MHz and 2496-2690 MHz), and the WIFI 2.4/5G dual-frequency bands. That is, the antenna structure 500*a* can work at the low frequency band, the middle frequency band, the high frequency band, and the WIFI 2.4/5G dual-frequency bands, and when the antenna structure 500*a* works at these frequency bands, a working frequency satisfies a design of the antenna and also has a good radiating efficiency.

Figure 53:
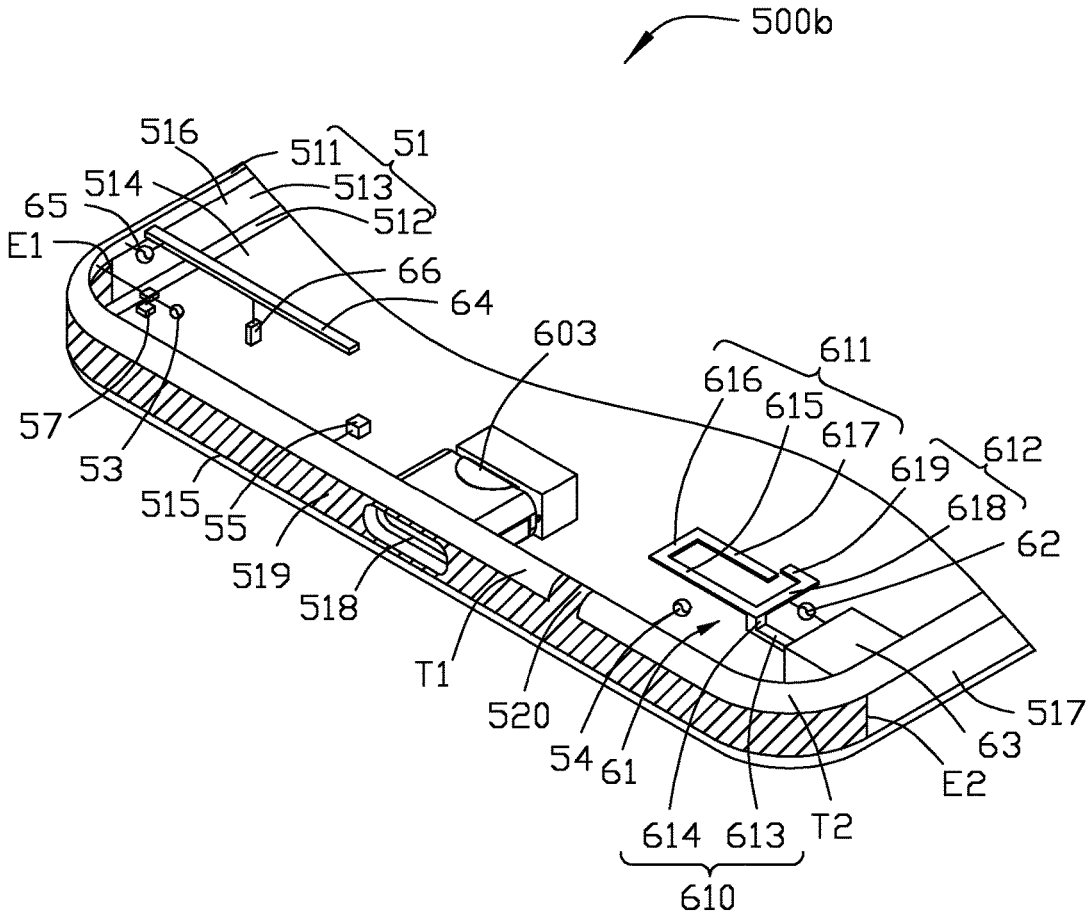
FIG. 53 is an isometric view of a fifth exemplary embodiment of a wireless communication device using a fifth exemplary antenna structure.

FIG. 53 illustrates a fifth exemplary antenna structure 500*b*. The antenna structure 500*b* includes a housing 51, a first feed source 53, a second feed source 54, a first switching circuit 55, a second switching circuit 57, a first radiator 61, a third feed source 62, an isolating portion 63, a second radiator 64, and a fourth feed source 65. The housing 51 includes a front frame 511, a backboard 512, and a side frame 513. The side frame 513 includes an end portion 515, a first side portion 516, and a second side portion 517. The side frame 513 defines a slot 519. The front frame 511 defines a gap 520. The front frame 511 is divided into two portions by the gap 520. The two portions include a long portion T1 and a short portion T2.

In this exemplary embodiment, the antenna structure 500*b* differs from the antenna structure 500*a* in that the antenna structure 500*b* further includes a third switching circuit 66. One end of the third switching circuit 66 is electrically connected to the second radiator 64 and another end of the third switching circuit 66 is electrically connected to the backboard 512. The third switching circuit 66 is configured to adjust a frequency band of the high frequency operation mode of the second radiator 64. A circuit structure and a working principle of the third switching circuit 66 are consistent with the first switching circuit 55 shown in FIG. 55.

In this exemplary embodiment, when the antenna structure 500*b* works at the low frequency operation mode, a current path distribution graph of the antenna structure 500*b* is consistent with the current path distribution graph of the antenna structure 500 shown in FIG. 37.

Figure 54:
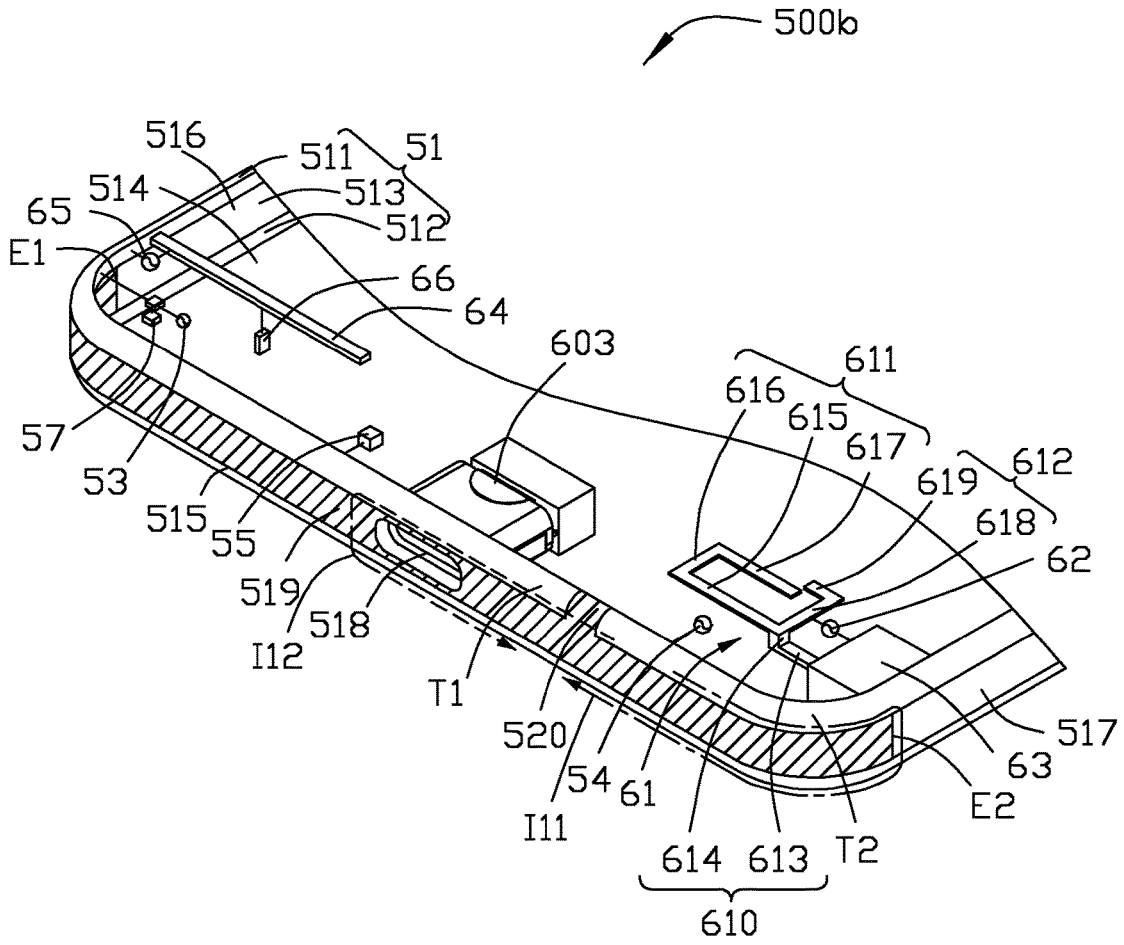
FIG. 54 is a current path distribution graph when the antenna structure of FIG. 53 works at a frequency band of about 1710-2170 MHz.

Per FIG. 54, when the current enters the short portion T2 from the second feed source 54, the current flows to the front frame 511, the second side portion 517, and the backboard 512 (e.g., path I11) to activate a second mode to generate radiation signals in a second frequency band. When the current enters the short portion T2 from the second feed source 54, the current is coupled to the long portion T1 through the gap 520, flows through the resonance circuit 58 of the first switching circuit 55, and flows to the backboard 512 (e.g., path I12). Then, through a coupling of the gap 520 and a configuration of the resonance circuit 58, the short portion T2 further activate a third mode to generate radiation signals in a third frequency band. In this exemplary embodiment, the second mode is a middle frequency operation mode. The second frequency band is a frequency band of about 1710-1990 MHz. The third mode is a high frequency operation mode. The third frequency band is a frequency band of about 2110-2170 MHz.

In this exemplary embodiment, when the antenna structure 500*b* works at the WIFI 2.4 GHz mode and the WIFI 5 GHz mode, a current path distribution graph of the antenna structure 500*b* is consistent with the current path distribution graph of the antenna structure 500*a* shown in FIG. 45.

Figure 55:
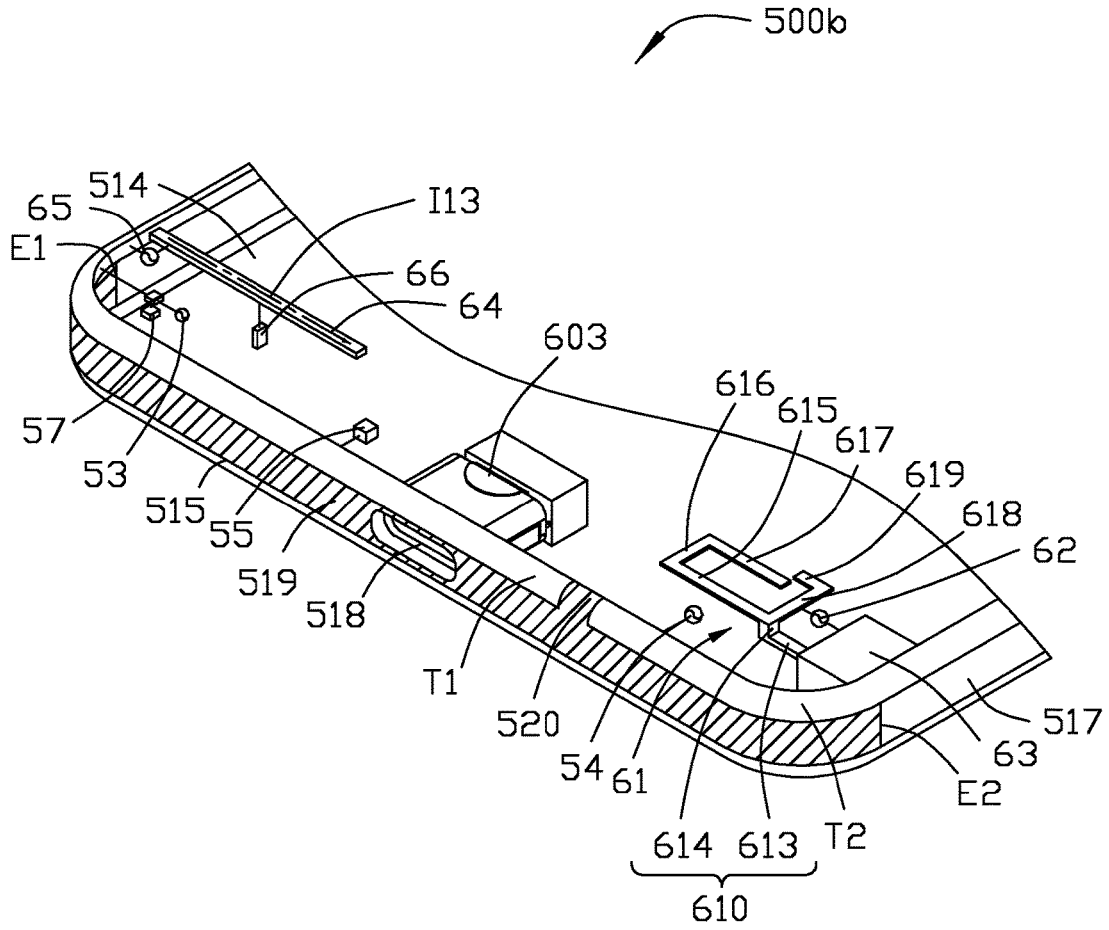
FIG. 55 is a current path distribution graph when the antenna structure of FIG. 53 works at frequency bands of about 2300-2400 MHz and 2496-2690 MHz.

Per FIG. 55, when the current enters the second radiator 64 from the fourth feed source 65, the current flows to the end of the second radiator 64 away from the fourth feed source 65 (e.g., path I13) to activate a sixth mode to generate radiation signals in a sixth frequency band. In this exemplary embodiment, the sixth mode is a high frequency operation mode. Since the antenna structure 500*b* includes the third switching circuit 66, the high frequency operation mode of the antenna structure 500*b* can be switched through the third switching circuit 66. For example, the antenna structure 500*b* can be switched to a frequency band of about 2300-2400 MHz and/or a frequency band of about 2496-2690 MHz (LTE-A Band 41), and the high frequency operation mode, the middle frequency operation mode, and LTE-A Band 40 mode can be activated and can operate simultaneously.

In this exemplary embodiment, when the antenna structure 500*b* works at the low frequency operation mode, a scattering parameter graph and a radiating efficiency graph of the antenna structure 500*b* are consistent with the scattering parameter graph and a radiating efficiency graph of the antenna structure 500 shown in FIG. 39 and FIG. 40.

Figure 56:
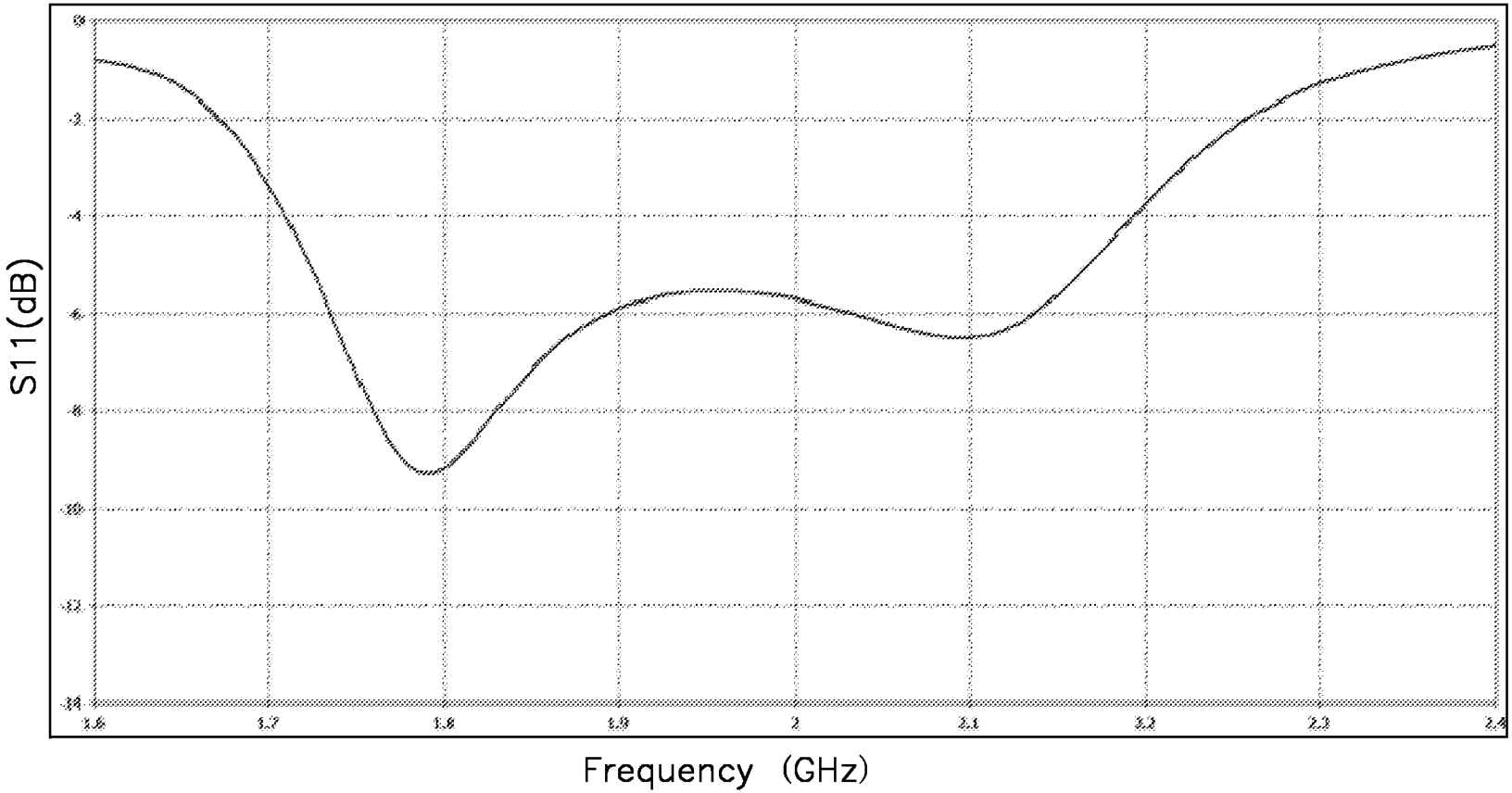
FIG. 56 is a scattering parameter graph when the antenna structure of FIG. 53 works at a frequency band of about 1710-2170 MHz.
Figure 57:
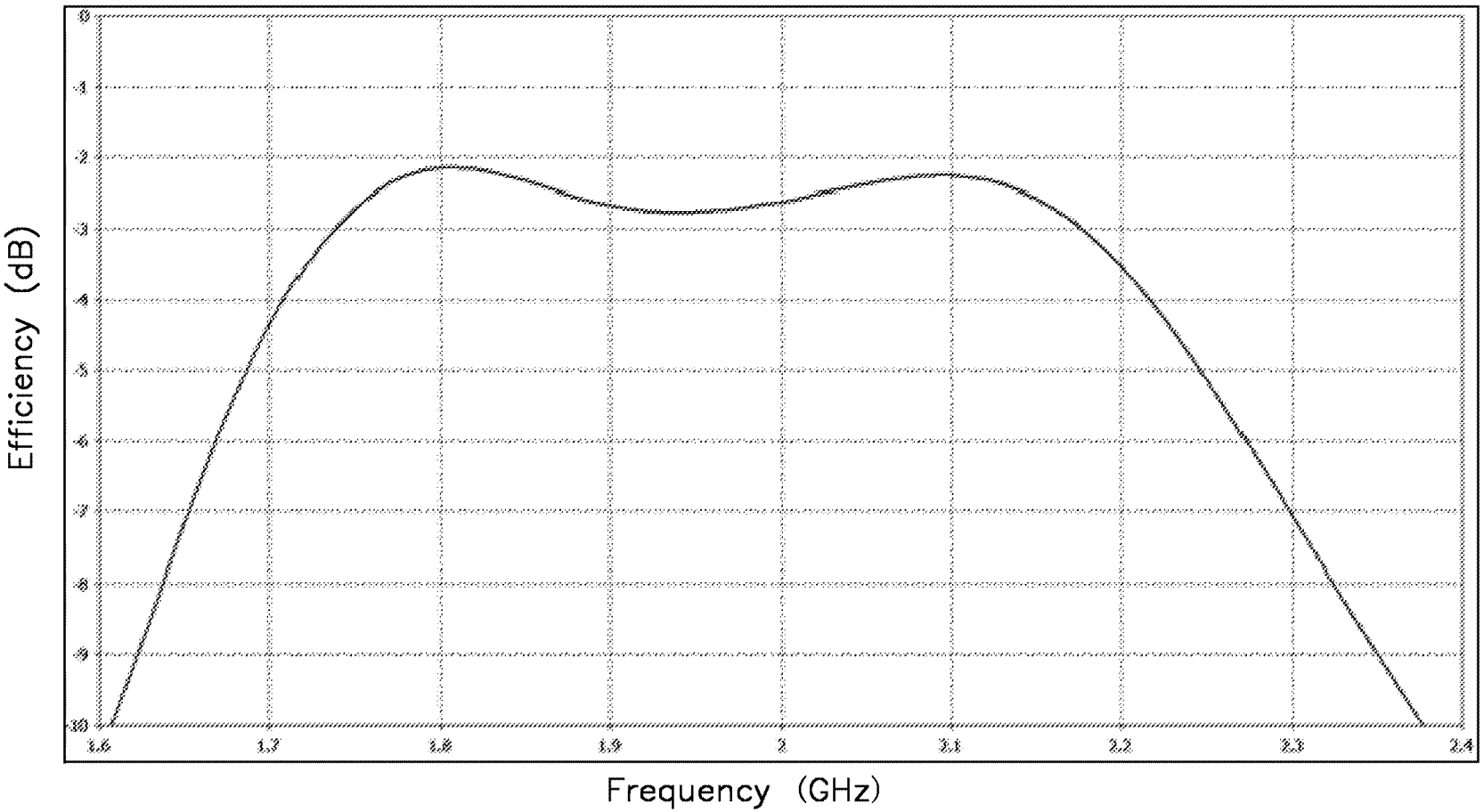
FIG. 57 is a radiating efficiency graph when the antenna structure of FIG. 53 works at a frequency band of about 1710-2170 MHz.

FIG. 56 illustrates a scattering parameter graph of the antenna structure 500*b*, when the antenna structure 500*b* works at a frequency band of about 1710-2170 MHz. FIG. 57 illustrates a radiating efficiency graph of the antenna structure 500*b*, when the antenna structure 500*b* works at a frequency band of about 1710-2170 MHz.

In this exemplary embodiment, when the antenna structure 500*b* works at the WIFI 2.4 GHz mode and the WIFI 5 GHz mode, a scattering parameter graph and a radiating efficiency graph of the antenna structure 500*b* are consistent with the scattering parameter graph and a radiating efficiency graph of the antenna structure 500*a* shown in FIG. 49 and FIG. 50.

Figure 58:
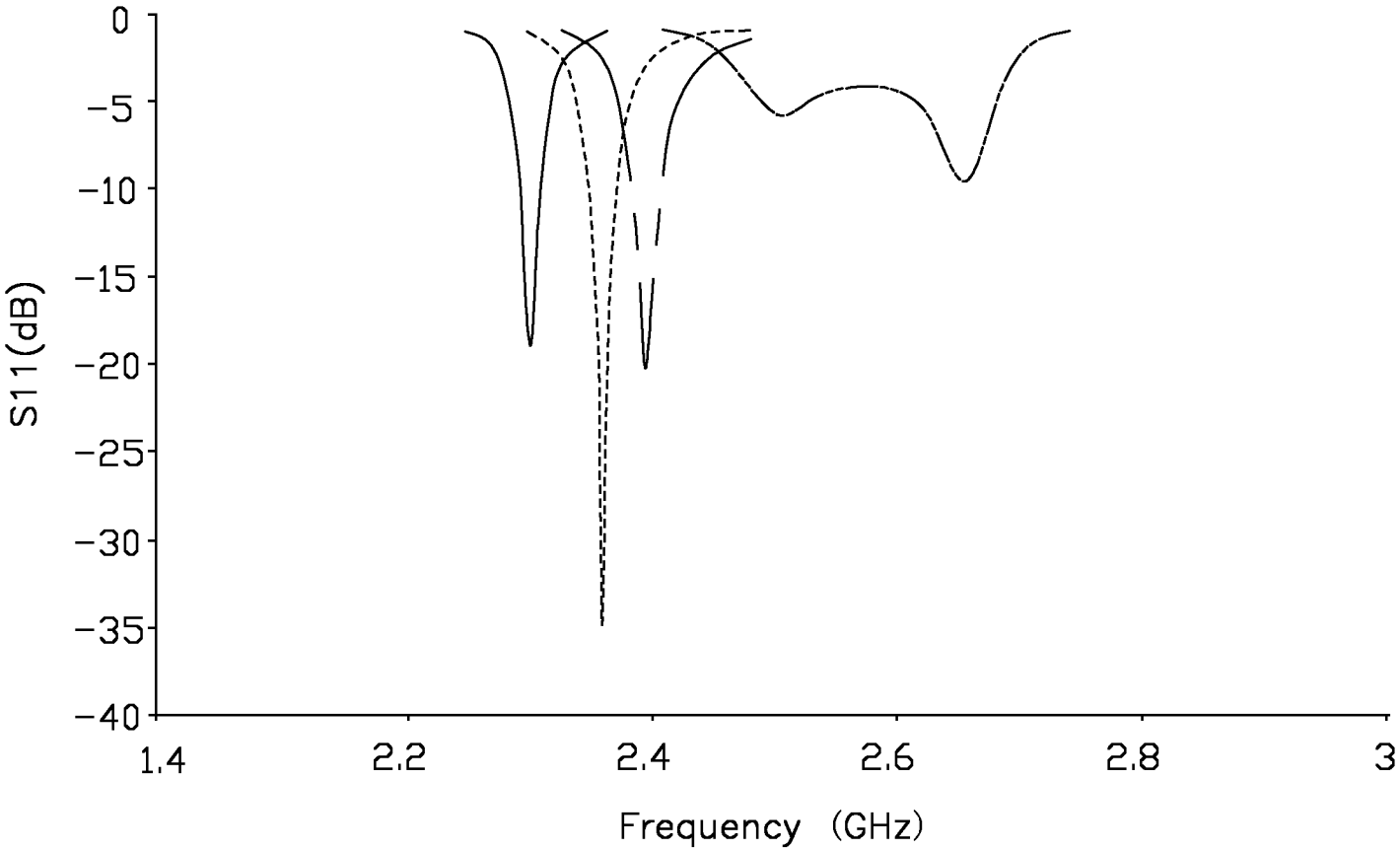
FIG. 58 is a scattering parameter graph when the antenna structure of FIG. 53 works at frequency bands of about 2300-2400 MHz and 2496-2690 MHz.
Figure 59:
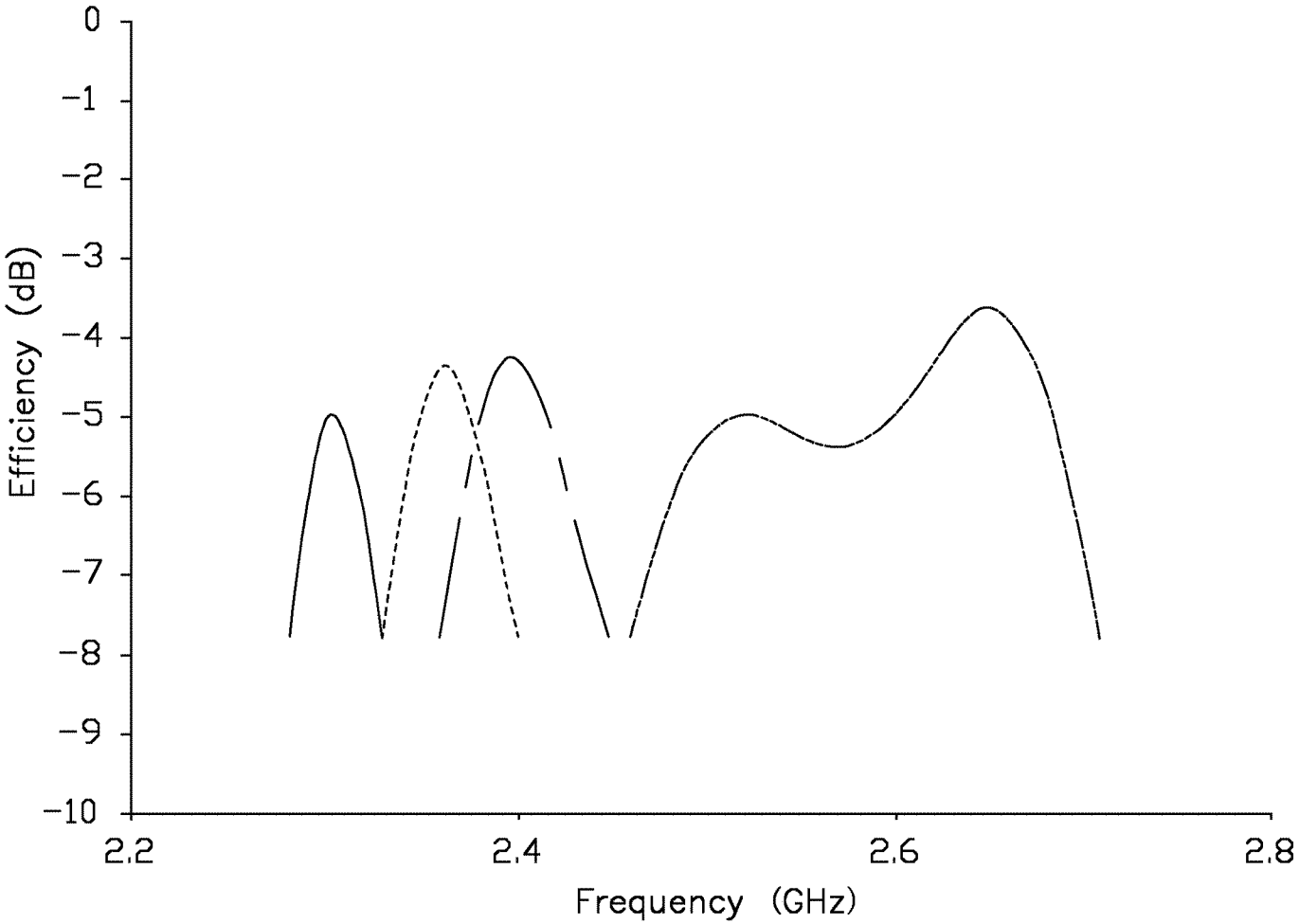
FIG. 59 is a radiating efficiency graph when the antenna structure of FIG. 53 works at frequency bands of about 2300-2400 MHz and 2496-2690 MHz.

FIG. 58 illustrates a scattering parameter graph of the antenna structure 500*b*, when the antenna structure 500*b* works at frequency bands of about 2300-2400 MHz and 2496-2690 MHz. FIG. 59 illustrates a radiating efficiency graph of the antenna structure 500*b*, when the antenna structure 500*b* works at frequency bands of about 2300-2400 MHz and 2496-2690 MHz.

As described above, the long portion T1 can activate a first mode to generate radiation signals in a low frequency band, the short portion T2 can activate a second mode and a third mode to generate radiation signals in a middle frequency band and a high frequency band. The second radiator 64 can activate a sixth mode to generate radiation signals in a high frequency band. The wireless communication device 600 can use carrier aggregation (CA) technology of LTE-A to receive and/or transmit wireless signals at multiple frequency bands simultaneously. In detail, the wireless communication device 600 can use the CA technology and use at least two of the long portion T1, the short portion T2, and the second radiator 64 to receive and/or transmit wireless signals at multiple frequency bands simultaneously.

In other exemplary embodiments, a location of the first radiator 61 can be exchanged with a location of the second radiator 64 and the third switching circuit 66, and a location of the isolating portion 63 is fixed and keeps unchanged. The first radiator 61 is positioned in the receiving space 514 and is symmetric with the second radiator 30 shown in FIG. 17. The first radiator 61 is positioned adjacent to the long portion T1. The end of the first radiating arm 613 of the first radiator 61 connecting to the isolating portion 63 is changed to be electrically connected to the front frame 511. The third feed source 62 is positioned on the front frame 511 and is electrically connected to the first connecting section 618 of the first radiator 61.

The second radiator 61 is connected to the isolating portion 63 and extends towards the first side portion 516. One end of the fourth feed source 65 is electrically connected to the second radiator 61 through a matching circuit (not shown). Another end of the fourth feed source 65 is electrically connected to the isolating portion 63 to feed current to the second radiator 61. One end of the third switching circuit 66 is electrically connected to the second radiator 61 and another end of the third switching circuit 66 is connected to the backboard 512.

In addition, the slot 519 and the gap 520 of the housing 51 are both defined on the front frame 511 and the side frame 513 instead of the backboard 512. Then the backboard 512 forms an all-metal structure. That is, the backboard 512 does not define any other slot and/or gap and has a good structural integrity and an aesthetic quality.

Figure 60:
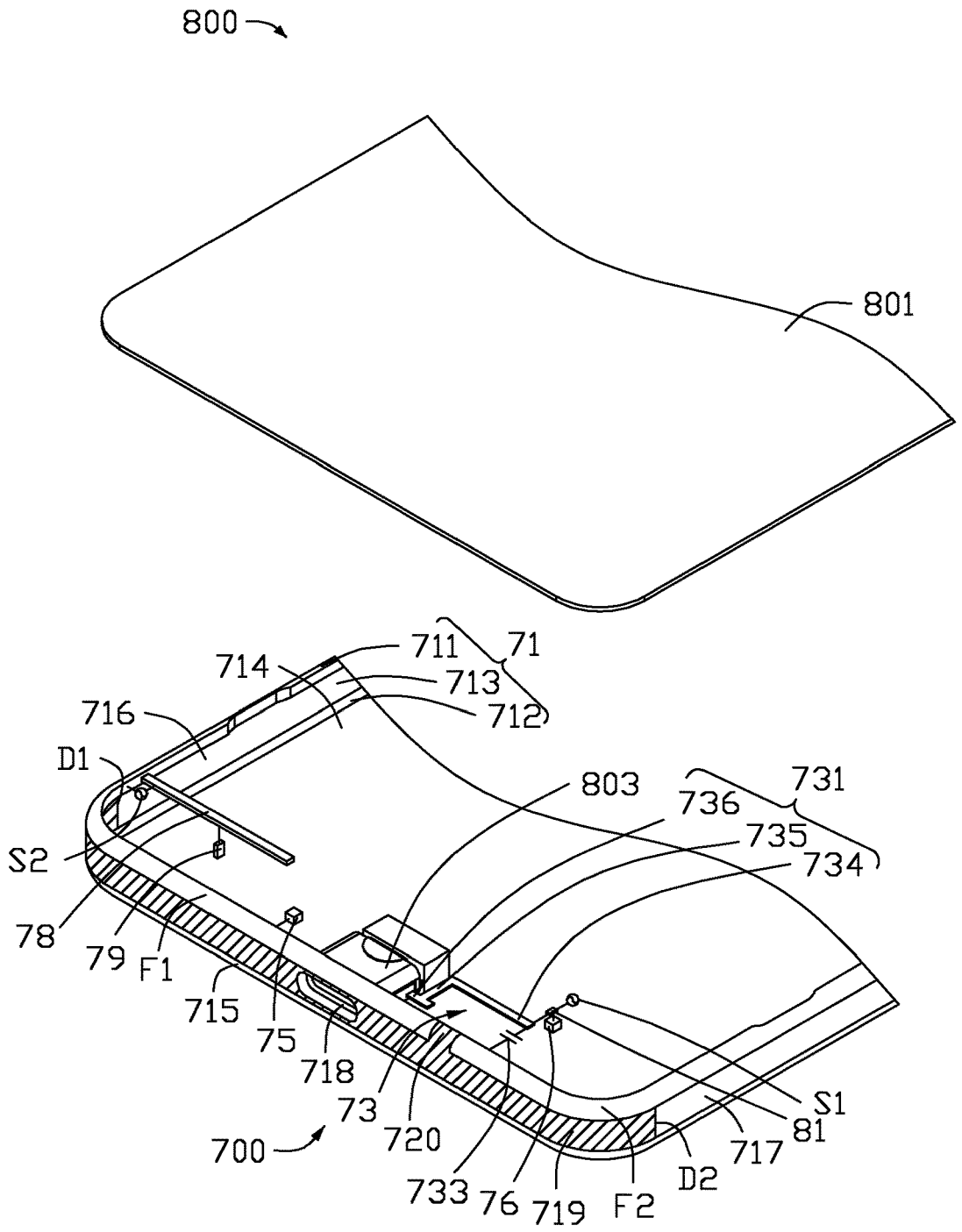
FIG. 60 is an isometric view of a sixth exemplary embodiment of a wireless communication device using a sixth exemplary antenna structure.

Exemplary Embodiments 6-7:

FIG. 60 illustrates an embodiment of a wireless communication device 800 using a sixth exemplary antenna structure 700. The wireless communication device 800 can be a mobile phone or a personal digital assistant, for example. The antenna structure 700 can receive and/or transmit wireless signals.

Figure 61:
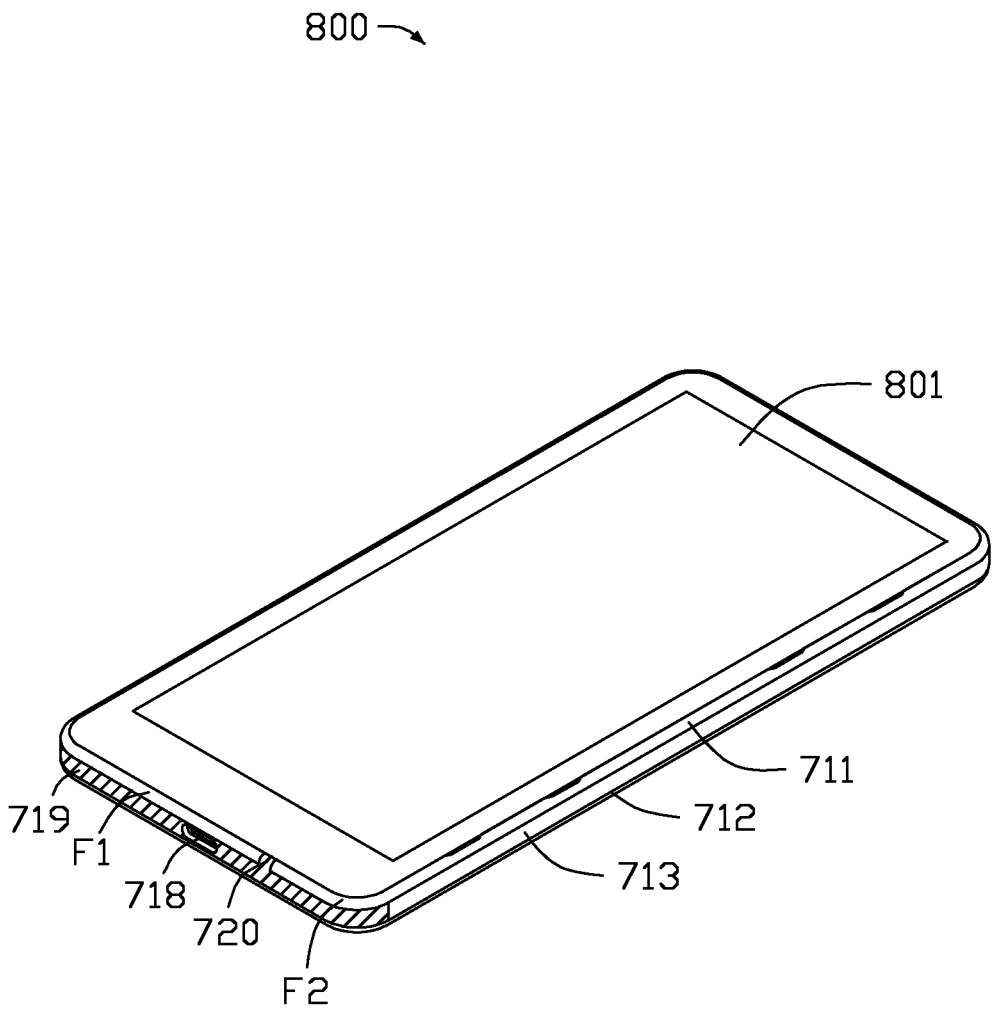
FIG. 61 is an assembled, isometric view of the wireless communication device of FIG. 60.
Figure 62:
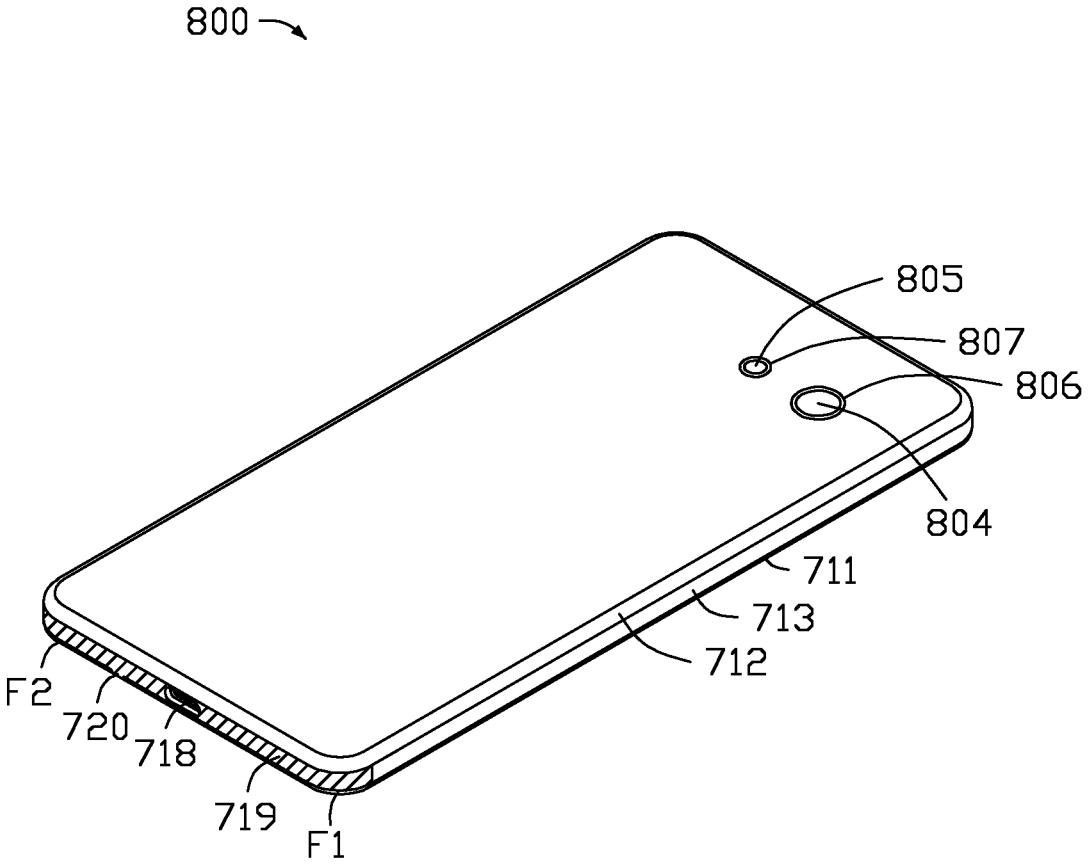
FIG. 62 is similar to FIG. 61, but shown from another angle.

Per FIG. 61 and FIG. 62, the antenna structure 700 includes a housing 71, a first feed source S1, a first radiator 73, a first switching circuit 75, a second switching circuit 76, a second radiator 78, a second feed source S2, and a third switching circuit 79. The housing 71 can be a metal housing of the wireless communication device 800. In this exemplary embodiment, the housing 71 is made of metallic material and includes a front frame 711, a backboard 712, and a side frame 713. The front frame 711, the backboard 712, and the side frame 713 can be integral with each other. The front frame 711, the backboard 712, and the side frame 713 cooperatively form the metal housing of the wireless communication device 800.

The front frame 711 defines an opening (not shown). The wireless communication device 800 includes a display 801. The display 801 is received in the opening. The display 801 has a display surface. The display surface is exposed at the opening and is positioned parallel to the backboard 712.

The backboard 712 is positioned opposite to the front frame 711. The backboard 712 is directly connected to the side frame 713 and there is no gap between the backboard 712 and the side frame 713. The backboard 712 is an integral and single metallic sheet. The backboard 712 defines holes 806, 807 for exposing a camera lens 804 and a flash light 805. The backboard 712 does not define any slot, break line, and/or gap for dividing the backboard 712. The backboard 712 serves as a ground of the antenna structure 700 and the wireless communication device 800.

In other exemplary embodiments, the wireless communication device 800 further includes a shielding mask or a middle frame (not shown). The shielding mask is positioned at the surface of the display 801 towards the backboard 712 and shields against electromagnetic interference. The middle frame is positioned at the surface of the display 801 towards the backboard 712 and is configured for supporting the display 801. The shielding mask or the middle frame is made of metallic material. The shielding mask or the middle frame can be electrically connected to the backboard 712 and serves as ground of the antenna structure 700 and the wireless communication device 800.

The side frame 713 is positioned between the front frame 711 and the backboard 712. The side frame 713 is positioned around a periphery of the front frame 711 and a periphery of the backboard 712. The side frame 713 forms a receiving space 714 together with the display 801, the front frame 711, and the backboard 712. The receiving space 714 can receive a printed circuit board, a processing unit, or other electronic components or modules.

The side frame 713 includes an end portion 715, a first side portion 716, and a second side portion 717. In this exemplary embodiment, the end portion 715 is a bottom portion of the wireless communication device 800. The end portion 715 connects the front frame 711 and the backboard 712. The first side portion 716 is positioned apart from and parallel to the second side portion 717. The end portion 715 has first and second ends. The first side portion 716 is connected to the first end of the end portion 715 and the second side portion 717 is connected to the second end of the end portion 715. The first side portion 716 connects the front frame 711 and the backboard 712. The second side portion 717 also connects the front frame 711 and the backboard 712.

The side frame 713 defines a through hole 718 and a slot 719. The front frame 711 defines a gap 720. In this exemplary embodiment, the through hole 718 is defined at a middle part of the end portion 715 and passes through the end portion 715. The wireless communication device 800 further includes an electronic element 803. In this exemplary embodiment, the electronic element 803 is a USB module. The electronic element 803 is positioned in the receiving space 714. The electronic element 803 corresponds to the through hole 718 and is partially exposed from the through hole 718. A USB device can be inserted in the through hole 718 and be electrically connected to the electronic element 803.

In this exemplary embodiment, the slot 719 is defined at the end portion 715 and communicates with the through hole 718. The slot 719 further extends to the first side portion 716 and the second side portion 717. In other exemplary embodiments, the slot 719 can only be defined at the end portion 715 and does not extend to any one of the first side portion 716 and the second side portion 717. In other exemplary embodiments, the slot 719 can be defined at the end portion 715 and extends to one of the first side portion 716 and the second side portion 717.

The gap 720 communicates with the slot 719 and extends across the front frame 711. In this exemplary embodiment, the gap 720 is positioned adjacent to the second side portion 717. The front frame 711 is divided into two portions by the gap 720, these portions being a long portion F 1 and a short portion F2 (long and short relative to each other). A first portion of the front frame 711 extending from a first side of the gap 720 to a first end D1 of the slot 719 forms the long portion F1. A second portion of the front frame 711 extending from a second side of the gap 720 to a second end D2 of the slot 719 forms the short portion F2.

In this exemplary embodiment, the gap 720 is not positioned at a middle portion of the end portion 715. The long portion F1 is longer than the short portion F2.

In this exemplary embodiment, the slot 719 and the gap 720 are both filled with insulating material, for example, plastic, rubber, glass, wood, ceramic, or the like, thereby isolating the long portion F1, the short portion F2, and the backboard 712.

In this exemplary embodiment, the slot 719 is defined on the end of the side frame 713 adjacent to the backboard 712 and extends to the front frame 711. Then the long portion F1 and the short portion F2 are fully formed by a portion of the front frame 711. In other exemplary embodiments, a position of the slot 719 can be adjusted. For example, the slot 719 is defined on the end of the side frame 713 adjacent to the backboard 712 and extends towards the front frame 711. Then the long portion F1 and the short portion F2 are formed by a portion of the front frame 711 and a portion of the side frame 713.

In this exemplary embodiment, except for the through hole 718, the slot 719, and the gap 720, a lower half portion of the front frame 711 and the side frame 713 does not define any other slot, break line, and/or gap. That is, there is only one gap 720 defined on the lower half portion of the front frame 711.

In this exemplary embodiment, the first feed source S1 is positioned in the receiving space 714 and is located between the electronic element 803 and the second side portion 717. The first feed source S1 is electrically connected to the first radiator 73 to feed current to the first radiator 73.

The first radiator 73 is positioned in the receiving space 714 and is located between the electronic element 803 and the second side portion 717. The first radiator 73 includes a first radiating portion 731 and a second radiating portion 733. One end of the first radiating portion 731 is electrically connected to the first feed source S1 through a matching circuit 81. Another end of the first radiating portion 731 is spaced apart from the long portion F1. When the first feed source S1 supplies current, the current flows through matching circuit 81 and the first radiating portion 731, and is coupled to the long portion F1. The first radiating portion 731 and the long portion F1 form a coupling structure to activate a first mode, to generate radiation signals in a first frequency band. In this exemplary embodiment, the first mode is an LTE-A low frequency operation mode. The first frequency band is a frequency band of about 704-960 MHz.

In this exemplary embodiment, the first radiating portion 731 includes a first radiating section 734, a second radiating section 735, and a third radiating section 736. The first radiating section 734 is coplanar with the second radiating section 735 and the third radiating section 736. The first radiating section 734 is substantially rectangular. The first radiating section 734 is electrically connected to the first feed source Si through the matching circuit 81, and extends along a direction parallel to the end portion 715 towards the electronic element 803 until the first radiating section 734 passes over the gap 720.

The second radiating section 735 is substantially rectangular. One end of the second radiating section 735 is perpendicularly connected to the end of the first radiating section 734 away from the first feed source S1. Another end of the second radiating section 735 extends along a direction parallel to the second side portion 717 towards the long portion F1 and forms an L-shaped structure with the first radiating section 734. The third radiating section 736 is substantially rectangular. The third radiating section 736 is spaced apart from and parallel to the long portion F1. The third radiating section 736 is perpendicularly connected to the end of the second radiating section 735 away from the first radiating section 734. The third radiating section 736 further extends along two directions, that is, towards the first side portion 716 and towards the second side portion 717 respectively, to form a T-shaped structure with the second radiating section 735.

In this exemplary embodiment, the second radiating portion 733 is a capacitor. One end of the second radiating portion 733 is electrically connected to a junction of the matching circuit 81 and the first radiating section 734. Another end of the second radiating portion 733 is electrically connected to the short portion F2. Then, when the first feed source Si supplies current, the current flows through the second radiating portion 733, and flows to the short portion F2 to activate a second mode to generate radiation signals in a second frequency band. In this exemplary embodiment, the second mode is an LTE-A middle frequency operation mode. The second frequency band is a frequency band of about 1710-1990 MHz. In addition, the current from the second radiating portion 733 and the short portion F2 is further coupled to the long portion F1 through the gap 720 to activate a third mode to generate radiation signals in the third frequency band. In this exemplary embodiment, the third mode is also an LTE-A middle frequency operation mode. The third frequency band is a frequency band of about 2110-2170 MHz. Then, the second mode and the third mode cooperatively form a wide band mode (1710-2170 MHz).

Figure 63:
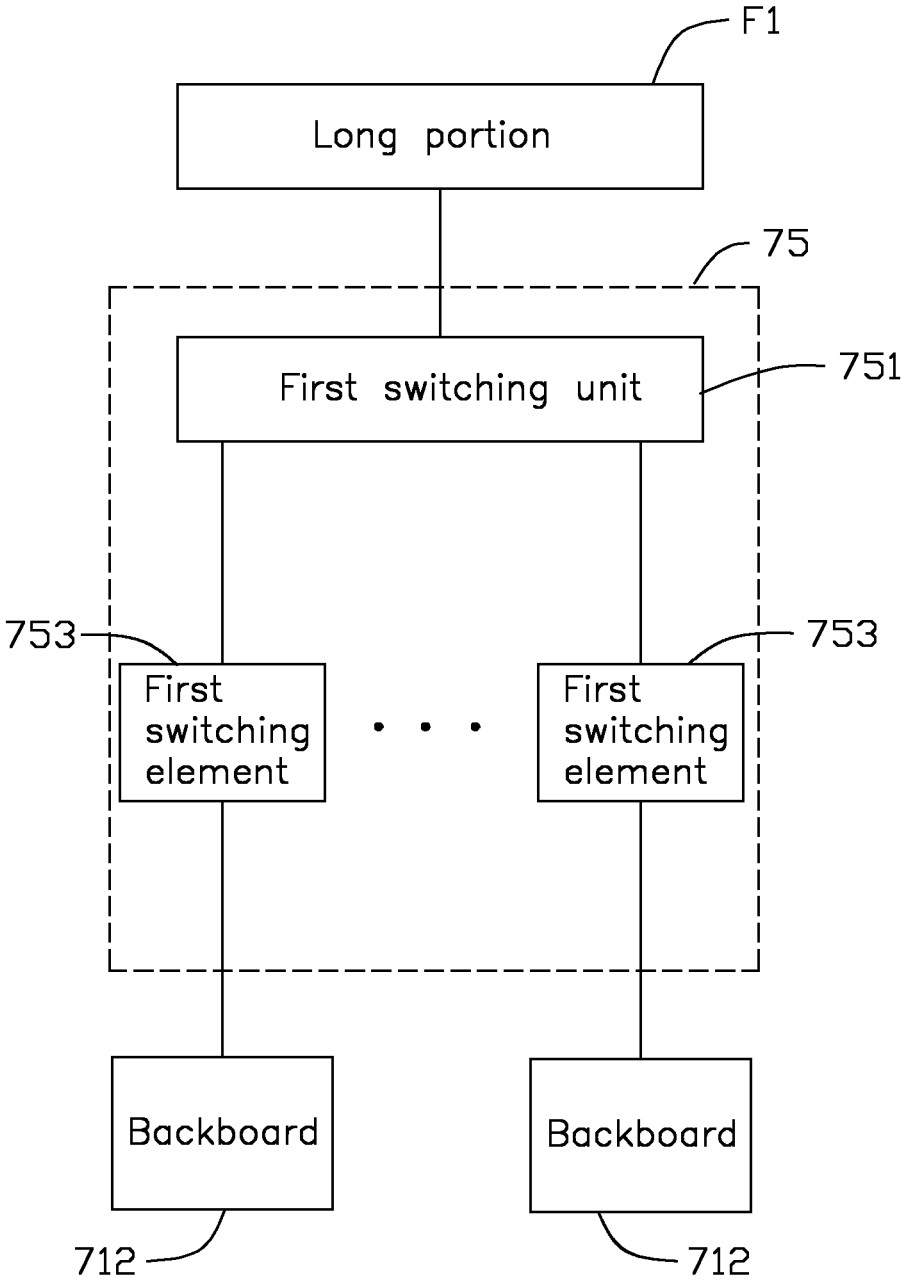
FIG. 63 is a circuit diagram of a first switching circuit of the antenna structure of FIG. 60.

Per FIG. 63, the first switching circuit 75 is electrically connected to a middle portion of the long portion F 1. The first switching circuit 75 includes a first switching unit 751 and a plurality of first switching elements 753. The first switching unit 751 is electrically connected to the long portion F1. The first switching elements 753 can be an inductor, a capacitor, or a combination of the inductor and the capacitor. The first switching elements 753 are connected in parallel. One end of each first switching element 753 is electrically connected to the first switching unit 751. The other end of each first switching element 753 is electrically connected to the backboard 712.

Figure 64:
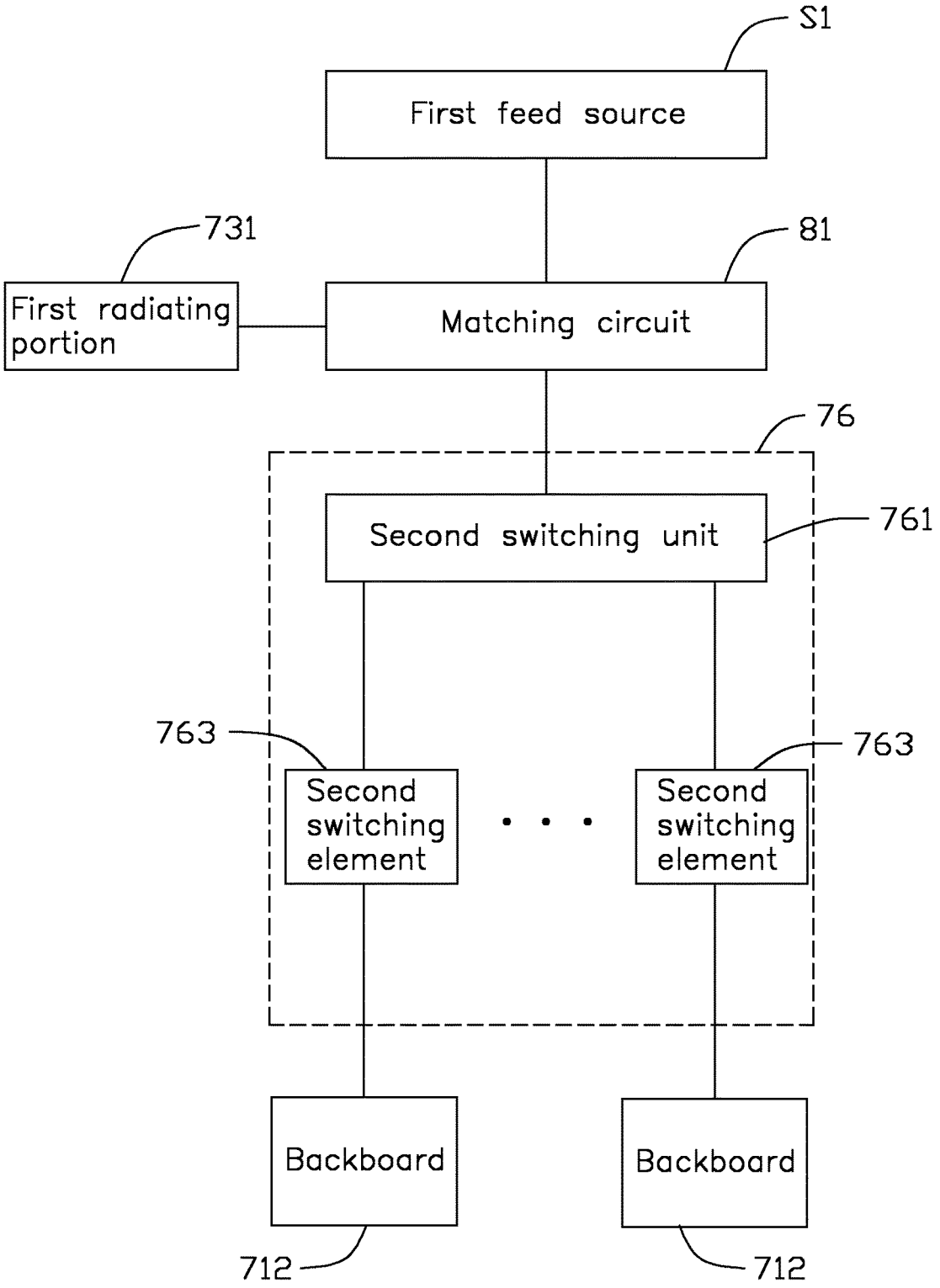
FIG. 64 is a circuit diagram of a second switching circuit of the antenna structure of FIG. 60.

Per FIG. 64, one end of the matching circuit 81 is electrically connected to the first feed source S1. Another end of the matching circuit 81 is electrically connected to the first radiating portion 731. One end of the second switching circuit 76 is electrically connected to the matching circuit 81. Another end of the second switching circuit 76 is electrically connected to the backboard 712. In this exemplary embodiment, the second switching circuit 76 includes a second switching unit 761 and a plurality of second switching elements 763. The second switching unit 761 is electrically connected to the matching circuit 81 and is electrically connected to the first radiating portion 731 through the matching circuit 81. The second switching elements 763 can be an inductor, a capacitor, or a combination of the inductor and the capacitor. The second switching elements 763 are connected in parallel. One end of each second switching element 763 is electrically connected to the second switching unit 761. The other end of each second switching element 763 is electrically connected to the backboard 712.

Through controlling the first switching unit 751 and/or the second switching unit 761, the long portion F1 can be switched to connect with different first switching elements 753 and/or second switching elements 763. Since each first switching elements 753 and second switching element 763 has a different impedance, an operating frequency band of the long portion F1 can be adjusted through switching the first switching unit 751 and/or the second switching unit 761, for example, the frequency band of the first mode of the long portion F1 can be offset towards a lower frequency or towards a higher frequency (relative to each other). In this exemplary embodiment, the first switching circuit 75 and the second switching circuit 76 can be switched independently or together.

Figure 65:
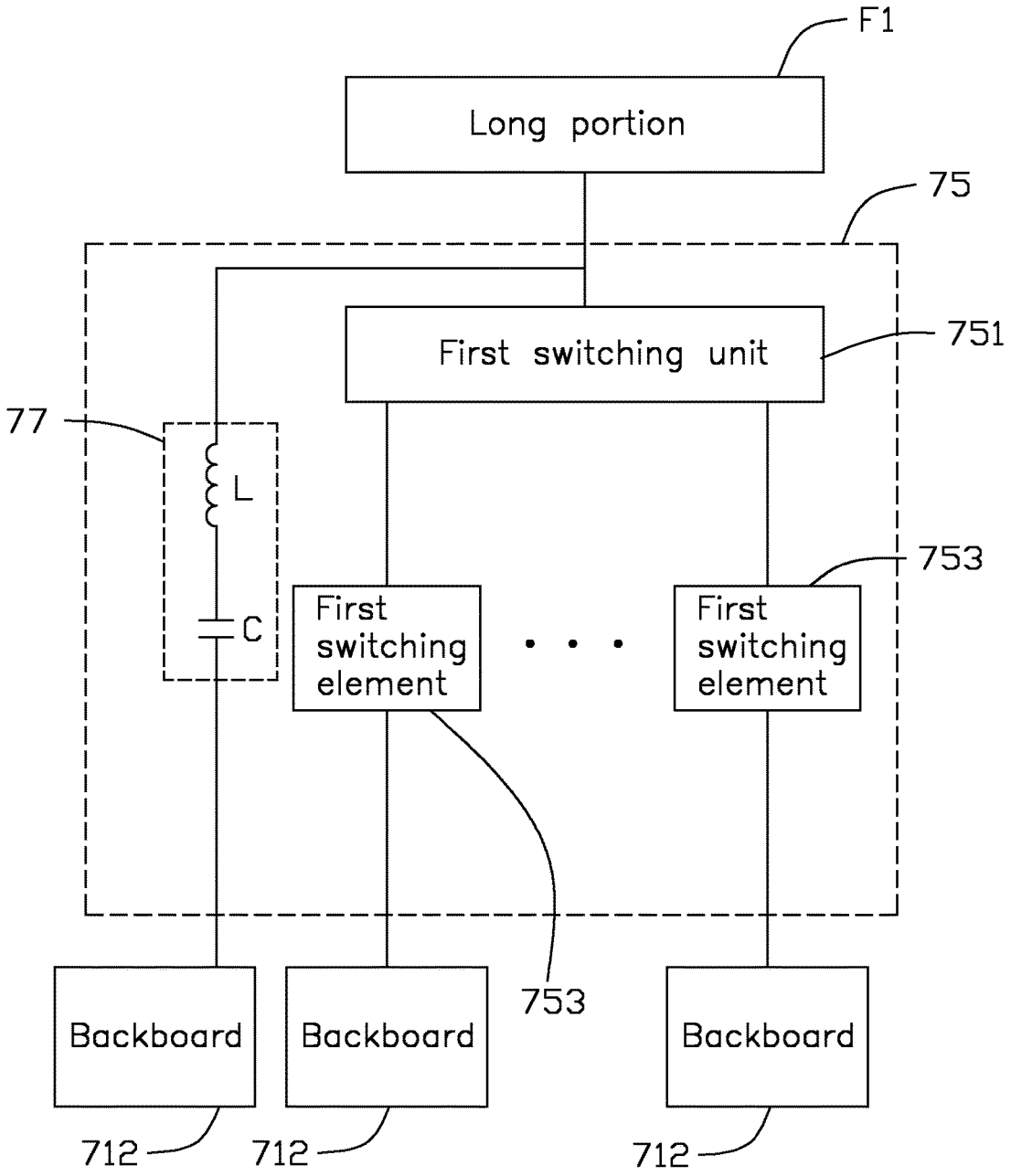
FIG. 65 is a circuit diagram of the first switching circuit of FIG. 63, showing the first switching circuit includes a resonance circuit.

Per FIG. 65, the first switching circuit 75 further includes a resonance circuit 77. In one exemplary embodiment, the first switching circuit 75 includes one resonance circuit 77. The resonance circuit 77 includes an inductor L and a capacitor C connected in series. The resonance circuit 77 is electrically connected between the long portion F 1 and the backboard 712. The resonance circuit 77 is electrically connected in parallel to the first switching unit 751 and at least one first switching element 753.

Figure 66:
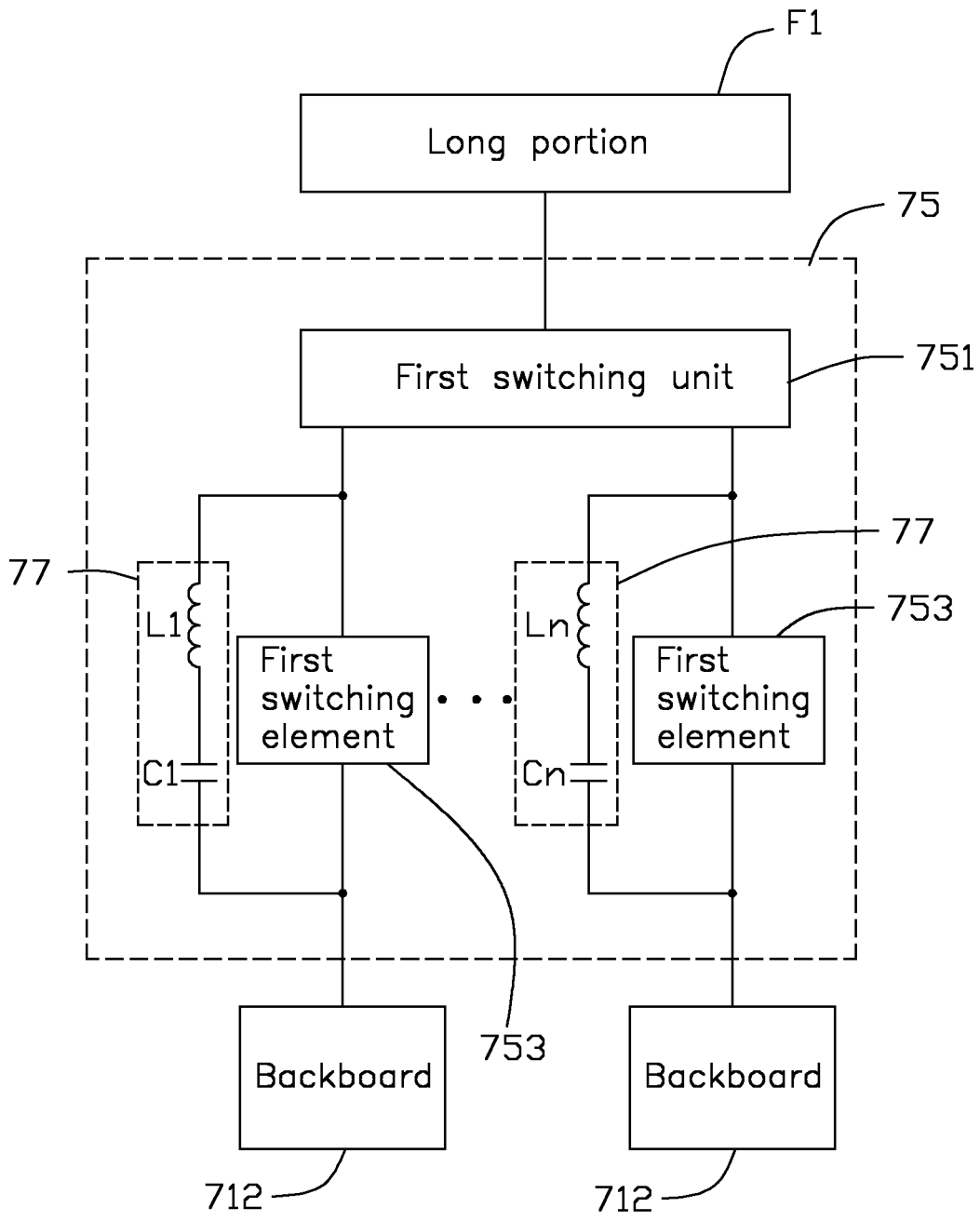
FIG. 66 is similar to FIG. 65, but shown the first switching circuit includes another resonance circuit.

Per FIG. 66, in another exemplary embodiment, the first switching circuit 75 includes a plurality of resonance circuits 77. The number of the resonance circuits 77 is equal to the number of first switching elements 753. Each resonance circuit 77 includes inductors L1-Ln and capacitors C1-Cn connected in series. Each resonance circuit 77 is electrically connected to one of the first switching elements 753 in parallel between the first switching unit 751 and the backboard 712.

Per FIG. 63, FIG. 64, FIG. 65, and FIG. 66, the backboard 712 can be replaced by the shielding mask or the middle frame for grounding the first switching circuit 75 and/or the second switching circuit 76.

Figure 67:
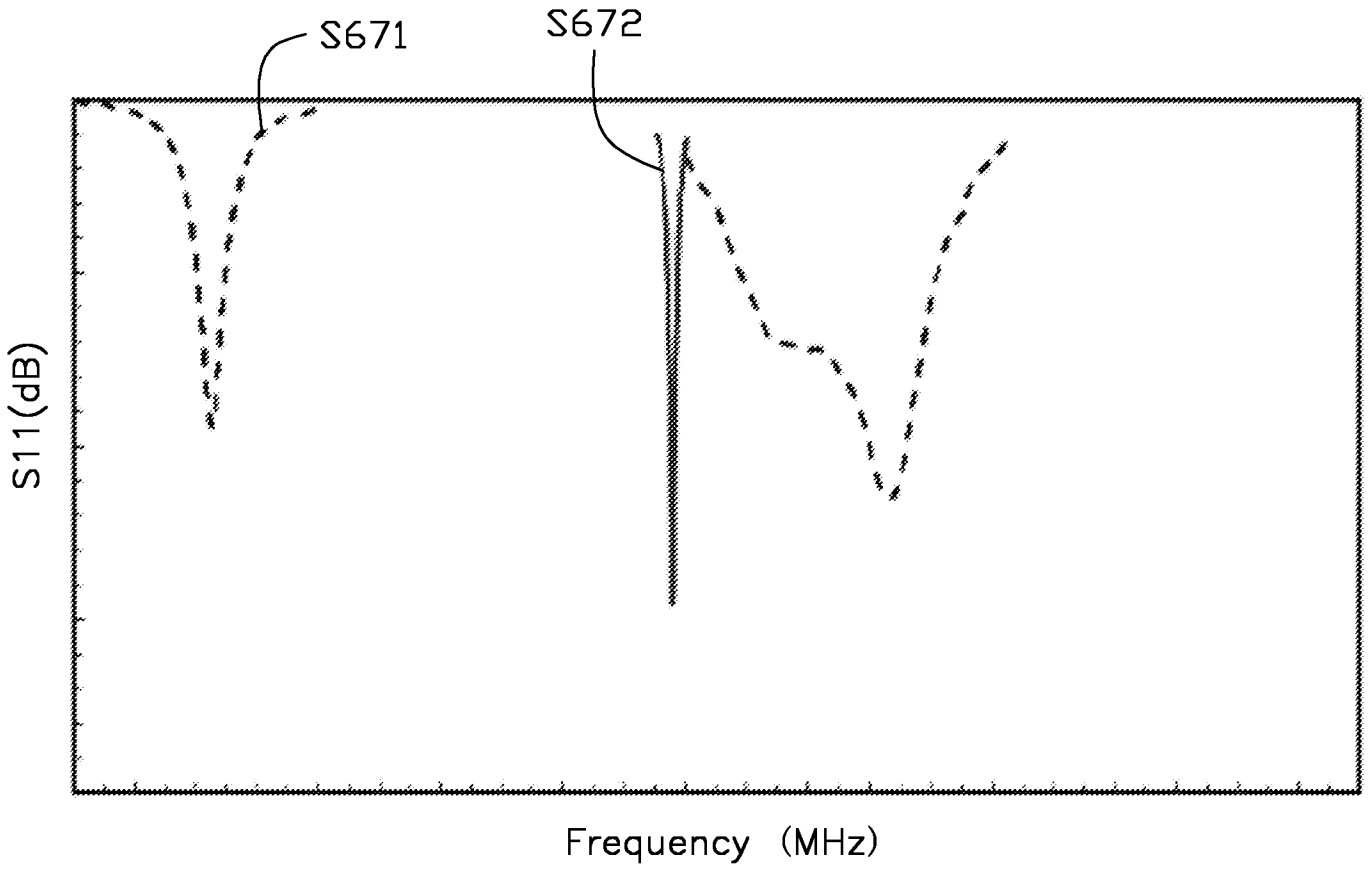
FIG. 67 is a schematic diagram of the antenna structure of FIG. 60, showing the first switching circuit of FIG. 65 includes a resonance circuit and generates a resonance mode.

Per FIG. 67, when the antenna structure 700 does not include the resonance circuit 77 of FIG. 65, the antenna structure 700 works at the first mode (please see the curve S671). When the antenna structure 700 includes the resonance circuit 77, the long portion F1 of the antenna structure 700 can activate an additional resonance mode (that is, a third mode, 2110-2170 MHz, please see the curve S672) to generate radiation signals in a third frequency band. The third mode can effectively broaden an applied frequency band of the antenna structure 700.

Figure 68:
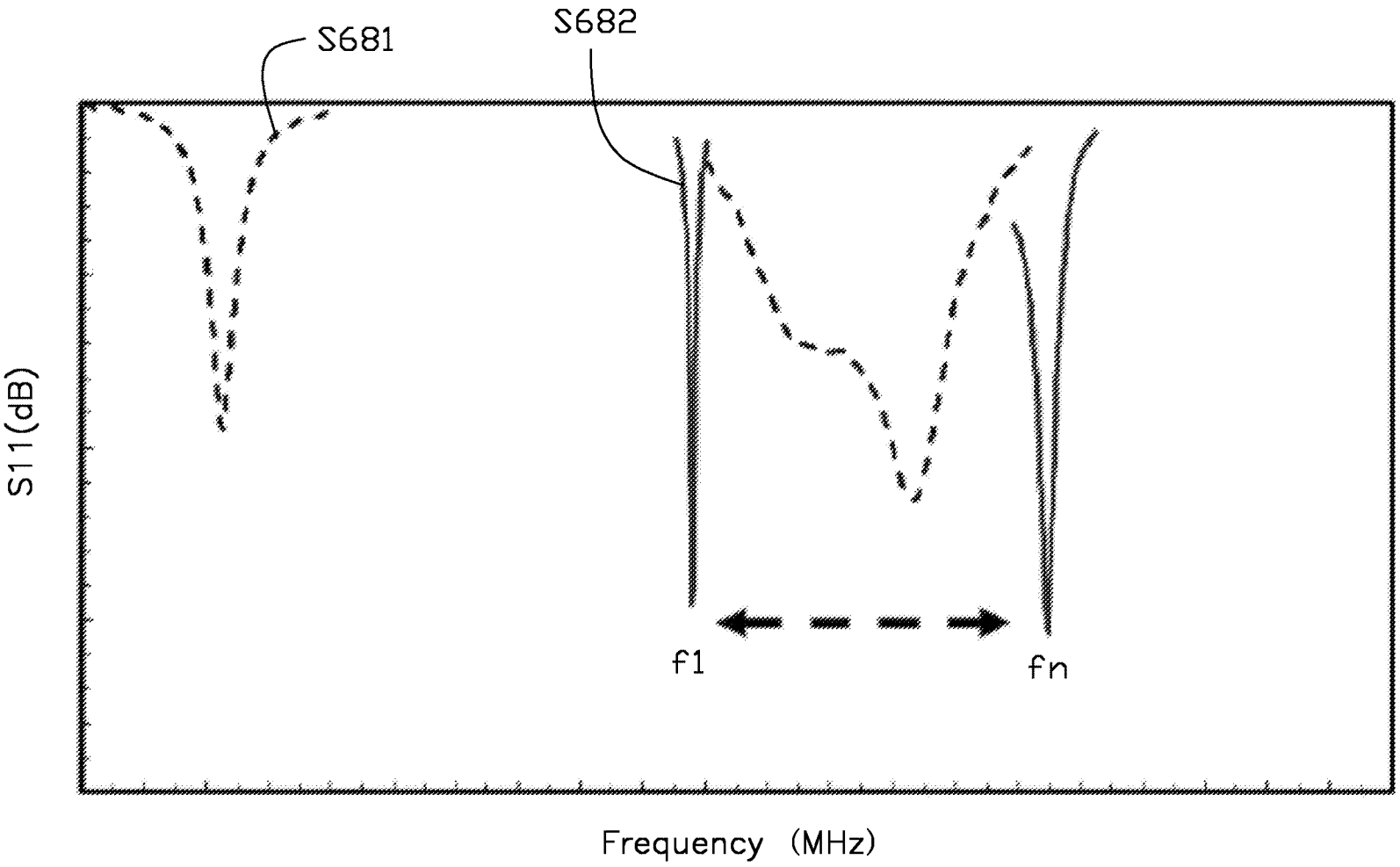
FIG. 68 is a schematic diagram of the antenna structure of FIG. 60, showing the first switching circuit of FIG. 66 includes a resonance circuit and generates a resonance mode.

Per FIG. 68, when the antenna structure 700 does not include the resonance circuit 77 of FIG. 66, the antenna structure 700 works at the first mode (please see the curve S681). When the antenna structure 700 includes the resonance circuit 77, the long portion F1 of the antenna structure 700 can activate the additional resonance mode (please see the curve S682), that is, the third mode. The third mode can effectively broaden an applied frequency band of the antenna structure 700.

In one exemplary embodiment, inductance values of the inductors L1-Ln and capacitance values of the capacitors C1-Cn of the resonance circuit 77 can cooperatively decide a frequency band of the resonance mode when the first mode switches. For example, in one exemplary embodiment, as illustrated in FIG. 68, when the first switching unit 751 switches to different first switching elements 753 through setting the inductance value and the capacitance value of the resonance circuit 77, the resonance mode of the antenna structure 700 can also be switched. For example, the resonance mode of the antenna structure 700 can be moved from f1 to fn.

In other exemplary embodiments, the frequency band of the resonance mode can be fixed through setting the inductance value and the capacitance value of the resonance circuit 77. Then no matter to which first switching element 753 the first switching unit 751 is switched, the frequency band of the resonance mode is fixed and keeps unchanged.

In other exemplary embodiments, the resonance circuit 77 is not limited to include the inductor L and the capacitor C, and can include other resonance components.

In this exemplary embodiment, the second radiator 78 is positioned in the receiving space 714 of the housing 71 and is positioned adjacent to the long portion F1. The second radiator 78 is spaced apart from the backboard 712. In this exemplary embodiment, the second radiator 78 is substantially a strip and is positioned parallel to the end portion 715. The second radiator 78 is connected to the position of the front frame 711 adjacent to the first end D1 and extends towards the second side portion 717.

The second feed source S2 is positioned on the front frame 711 and is electrically connected to the second radiator 78 to feed current to the second radiator 78. When the second feed source S2 supplies current, the current flows to the second radiator 78 to activate a fourth mode, to generate radiation signals in a fourth frequency band. In this exemplary embodiment, the fourth mode is an LTE-A high frequency operation mode. The fourth frequency band is a frequency band of about 2300-2400 MHz and 2496-2690 MHz.

One end of the third switching circuit 79 is electrically connected to the second radiator 78 and another end of the third switching circuit 79 is electrically connected to the backboard 712, the shielding mask, or the middle frame to be grounded. The third switching circuit 79 is configured to adjust a frequency band of the high frequency operation mode of the second radiator 78. A circuit structure and a working principle of the third switching circuit 79 are consistent with the first switching circuit 75 shown in FIG. 63.

Figure 69:
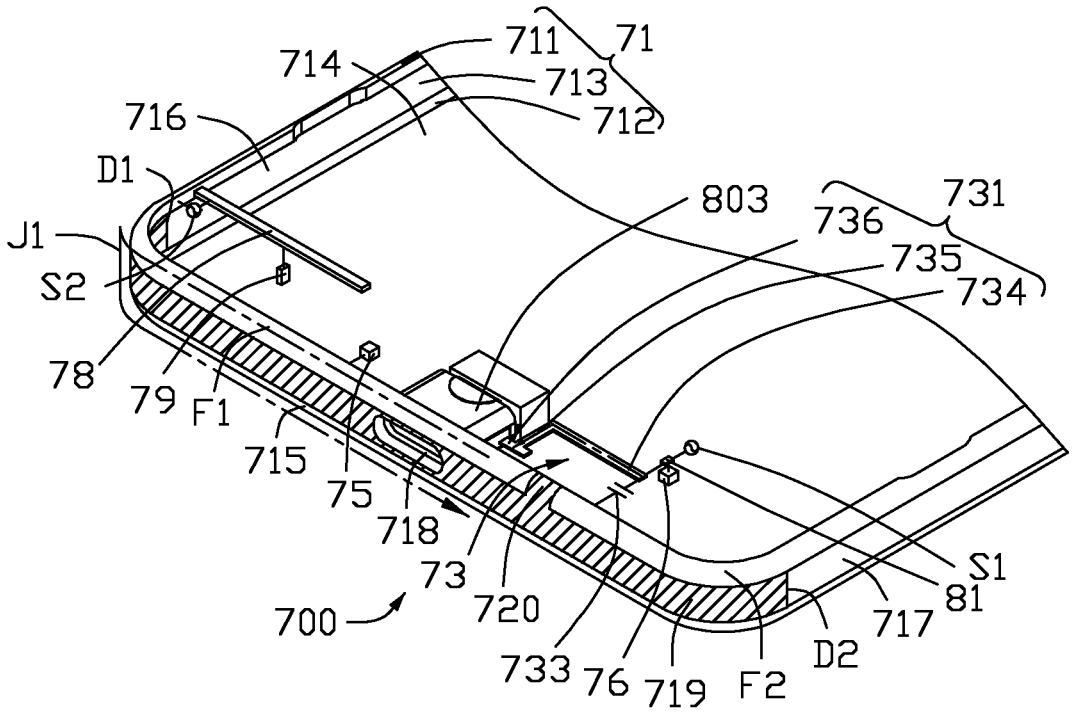
FIG. 69 is a current path distribution graph when the antenna structure of FIG. 60 works at a low frequency operation mode.

Per FIG. 69, when the first feed source S1 supplies current, the current flows through the first radiating section 734, the second radiating section 735, and the third radiating section 736 of the first radiating portion 731. The current is further coupled to the long portion F1 through the third radiating section 736, flows through the first side portion 716 from the long portion F1, and then to the backboard 712 (e.g., path J1) to activate the first mode to generate radiation signals in the first frequency band. Since the antenna structure 700 includes the first switching circuit 75 and the second switching circuit 76, the low frequency operation mode of the long portion F1 can be switched through the first switching circuit 75 and the second switching circuit 76 in coordination with each other, and the middle frequency operation mode and the high frequency operation mode of the antenna structure 700 are unaffected.

Figure 70:
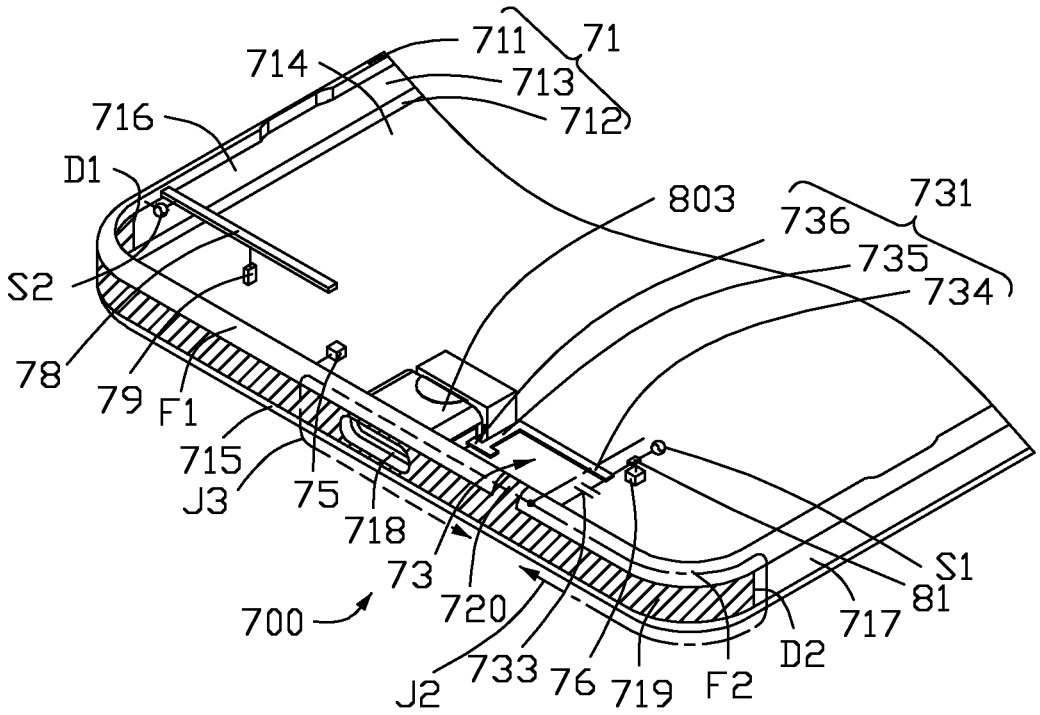
FIG. 70 is a current path distribution graph when the antenna structure of FIG. 60 works at a middle frequency operation mode.

Per FIG. 70, when the first feed source 51 supplies current, the current directly flows through the short portion F2 through the second radiating portion 733, and flows to the second side portion 717 and the backboard 712 (e.g., path J2) to activate the second mode, to generate radiation signals in the second frequency band. When the first feed source S1 supplies current, the current flows through the short portion F2 through the second radiating portion 733, is coupled to the long portion F1 through the gap 720, flows through the resonance circuit 77 of the first switching circuit 75, and then to the backboard 712 (e.g., path J3). Then, through a coupling of the gap 720 and a configuration of the resonance circuit 77, the long portion F1 further activates the third mode to generate radiation signals in the third frequency band.

Figure 71:
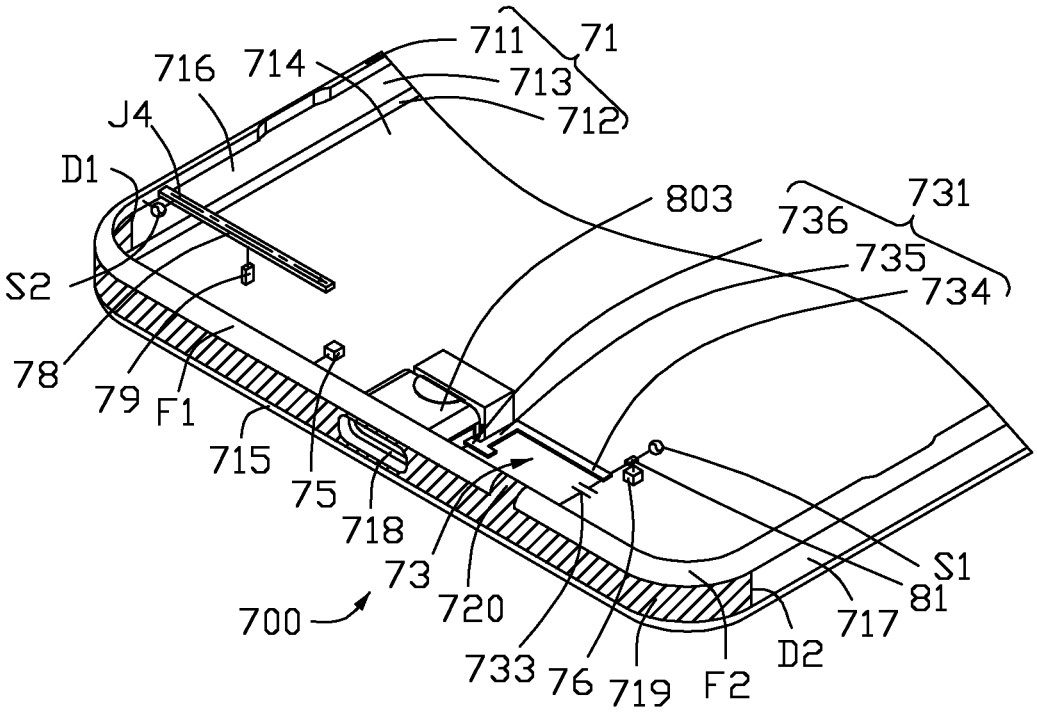
FIG. 71 is a current path distribution graph when the antenna structure of FIG. 60 works at a high frequency operation mode.

Per FIG. 71, when the current enters the second radiator 78 from the second feed source S2, the current flows to the end of the second radiator 78 away from the second feed source S2 (e.g., path J4) to activate the fourth mode, to generate radiation signals in the fourth frequency band. Since the antenna structure 700 includes the third switching circuit 79, the frequencies of the high frequency operation mode can be effectively switched.

Figure 72:
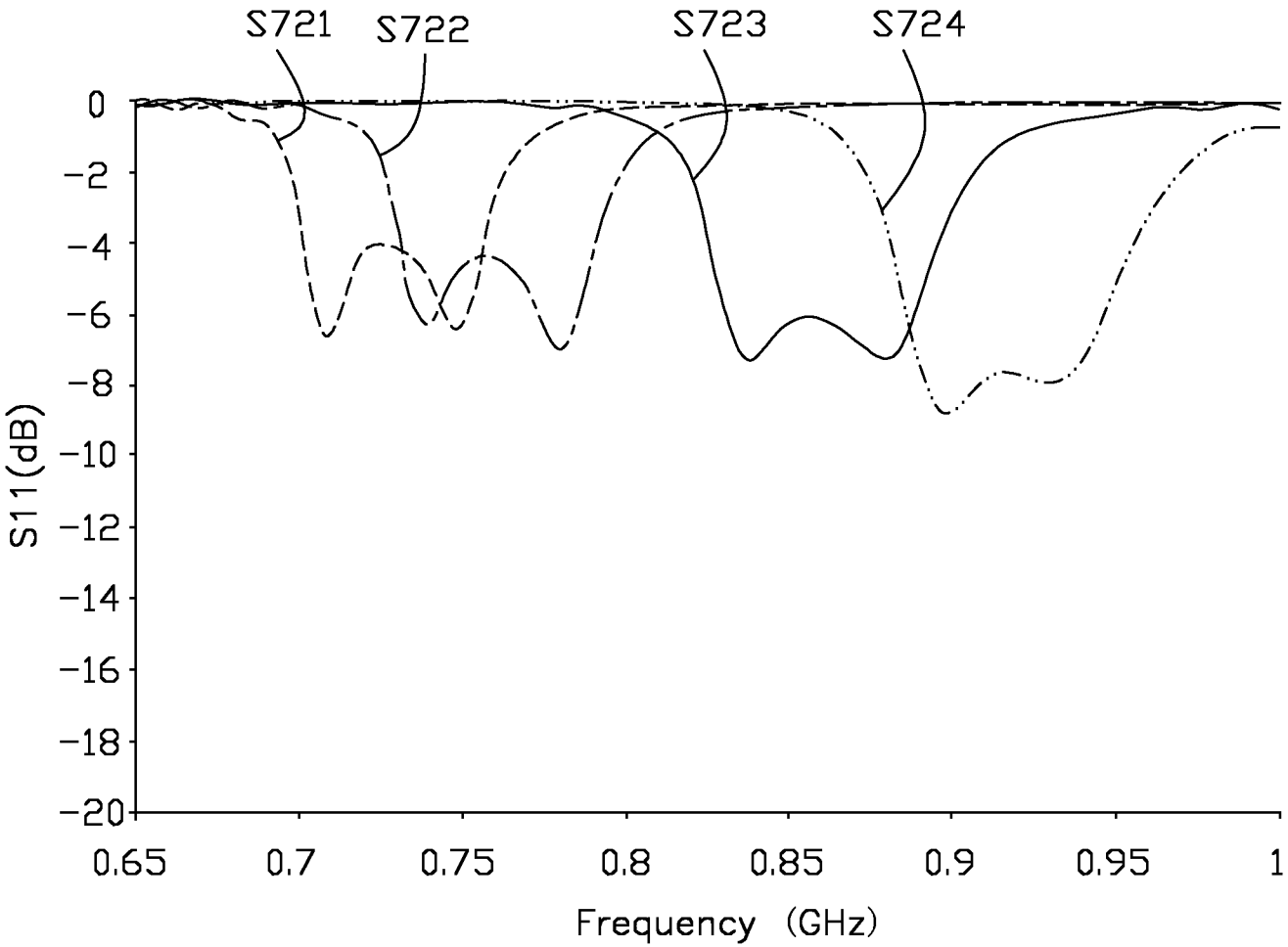
FIG. 72 is a scattering parameter graph when the antenna structure of FIG. 60 works at a low frequency operation mode.

FIG. 72 illustrates a scattering parameter graph of the antenna structure 700, when the antenna structure 700 works at the low frequency operation mode. Curve S721 illustrates a scattering parameter when the antenna structure 700 works at a frequency band of about 704-746 MHz (LTE-A Band 17). Curve S722 illustrates a scattering parameter when the antenna structure 700 works at a frequency band of about 746-787 MHz (LTE-A Band 13). Curve S723 illustrates a scattering parameter when the antenna structure 700 works at a frequency band of about 824-894 MHz (LTE-A Band 5). Curve S724 illustrates a scattering parameter when the antenna structure 700 works at a frequency band of about 880-960 MHz (LTE-A Band 8). Curves S721-S724 respectively correspond to four different frequency bands and respectively correspond to four of the plurality of low frequency operation modes of the first switching circuit 75 and the second switching circuit 76.

Figure 73:
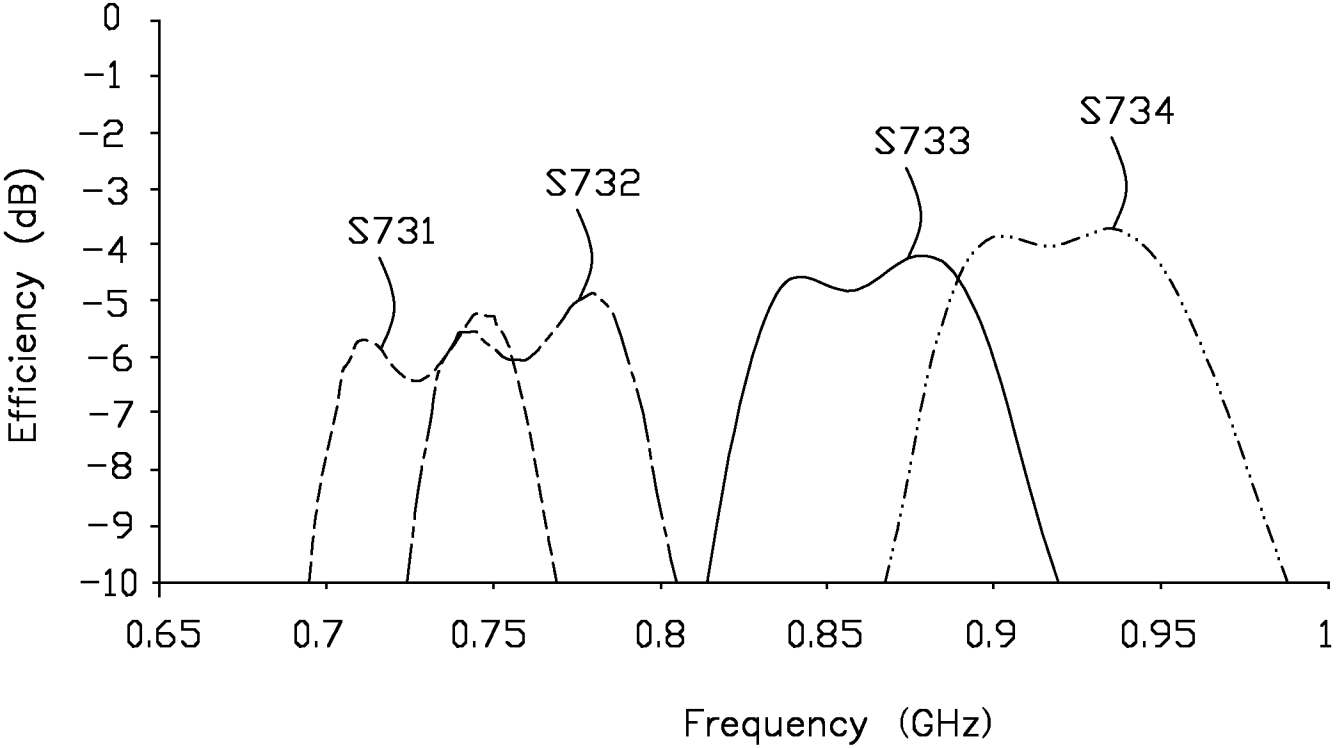
FIG. 73 is a radiating efficiency graph when the antenna structure of FIG. 60 works at a low frequency operation mode.

FIG. 73 illustrates a radiating efficiency graph of the antenna structure 700, when the antenna structure 700 works at the low frequency operation mode. Curve S731 illustrates a radiating efficiency when the antenna structure 700 works at a frequency band of about 704-746 MHz (LTE-A Band 17). Curve S732 illustrates a radiating efficiency when the antenna structure 700 works at a frequency band of about 746-787 MHz (LTE-A Band 13). Curve S733 illustrates a radiating efficiency when the antenna structure 700 works at a frequency band of about 824-894 MHz (LTE-A Band 5). Curve S734 illustrates a radiating efficiency when the antenna structure 700 works at a frequency band of about 880-960 MHz (LTE-A Band 8). Curves S731-S734 respectively correspond to four different frequency bands and respectively correspond to four of the plurality of low frequency operation modes of the first switching circuit 75 and the second switching circuit 76.

Figure 74:
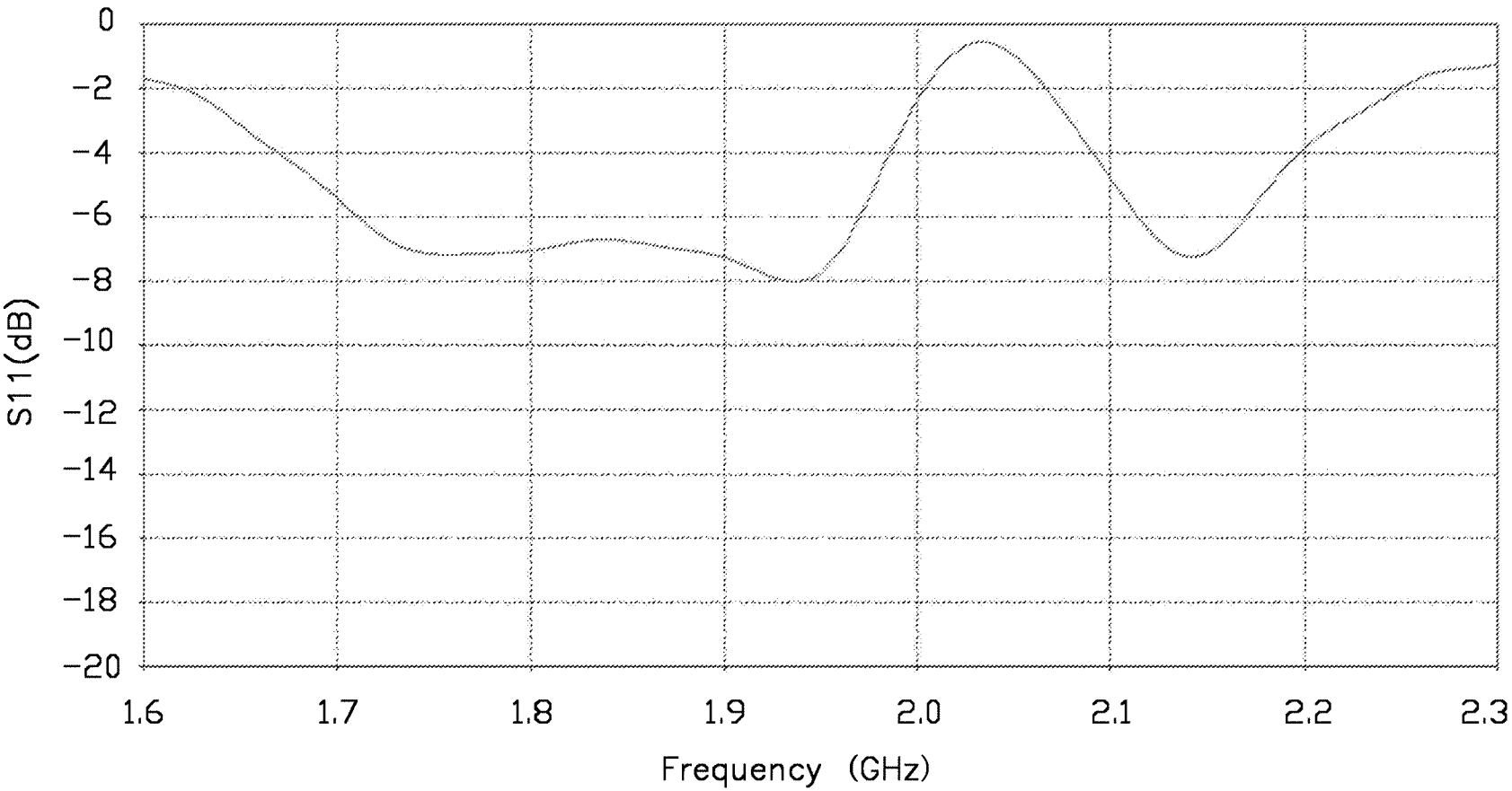
FIG. 74 is a scattering parameter graph when the antenna structure of FIG. 60 works at a middle frequency operation mode.
Figure 75:
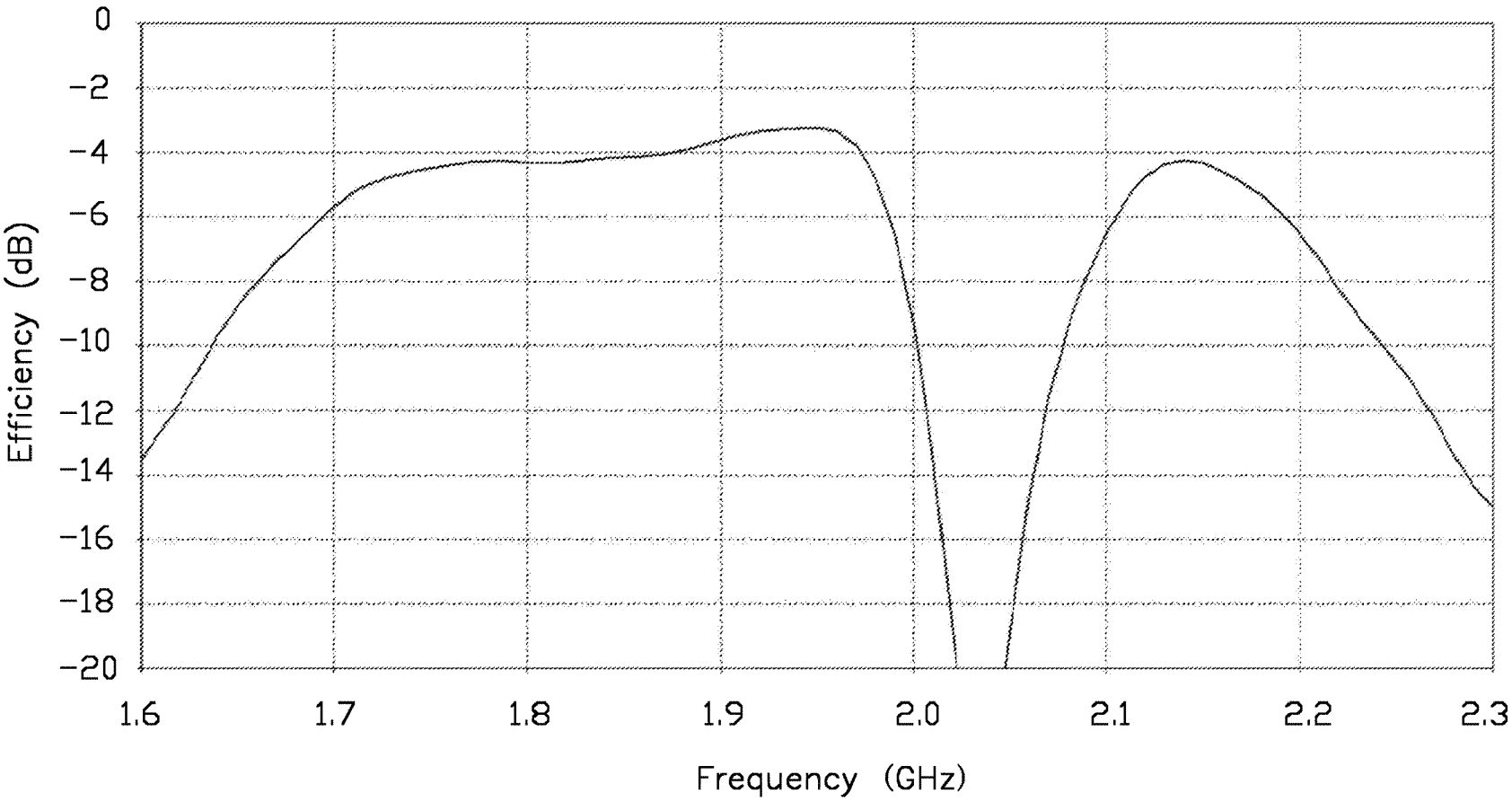
FIG. 75 is a radiating efficiency graph when the antenna structure of FIG. 60 works at a middle frequency operation mode.

FIG. 74 illustrates a scattering parameter graph of the antenna structure 700, when the antenna structure 700 works at the middle frequency operation mode (1710-1990 MHz and 2110-2170 MHz). FIG. 75 illustrates a radiating efficiency graph of the antenna structure 700, when the antenna structure 700 works at the middle frequency operation mode (1710-1990 MHz and 2110-2170 MHz).

Figure 76:
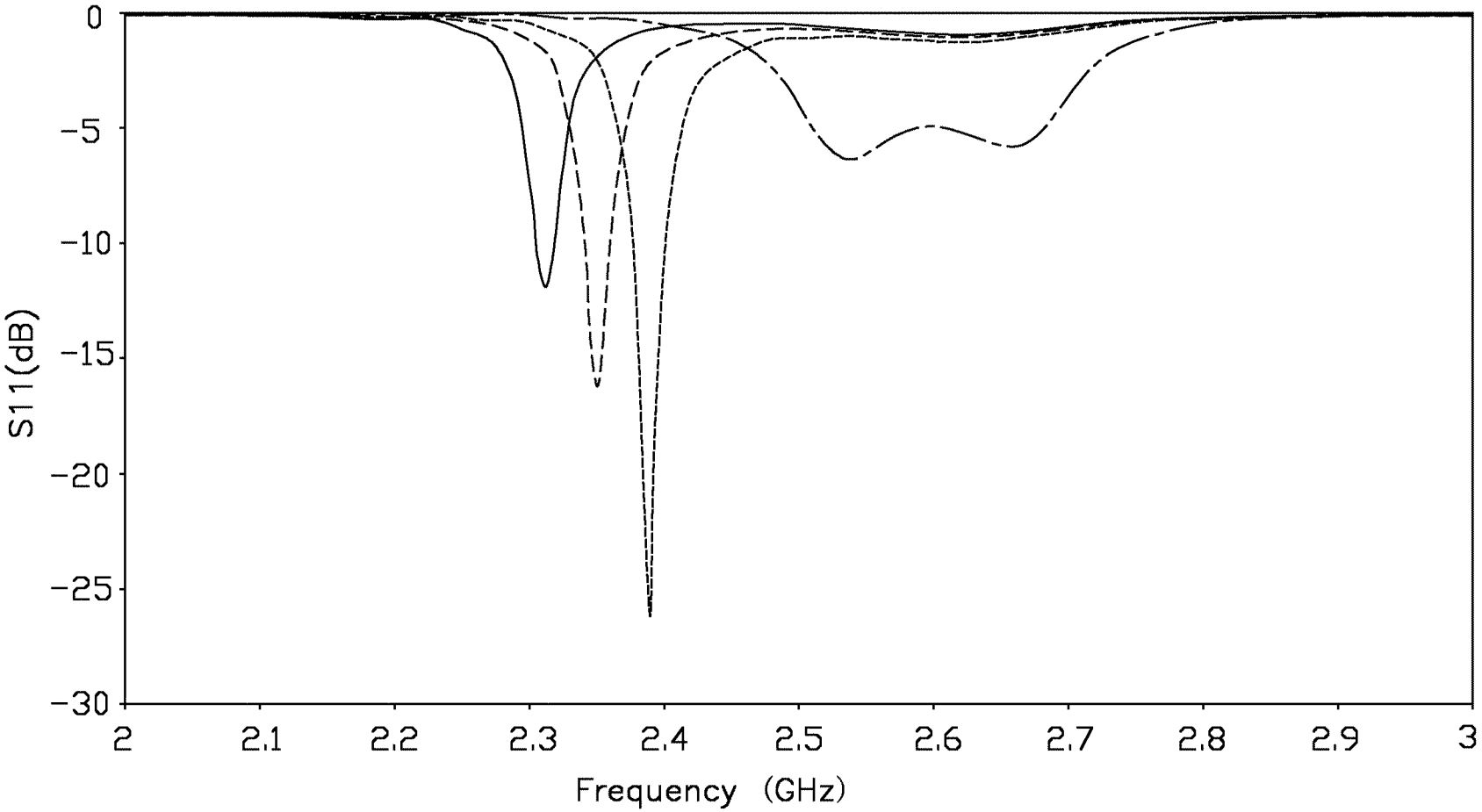
FIG. 76 is a scattering parameter graph when the antenna structure of FIG. 60 works at a high frequency operation mode.
Figure 77:
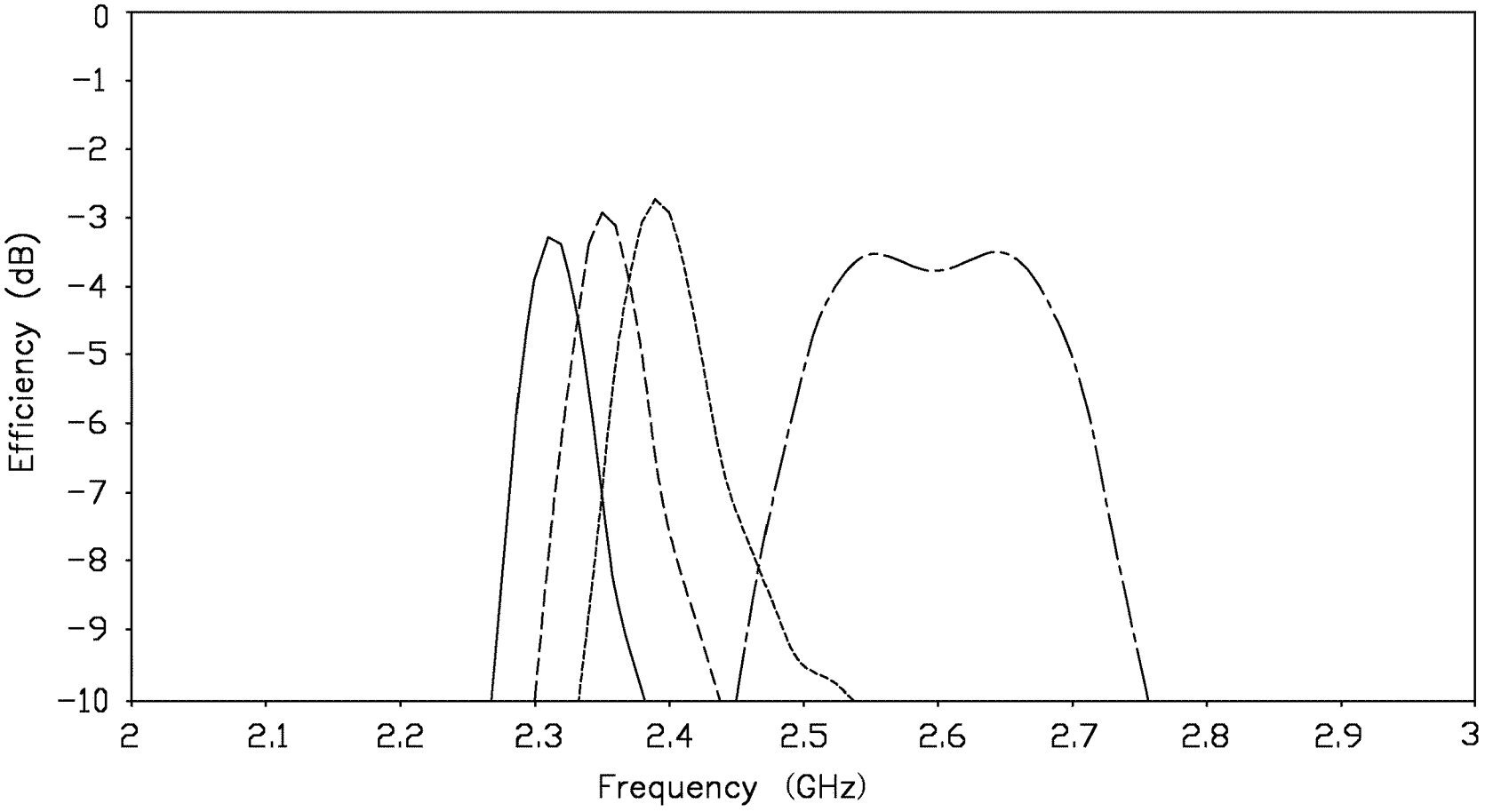
FIG. 77 is a radiating efficiency graph when the antenna structure of FIG. 60 works at a high frequency operation mode.

FIG. 76 illustrates a scattering parameter graph of the antenna structure 700, when the antenna structure 700 works at the high frequency operation mode (2300-2400 MHz and 2496-2690 MHz). FIG. 77 illustrates a radiating efficiency graph of the antenna structure 700, when the antenna structure 700 works at the high frequency operation mode (2300-2400 MHz and 2496-2690 MHz). When the switching unit of the third switching circuit 79 switches to different switching elements (for example, four different switching elements), each of switching elements has a different impedance, the high frequency band of the antenna structure 700 can be effectively adjusted to obtain a good operating bandwidth.

In view of FIGS. 72 to 77, the antenna structure 700 can work at a low frequency band, for example, frequency bands of about LTE-A Band 17/13/5/8. The antenna structure 700 can also work at the middle frequency band (1710-1990 MHz and 2110-2170 MHz), and the high frequency band (2300-2400 MHz and 2496-2690 MHz). That is, the antenna structure 700 can work at the low frequency band, the middle frequency band, and the high frequency band, and when the antenna structure 700 works at these frequency bands, a working frequency satisfies a design of the antenna and also has a good radiating efficiency.

In this exemplary embodiment, the antenna structure 700 includes the first radiator 73, the first radiating portion 731 and the long portion F1 cooperatively a coupling structure, and the second radiating portion 733 is directly connected to the short portion F2. That is, the first radiator 73, the long portion F1, and the short portion F2 cooperatively form a half-coupling feed structure. The long portion F1 and the short portion F2 respectively activate a first mode and a second mode. The configuration of the half-coupling feed structure ensures a flexibility for adjusting the antenna structure 700 and can effectively decrease a nonmetallic area of the antenna structure 700.

In addition, the antenna structure 700 includes the first switching circuit 75 and the second switching circuit 76, the first mode can be effectively adjusted and switched. The antenna structure 700 further includes the resonance circuit 77, then the long portion F1 can activate an additional middle frequency operation mode (the third mode). The antenna structure 700 includes the second radiator 78 and the third switching circuit 79, the antenna structure 700 can activate a high frequency operation mode and the high frequency band of the antenna structure 700 can be effectively adjusted to obtain a good operating bandwidth.

Figure 78:
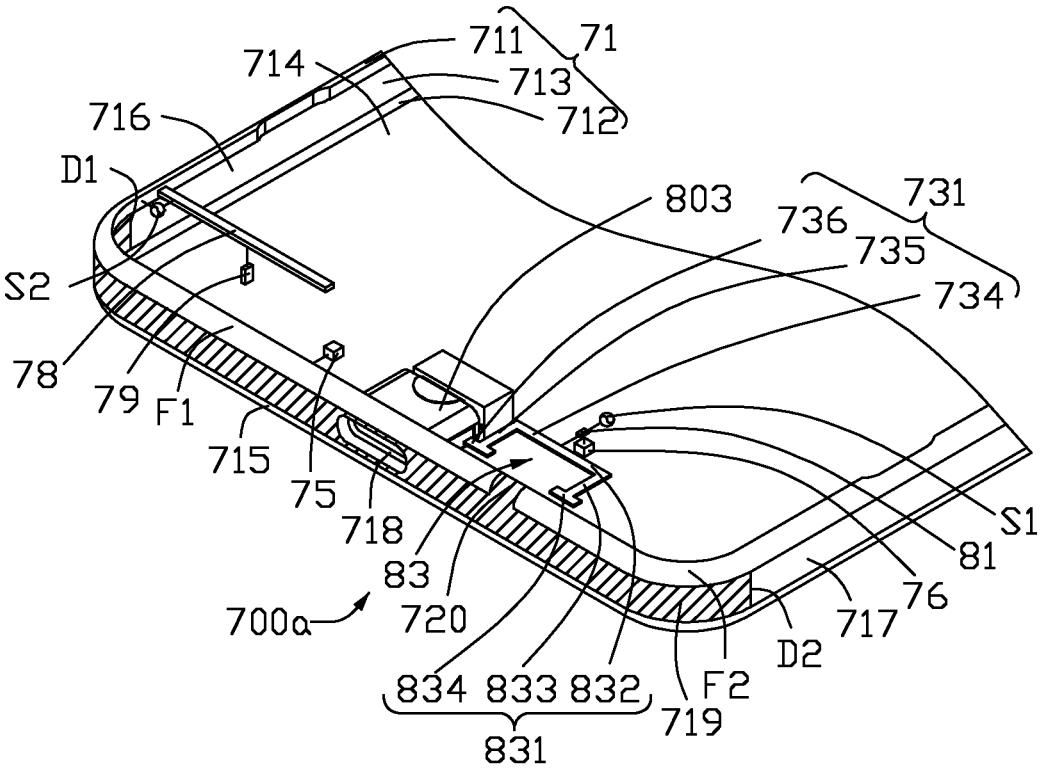
FIG. 78 is an isometric view of a seventh exemplary embodiment of a wireless communication device using a seventh exemplary antenna structure.

FIG. 78 illustrates a seventh exemplary antenna structure 700*a*. The antenna structure 700*a* includes a housing 71, a first feed source S1, a first radiator 83, a first switching circuit 75, a second switching circuit 76, a resonance circuit 77, a second radiator 78, a second feed source S2, and a third switching circuit 79. The housing 71 includes a front frame 711, a backboard 712, and a side frame 713. The side frame 713 includes an end portion 715, a first side portion 716, and a second side portion 717. The side frame 713 defines a slot 719. The front frame 711 defines a gap 720. The front frame 711 is divided into two portions by the gap 720, these portions being a long portion F1 and a short portion F2 (long and short relative to each other).

The first radiator 83 includes a first radiating portion 731 and a second radiating portion 831. The first radiating portion 731 includes a first radiating section 734, a second radiating section 735, and a third radiating section 736. The third radiating section 736 is spaced apart from the long portion F1, then the first radiating portion 731 and the long portion F1 form a coupling structure.

In this exemplary embodiment, the antenna structure 700*a* differs from the antenna structure 700 in that a structure of the second radiating portion 831 of the antenna structure 700*a* is different from the second radiating portion 733 of the antenna structure 700. A connection relationship between the second radiating portion 831 and the short portion F2 is also different from the connection relationship between the second radiating portion 733 and the short portion F2.

In this exemplary embodiment, the second radiating portion 831 is symmetrical to the first radiating portion 731 relative to the first feed source S1. The second radiating portion 831 includes a first coupling section 832, a second coupling section 833, and a third coupling section 834. The first coupling section 832 is substantially rectangular. The first coupling section 832 is electrically connected to the first radiating section 734 and the matching circuit 81 of the first feed source S1, and extends along a direction parallel to the end portion 715 towards the second side portion 717, so as to be collinear with the first radiating section 734.

The second coupling section 833 is substantially rectangular. One end of the second coupling section 833 is perpendicularly connected to the end of the first coupling section 832 away from the first feed source S1. Another end of the second coupling section 833 extends along a direction parallel to the second radiating section 735 towards the end portion 715. The second coupling section 833, the first radiating section 734, the second radiating section 735, and the first coupling section 832 cooperatively form a U-shaped structure.

The third coupling section 834 is substantially rectangular. The third coupling section 834 is spaced apart from and parallel to the short portion F2. The third coupling section 834 is electrically connected to the end of the second coupling section 833 away from the first coupling section 832. The third coupling section 834 further extends along two directions, the two directions being towards the first side portion 716 and towards the second side portion 717 respectively, to form a T-shaped structure with the second coupling section 833.

In this exemplary embodiment, when the antenna structure 700*a* works at the low frequency operation mode, a current path distribution graph of the antenna structure 700*a* is consistent with the current path distribution graph of the antenna structure 700 shown in FIG. 69.

Figure 79:
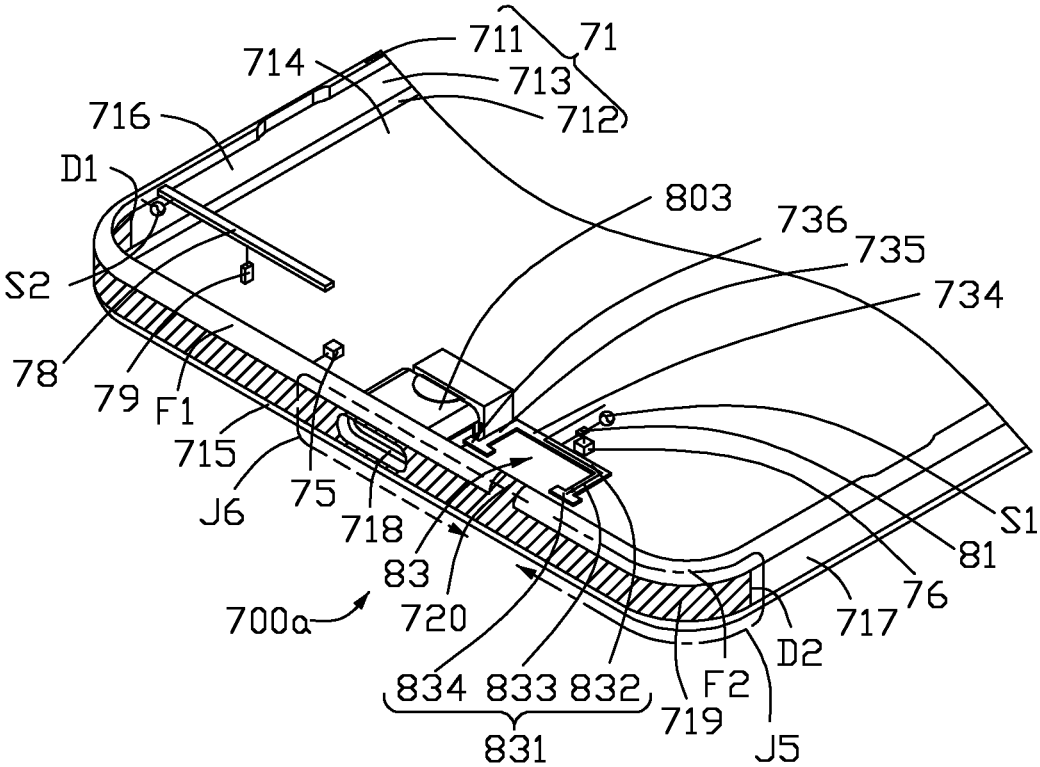
FIG. 79 is a current path distribution graph when the antenna structure of FIG. 78 works at a middle frequency operation mode.

Per FIG. 79, when the first feed source S1 supplies current, the current directly flows through the first coupling section 832, the second coupling section 833, and the third coupling section 834. The current is further coupled to the short portion F2 through the third coupling section 834, and flows to the second side portion 717 and the backboard 712 (e.g., path J5) to activate the second mode, to generate radiation signals in the second frequency band. When the first feed source S1 supplies current, the current is coupled to the short portion F2 through the third coupling section 834, is coupled to the long portion F1 through the gap 720, flows through the resonance circuit 77 of the first switching circuit 75, and flows to the backboard 712 (e.g., path J6). Then, through a coupling of the gap 720 and a configuration of the resonance circuit 77, the long portion F1 further activates the third mode to generate radiation signals in the third frequency band.

In this exemplary embodiment, when the antenna structure 700*a* works at the high frequency operation mode, a current path distribution graph of the antenna structure 700*a* is consistent with the current path distribution graph of the antenna structure 700 shown in FIG. 71.

Figure 80:
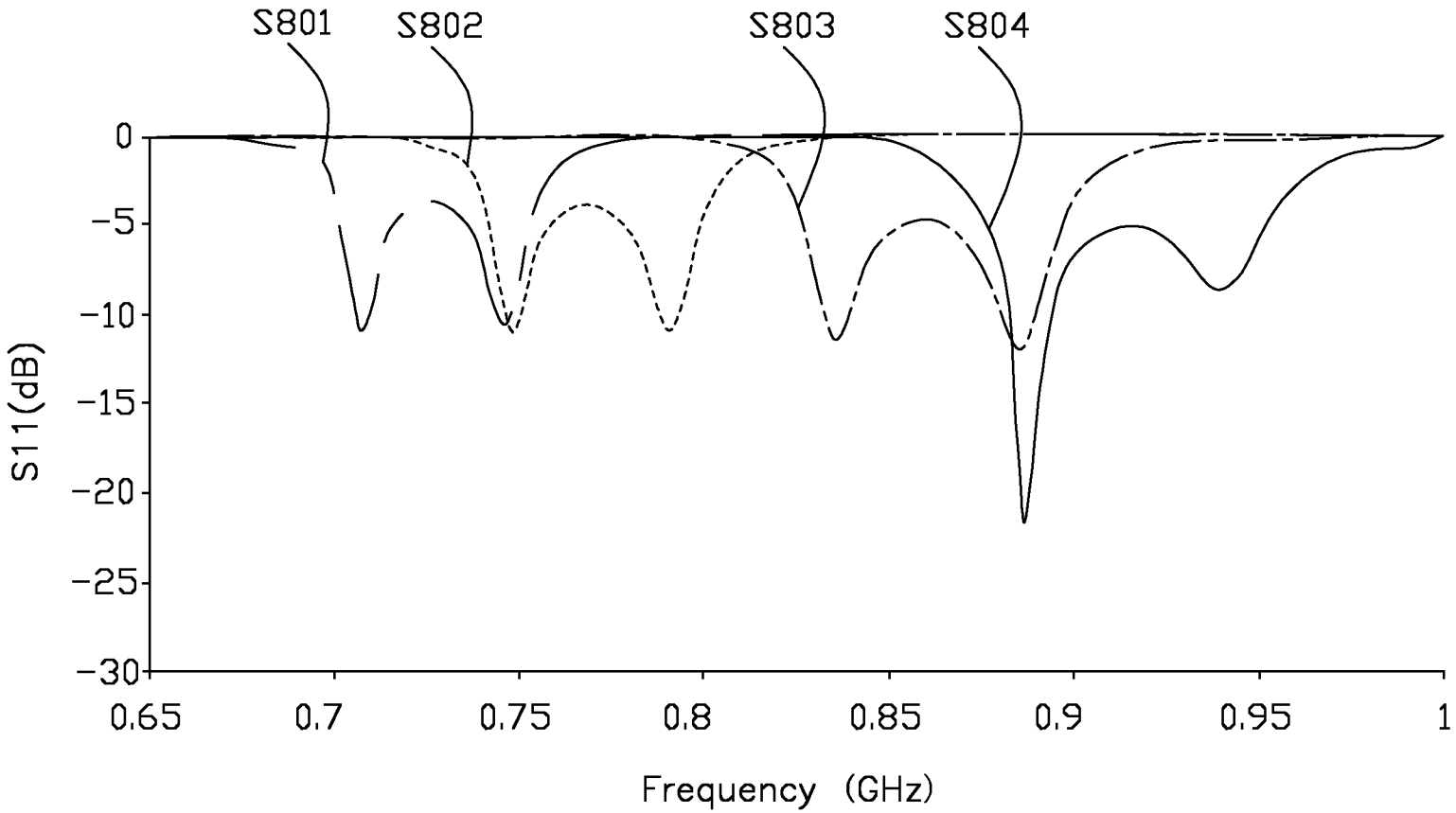
FIG. 80 is a scattering parameter graph when the antenna structure of FIG. 78 works at a low frequency operation mode.

FIG. 80 illustrates a scattering parameter graph of the antenna structure 700*a*, when the antenna structure 700*a* works at the low frequency operation mode. Curve S801 illustrates a scattering parameter when the antenna structure 700*a* works at a frequency band of about 704-746 MHz (LTE-A Band 17). Curve S802 illustrates a scattering parameter when the antenna structure 700*a* works at a frequency band of about 746-787 MHz (LTE-A Band 13). Curve S803 illustrates a scattering parameter when the antenna structure 700*a* works at a frequency band of about 824-894 MHz (LTE-A Band 5). Curve S804 illustrates a scattering parameter when the antenna structure 700*a* works at a frequency band of about 880-960 MHz (LTE-A Band 8). Curves S801-S804 respectively correspond to four different frequency bands and respectively correspond to four of the plurality of low frequency operation modes of the first switching circuit 75 and the second switching circuit 76.

Figure 81:
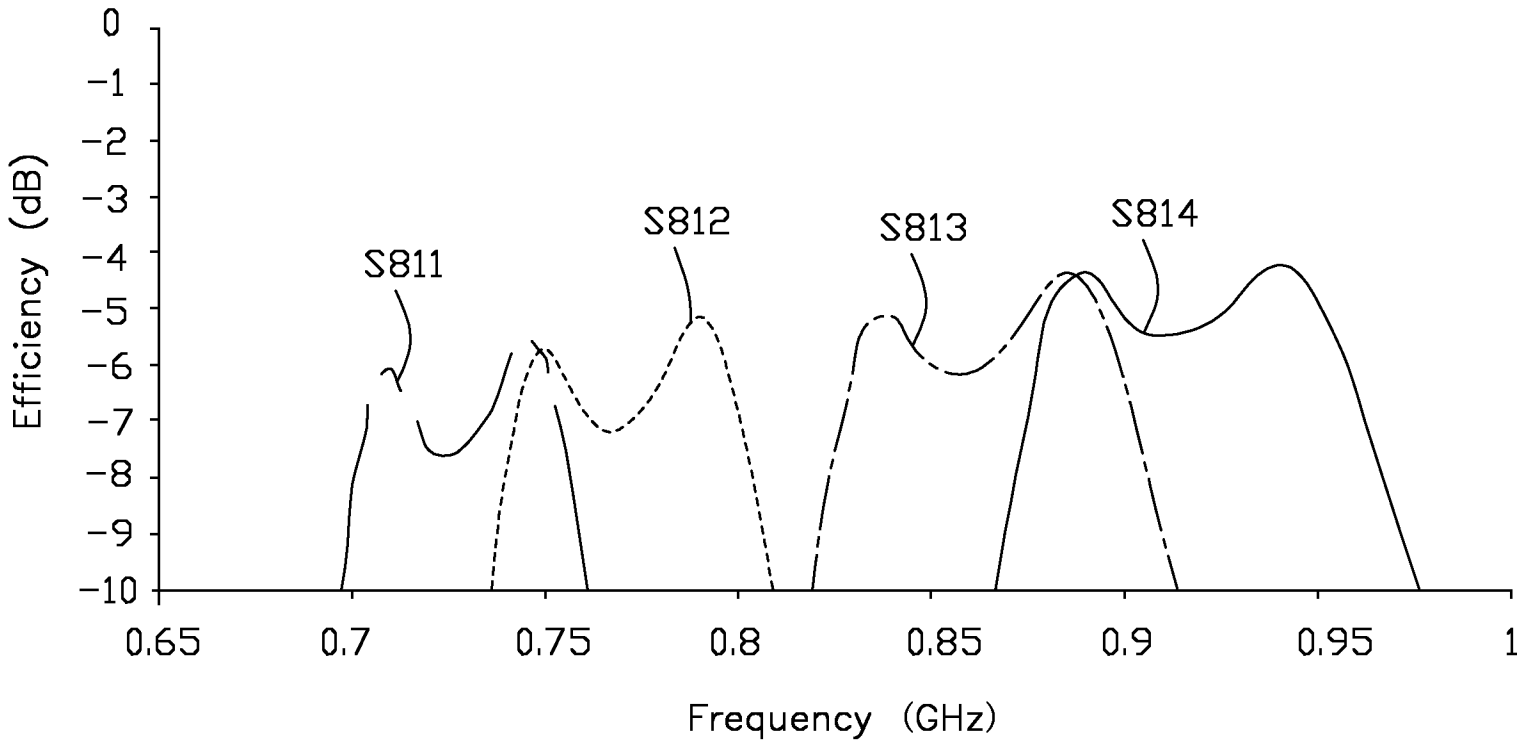
FIG. 81 is a radiating efficiency graph when the antenna structure of FIG. 78 works at a low frequency operation mode.

FIG. 81 illustrates a radiating efficiency graph of the antenna structure 700*a*, when the antenna structure 700*a* works at the low frequency operation mode. Curve S811 illustrates a radiating efficiency when the antenna structure 700*a* works at a frequency band of about 704-746 MHz (LTE-A Band 17). Curve S812 illustrates a radiating efficiency when the antenna structure 700*a* works at a frequency band of about 746-787 MHz (LTE-A Band 13). Curve S813 illustrates a radiating efficiency when the antenna structure 700*a* works at a frequency band of about 824-894 MHz (LTE-A Band 5). Curve S814 illustrates a radiating efficiency when the antenna structure 700*a* works at a frequency band of about 880-960 MHz (LTE-A Band 8).

Curves S811-S814 respectively correspond to four different frequency bands and respectively correspond to four of the plurality of low frequency operation modes of the first switching circuit 75 and the second switching circuit 76.

Figure 82:
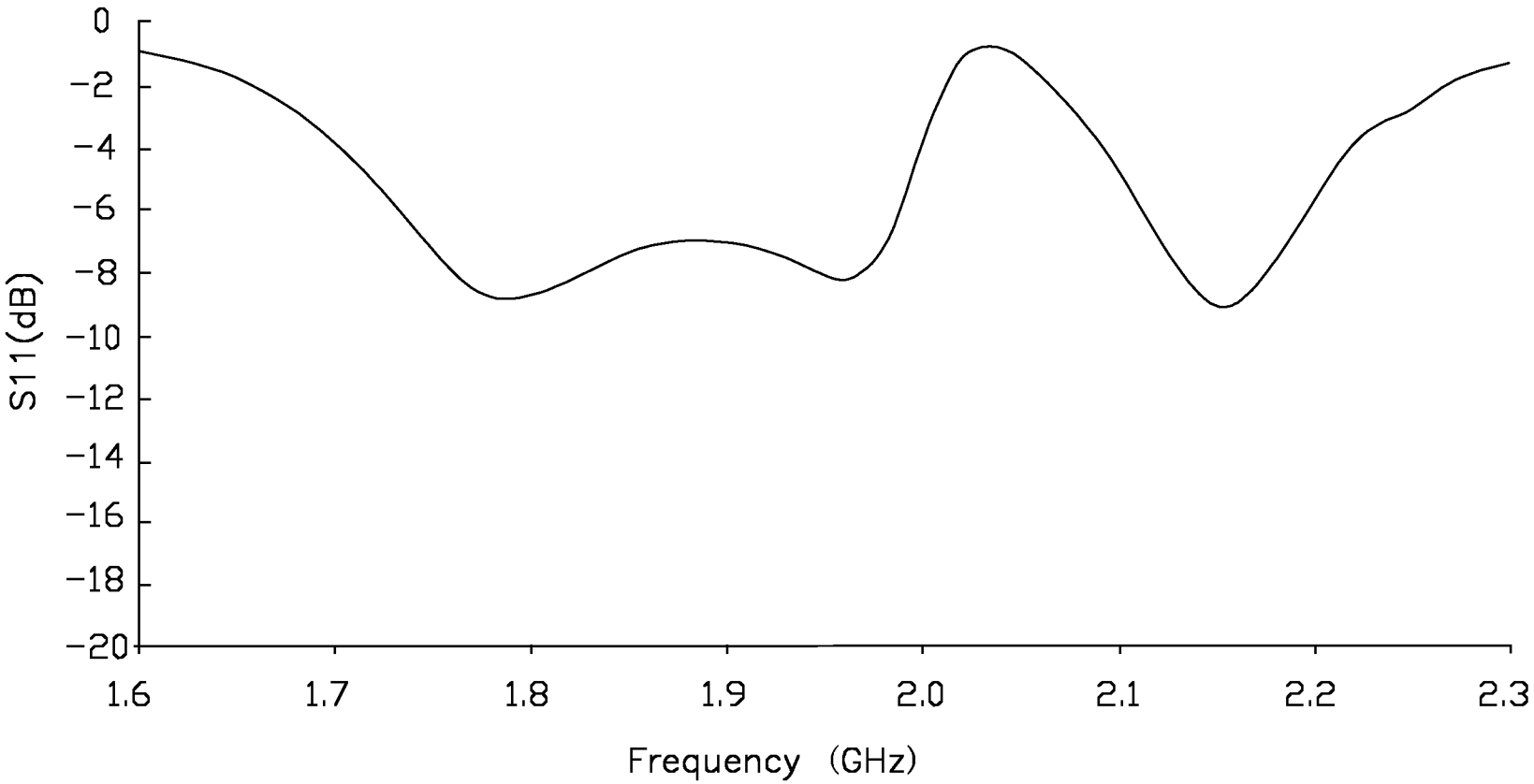
FIG. 82 is a scattering parameter graph when the antenna structure of FIG. 78 works at a middle frequency operation mode.
Figure 83:
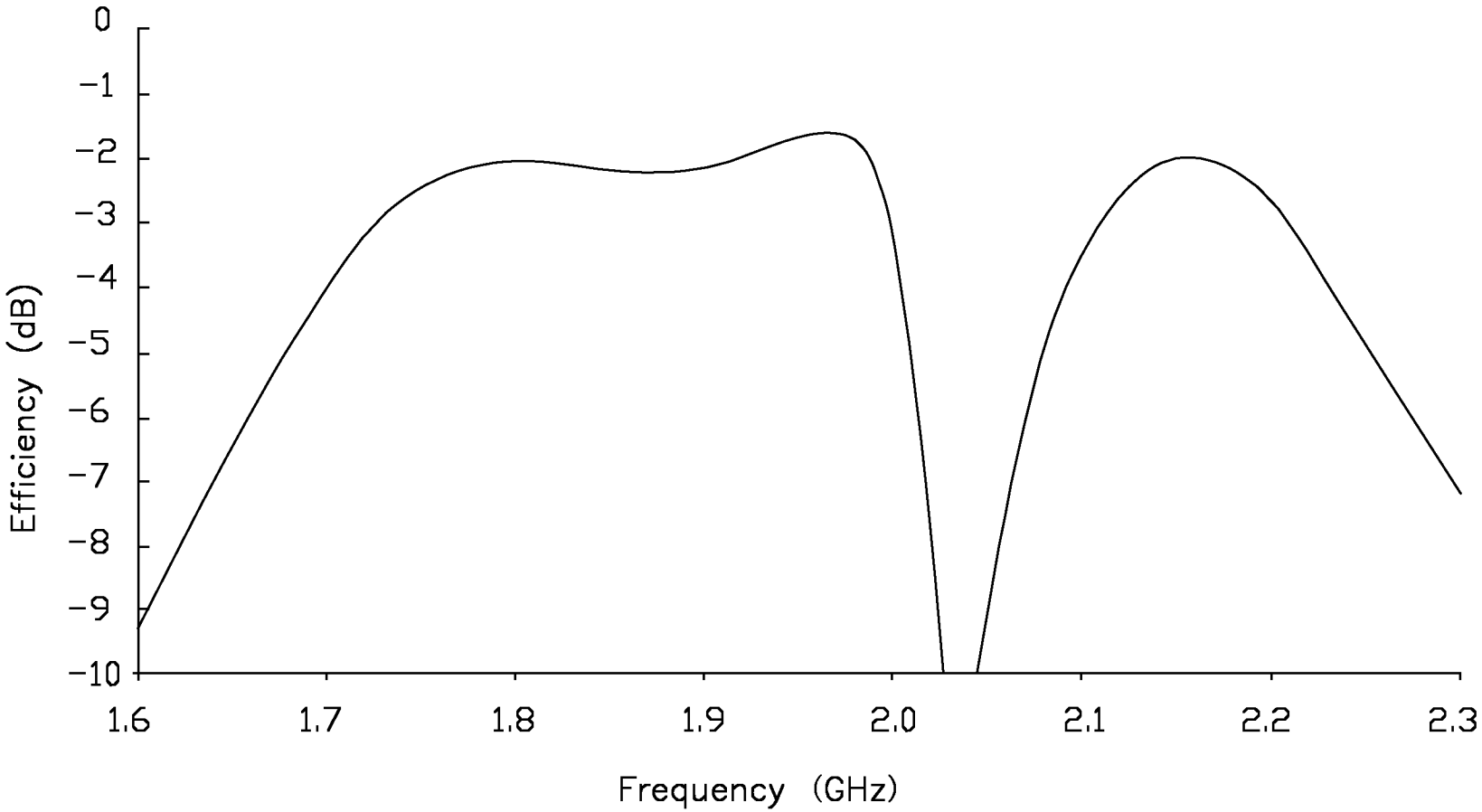
FIG. 83 is a radiating efficiency graph when the antenna structure of FIG. 78 works at a middle frequency operation mode.

FIG. 82 illustrates a scattering parameter graph of the antenna structure 700*a*, when the antenna structure 700*a* works at the middle frequency operation mode (1710-1990 MHz and 2110-2170 MHz). FIG. 83 illustrates a radiating efficiency graph of the antenna structure 700*a*, when the antenna structure 700*a* works at the middle frequency operation mode (1710-1990 MHz and 2110-2170 MHz).

In this exemplary embodiment, when the antenna structure 700*a* works at the high frequency operation mode, a scattering parameter graph and a radiating efficiency graph of the antenna structure 700*a* are consistent with the scattering parameter graph and a radiating efficiency graph of the antenna structure 700 shown in FIG. 76 and FIG. 77.

In this exemplary embodiment, the antenna structure 700*a* includes the first radiator 83, the first radiating portion 731 of the first radiator 83 and the long portion F1 cooperatively a coupling structure. The second radiating portion 831 and the short portion F2 cooperatively a coupling structure. That is, the first radiator 83, the long portion F1, and the short portion F2 cooperatively form a full-coupling feed structure. The long portion F1 and the short portion F2 respectively activate a first mode and a second mode. The configuration of the full-coupling feed structure ensures a flexibility for adjusting the antenna structure 700*a* and can effectively decrease a nonmetallic area of the antenna structure 700*a*.

In addition, the antenna structure 700*a* includes the first switching circuit 75 and the second switching circuit 76, the first mode can be effectively adjusted and switched. The antenna structure 700*a* further includes the resonance circuit 77, then the long portion F1 can activate an additional middle frequency operation mode (the third mode). The antenna structure 700*a* includes the second radiator 78 and the third switching circuit 79, the antenna structure 700*a* can activate a high frequency operation mode and the high frequency band of the antenna structure 700*a* can be effectively adjusted to obtain a good operating bandwidth.

As described above, the first radiator 73/83 is coupled with the long portion F1, thus the long portion F1 can activate a first mode to generate radiation signals in a low frequency band. The first radiator 73/83 is directly connected to or coupled to the short portion F2, then the short portion F2 can activate a second mode to generate radiation signals in a middle frequency band. That is, the first radiator 73/83 can form a half-coupling feed structure or a full-coupling feed structure with the long portion F1 and the short portion F2, and the long portion F1 and the short portion F2 cooperatively activate the first mode and the second mode. The long portion F1 is coupled with the short portion F2 through the gap 720, and through the resonance circuit 77, the long portion F1 can activate an additional third mode to generate radiation signals in a middle frequency band. The second radiator 78 can activate a fourth mode to generate radiation signals in a high frequency band. The wireless communication device 800 can use carrier aggregation (CA) technology of LTE-A to receive and/or transmit wireless signals at multiple frequency bands simultaneously. In detail, the wireless communication device 800 can use the CA technology and use at least two of the long portion F1, the short portion F2, the first radiator 73/83, and the second radiator 78 to receive and/or transmit wireless signals at multiple frequency bands simultaneously.

The antenna structure 100 of first exemplary embodiment, the antenna structure 200 of second exemplary embodiment, the antenna structure 500 of third exemplary embodiment, the antenna structure 500*a* of fourth exemplary embodiment, the antenna structure 500*b* of fifth exemplary embodiment, the antenna structure 700 of sixth exemplary embodiment, and the antenna structure 700*a* of seventh exemplary embodiment can be applied to one wireless communication device. For example, the antenna structure 100 or 200 can be positioned at an upper end of the wireless communication device to serve as an auxiliary antenna. The antenna structures 500, 500*a*, 500*b*, 700, or 700*a* can be positioned at a lower end of the wireless communication device to serve as a main antenna. When the wireless communication device transmits wireless signals, the wireless communication device can use the main antenna to transmit wireless signals. When the wireless communication device receives wireless signals, the wireless communication device can use the main antenna and the auxiliary antenna to receive wireless signals.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a metal housing, the metal housing comprising a front frame, a backboard, and a side frame, the side frame being positioned between the front frame and the backboard; wherein the side frame defines a slot and the front frame defines a gap, the gap communicates with the slot and extends across the front frame; the metal housing is divided into at least a long portion and a short portion by the slot and the gap;

a first feed source;

a first radiator, the radiator positioned in the housing and comprising a first radiating portion and a second radiating portion;

a first switching circuit; and a second switching circuit;

wherein one end of the first radiating portion is electrically connected to the first feed source, another end of the first radiating portion is spaced apart from the long portion; one end of the second radiating portion is electrically connected to the first feed source, and another end of the second radiating portion is spaced apart from the short portion;

wherein the side frame comprises an end portion, a first side portion, and a second side portion, the first side portion and the second side portion are respectively connected to two ends of the end portion; the slot is defined at least on the end portion; the first radiating portion comprises a first radiating section, a second radiating section, and a third radiating section, the first radiating section is electrically connected to the first feed source and extends along a direction parallel to the end portion towards the first side portion until the first radiating section passes over the gap; one end of the second radiating section is perpendicularly connected to an end of the first radiating section away from the first feed source, another end of the second radiating section extends along a direction parallel to the second side portion towards the long portion and forms an L-shaped structure with the first radiating section; the third radiating section is spaced apart from and parallel to the long portion, the third radiating section is perpendicularly connected to the end of the second radiating section away from the first radiating section and extends along two directions being towards the first side portion and towards the second side portion, to form a T-shaped structure with the second radiating section;

wherein a first portion of the front frame extending from a first side of the gap to a first end of the slot forms the long portion, when the first feed source supplies current, the current flows through the first radiating section, the second radiating section, and the third radiating section, the current is further coupled to the long portion through the third radiating section, flows through the first side portion from the long portion, and flows towards the backboard to activate a first mode to generate radiation signals in a first frequency band; and wherein the first switching circuit comprises a first switching unit and a plurality of first switching elements, the first switching unit is electrically connected to the long portion, the first switching elements are connected in parallel, one end of each first switching element is electrically connected to the first switching unit, and another end of each first switching element is electrically connected to the backboard; the second switching circuit comprises a second switching unit and a plurality of second switching elements, the second switching unit is electrically connected to the first feed source and the first radiator through a matching circuit, the second switching elements are connected in parallel, one end of each second switching element is electrically connected to the second switching unit, and another end of each second switching element is electrically connected to the backboard; and through controlling the first switching unit and/or of the second switching unit to switch, the first switching unit and/or the second switching unit are switched to different first switching elements and/or second switching elements and the first frequency band is adjusted.

2. The antenna structure of claim 1, wherein the slot and the gap are both filled with insulating material.

3. The antenna structure of claim 1, wherein the second radiating portion comprises a first coupling section, a second coupling section, and a third coupling section; the first coupling section is electrically connected to the first radiating section and the first feed source, and extends along a direction parallel to the end portion towards the second side portion to be collinear with the first radiating section; one end of the second coupling section is perpendicularly connected to the end of the first coupling section away from the first feed source, another end of the second coupling section extends along a direction parallel to the second radiating section towards the end portion; the second coupling section, the first radiating section, the second radiating section, and the first coupling section cooperatively form a U-shaped structure; the third coupling section is spaced apart from and parallel to the short portion; the third coupling section is electrically connected to the end of the second coupling section away from the first coupling section, the third coupling section extends along two directions towards the first side portion and the second side portion respectively to form a T-shaped structure with the second coupling section.

4. The antenna structure of claim 3, wherein a second portion of the front frame extending from a second side of the gap to a second end of the slot forms the short portion, the long portion is longer than the short portion; when the first feed source supplies current, the current flows through the first coupling section, the second coupling section, and the third coupling section, the current is then coupled to the short portion through the third coupling section, flows through the second side portion, and flows towards the backboard to activate a second mode to generate radiation signals in a second frequency band, a frequency of the second frequency band is higher than a frequency of the first frequency band; when the first feed source supplies current, the current is coupled to the short portion through the third coupling section, is coupled to the long portion through the gap, flows through the first switching circuit, and flows towards the backboard to activate a third mode to generate radiation signals in a third frequency band; a frequency of the third frequency band is higher than the frequency of the second frequency band.

5. The antenna structure of claim 4, further comprising only one resonance circuit, wherein the resonance circuit is electrically connected between the long portion and the backboard.

6. The antenna structure of claim 4, further comprising a plurality of resonance circuits, wherein a number of the resonance circuits is equal to a number of the first switching elements, each resonance circuit is electrically connected in parallel to one of the first switching elements between the first switching unit and the backboard, when the first frequency band is adjusted, the plurality of resonance circuits keeps the third frequency band unchanged.

7. The antenna structure of claim 4, further comprising a plurality of resonance circuits, wherein a number of the resonance circuits is equal to a number of the first switching elements, each resonance circuit is electrically connected in parallel to one of the first switching elements between the first switching unit and the backboard, when the first frequency band is adjusted, the plurality of resonance circuits correspondingly adjusts the third frequency band.

8. The antenna structure of claim 1, further comprising a second radiator and a second feed source, wherein the second radiator is positioned adjacent to the long portion, the second radiator is substantially rectangular, the second radiator is electrically connected to the front frame and extends towards the second side portion; the second feed source is positioned on the front frame and is electrically connected to the second radiator; when the second feed source supplies current, the current flows through the second radiator to activate a fourth mode to generate radiation signals in a fourth frequency band.

9. The antenna structure of claim 8, further comprising a third switching circuit, wherein one end of the third switching circuit is electrically connected to the second radiator and another end of the third switching circuit is electrically connected to the backboard for adjusting the fourth frequency band.

10. The antenna structure of claim 8, wherein a wireless communication device uses at least two of the long portion, the short portion, the first radiator, and the second radiator to receive and/or transmit wireless signals at multiple frequency bands simultaneously through carrier aggregation (CA) technology of mobile broadband communication.

11. The antenna structure of claim 1, wherein the backboard is an integral and single metallic sheet, the backboard is directly connected to the side frame and there is no gap formed between the backboard and the side frame, the backboard does not define any slot, break line, and/or gap for dividing the backboard.

12. A wireless communication device comprising:

an antenna structure, the antenna structure comprising:

a metal housing, the metal housing comprising a front frame, a backboard, and a side frame, the side frame being positioned between the front frame and the backboard; wherein the side frame defines a slot and the front frame defines a gap, the gap communicates with the slot and extends across the front frame; the metal housing is divided into at least a long portion and a short portion by the slot and the gap;

a first feed source;

a first radiator, the radiator positioned in the housing and comprising a first radiating portion and a second radiating portion;

a first switching circuit; and a second switching circuit;

wherein one end of the first radiating portion is electrically connected to the first feed source, another end of the first radiating portion is spaced apart from the long portion; one end of the second radiating portion is electrically connected to the first feed source, and another end of the second radiating portion is spaced apart from the short portion;

wherein the side frame comprises an end portion, a first side portion, and a second side portion, the first side portion and the second side portion are respectively connected to two ends of the end portion; the slot is defined at least on the end portion; the first radiating portion comprises a first radiating section, a second radiating section, and a third radiating section, the first radiating section is electrically connected to the first feed source and extends along a direction parallel to the end portion towards the first side portion until the first radiating section passes over the gap; one end of the second radiating section is perpendicularly connected to an end of the first radiating section away from the first feed source, another end of the second radiating section extends along a direction parallel to the second side portion towards the long portion and forms an L-shaped structure with the first radiating section; the third radiating section is spaced apart from and parallel to the long portion, the third radiating section is perpendicularly connected to the end of the second radiating section away from the first radiating section and extends along two directions being towards the first side portion and towards the second side portion, to form a T-shaped structure with the second radiating section;

wherein a first portion of the front frame extending from a first side of the gap to a first end of the slot forms the long portion, when the first feed source supplies current, the current flows through the first radiating section, the second radiating section, and the third radiating section, the current is further coupled to the long portion through the third radiating section, flows through the first side portion from the long portion, and flows towards the backboard to activate a first mode to generate radiation signals in a first frequency band, wherein the first switching circuit comprises a first switching unit and a plurality of first switching elements, the first switching unit is electrically connected to the long portion, the first switching elements are connected in parallel, one end of each first switching element is electrically connected to the first switching unit, and another end of each first switching element is electrically connected to the backboard; the second switching circuit comprises a second switching unit and a plurality of second switching elements, the second switching unit is electrically connected to the first feed source and the first radiator through a matching circuit, the second switching elements are connected in parallel, one end of each second switching element is electrically connected to the second switching unit, and another end of each second switching element is electrically connected to the backboard; and through controlling the first switching unit and/or the second switching unit to switch, the first switching unit and/or the second switching unit are switched to different first switching elements and/or second switching elements and the first frequency band is adjusted.

13. The wireless communication device of claim 12, further comprising a display, wherein the front frame, the backboard, and the side frame cooperatively form a metal housing of the wireless communication device, the front frame defines an opening, the display is received in the opening, a display surface of the display is exposed at the opening and is positioned parallel to the backboard.

14. The wireless communication device of claim 12, further comprising a Universal Serial Bus (USB) module, wherein the side frame defines a through hole, the USB module corresponds to the through hole and is partially exposed from the through hole.

15. The wireless communication device of claim 12, wherein the slot and the gap are both filled with insulating material.

16. The wireless communication device of claim 12, wherein the second radiating portion comprises a first coupling section, a second coupling section, and a third coupling section; the first coupling section is electrically connected to the first radiating section and the first feed source, and extends along a direction parallel to the end portion towards the second side portion to be collinear with the first radiating section; one end of the second coupling section is perpendicularly connected to the end of the first coupling section away from the first feed source, another end of the second coupling section extends along a direction parallel to the second radiating section towards the end portion; the second coupling section, the first radiating section, the second radiating section, and the first coupling section cooperatively form a U-shaped structure; the third coupling section is spaced apart from and parallel to the short portion; the third coupling section is electrically connected to the end of the second coupling section away from the first coupling section, the third coupling section extends along two directions towards the first side portion and the second side portion respectively to form a T-shaped structure with the second coupling section.

17. The wireless communication device of claim 16, wherein a second portion of the front frame extending from a second side of the gap to a second end of the slot forms the short portion, the long portion is longer than the short portion; when the first feed source supplies current, the current flows through the first coupling section, the second coupling section, and the third coupling section, the current is then coupled to the short portion through the third coupling section, flows through the second side portion, and flows towards the backboard to activate a second mode to generate radiation signals in a second frequency band, a frequency of the second frequency band is higher than a frequency of the first frequency band; when the first feed source supplies current, the current is coupled to the short portion through the third coupling section, is coupled to the long portion through the gap, flows through the first switching circuit, and flows towards the backboard to activate a third mode to generate radiation signals in a third frequency band; a frequency of the third frequency band is higher than the frequency of the second frequency band.

18. The wireless communication device of claim 17, wherein the antenna structure further comprises only one resonance circuit, the resonance circuit is electrically connected between the long portion and the backboard.

19. The wireless communication device of claim 17, wherein the antenna structure further comprises a plurality of resonance circuits, a number of the resonance circuits is equal to a number of the first switching elements, each resonance circuit is electrically connected in parallel to one of the first switching elements between the first switching unit and the backboard, when the first frequency band is adjusted, the plurality of resonance circuits keeps the third frequency band unchanged.

20. The wireless communication device of claim 17, wherein the antenna structure comprises a plurality of resonance circuits, a number of the resonance circuits is equal to a number of the first switching elements, each resonance circuit is electrically connected in parallel to one of the first switching elements between the first switching unit and the backboard, when the first frequency band is adjusted, the plurality of resonance circuits correspondingly adjusts the third frequency band.

21. The wireless communication device of claim 12, wherein the antenna structure further comprises a second radiator and a second feed source, the second radiator is positioned adjacent to the long portion, the second radiator is substantially rectangular, the second radiator is electrically connected to the front frame and extends towards the second side portion; the second feed source is positioned on the front frame and is electrically connected to the second radiator; when the second feed source supplies current, the current flows through the second radiator to activate a fourth mode to generate radiation signals in a fourth frequency band.

22. The wireless communication device of claim 21, wherein the antenna structure further comprises a third switching circuit, one end of the third switching circuit is electrically connected to the second radiator and another end of the third switching circuit is electrically connected to the backboard for adjusting the fourth frequency band.

23. The wireless communication device of claim 21, wherein the wireless communication device uses at least two of the long portion, the short portion, the first radiator, and the second radiator to receive and/or transmit wireless signals at multiple frequency bands simultaneously through carrier aggregation (CA) technology of mobile broadband communication.

24. The wireless communication device of claim 12, wherein the backboard is an integral and single metallic sheet, the backboard is directly connected to the side frame and there is no gap formed between the backboard and the side frame, the backboard does not define any slot, break line, and/or gap for dividing the backboard.

* * * * *